US008940467B2

(12) United States Patent
Hashimoto et al.

(10) Patent No.: US 8,940,467 B2
(45) Date of Patent: Jan. 27, 2015

(54) TONER

(71) Applicant: Canon Kabushiki Kaisha, Tokyo (JP)

(72) Inventors: Yasuhiro Hashimoto, Mishima (JP); Takayuki Toyoda, Yokohama (JP); Masashi Kawamura, Yokohama (JP); Naotaka Ikeda, Suntou-gun (JP); Hidekazu Fumita, Gotemba (JP); Emi Watanabe, Suntou-gun (JP); Yuhei Terui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 13/777,969

(22) Filed: Feb. 26, 2013

(65) Prior Publication Data

US 2013/0244165 A1 Sep. 19, 2013

(30) Foreign Application Priority Data

Feb. 29, 2012 (JP) ..... 2012-044322

(51) Int. Cl.
*G03G 9/00* (2006.01)
*G03G 9/087* (2006.01)
*G03G 9/09* (2006.01)

(52) U.S. Cl.
CPC ..... *G03G 9/087* (2013.01); *G03G 9/08708* (2013.01); *G03G 9/08711* (2013.01); *G03G 9/08722* (2013.01); *G03G 9/08728* (2013.01); *G03G 9/08755* (2013.01); *G03G 9/08757* (2013.01); *G03G 9/091* (2013.01)
USPC ..... 430/108.22; 430/108.23; 430/108.8; 430/109.1; 430/109.31; 430/137.1; 430/137.18

(58) Field of Classification Search
USPC ..... 430/108.22, 108.23, 137.1, 137.18, 430/108.8, 108.1, 109.1, 109.31
See application file for complete search history.

(56) References Cited

U.S. PATENT DOCUMENTS

| | | | | |
|---|---|---|---|---|
| 5,601,913 | A | 2/1997 | Ohtani et al. | |
| 6,627,374 | B2 | 9/2003 | Fumita et al. | |
| 6,835,521 | B2 | 12/2004 | Tsuji et al. | |
| 6,936,394 | B2 | 8/2005 | Okado et al. | |
| 6,951,704 | B2 | 10/2005 | Tsuji et al. | |
| 7,112,393 | B2 | 9/2006 | Komoto et al. | |
| 7,141,342 | B2 | 11/2006 | Toyoda et al. | |
| 7,264,910 | B2 | 9/2007 | Toyoda et al. | |
| 7,288,357 | B2 | 10/2007 | Toyoda et al. | |
| 7,459,253 | B2 | 12/2008 | Abe et al. | |
| 7,611,816 | B2 | 11/2009 | Tsuji et al. | |
| 7,704,661 | B2 | 4/2010 | Ikeda et al. | |
| 7,833,685 | B2 | 11/2010 | Tanaka et al. | |
| 7,833,687 | B2 | 11/2010 | Kato et al. | |
| 8,053,156 | B2 | 11/2011 | Abe et al. | |
| 8,211,606 | B2 | 7/2012 | Murai et al. | |
| 8,247,147 | B2 | 8/2012 | Abe et al. | |
| 8,367,289 | B2 | 2/2013 | Isono et al. | |
| 8,377,616 | B2 | 2/2013 | Tani et al. | |
| 8,440,382 | B2 | 5/2013 | Isono et al. | |
| 8,628,899 | B2 * | 1/2014 | Kawamura et al. | 430/108.22 |
| 2009/0130582 | A1 | 5/2009 | Handa et al. | |
| 2009/0226840 | A1 | 9/2009 | Fumita et al. | |
| 2011/0097660 | A1 | 4/2011 | Sugiyama et al. | |
| 2011/0136054 | A1 | 6/2011 | Watanabe et al. | |
| 2012/0040285 | A1 | 2/2012 | Shibata et al. | |
| 2012/0231388 | A1 * | 9/2012 | Kawamura et al. | 430/108.23 |
| 2012/0315574 | A1 | 12/2012 | Nonaka et al. | |
| 2013/0095421 | A1 | 4/2013 | Tanaka et al. | |
| 2013/0224647 | A1 | 8/2013 | Ikeda et al. | |

FOREIGN PATENT DOCUMENTS

| | | | |
|---|---|---|---|
| JP | 6-148927 | A | 5/1994 |
| JP | 7-219274 | A | 8/1995 |
| JP | 3285623 | B2 | 5/2002 |
| JP | 2006-301218 | A | 11/2006 |
| JP | 2010-152208 | A | 7/2010 |
| JP | 4510687 | B2 | 7/2010 |

* cited by examiner

*Primary Examiner* — Thorl Chea
(74) *Attorney, Agent, or Firm* — Fitzpatrick, Cella, Harper and Scinto

(57) ABSTRACT

A toner is provided that, even in a small amount thereof, gives a satisfactory image density and that is free of image problems, e.g., fogging and offset resistance, even during long-term use and in a high-temperature, high-humidity environment. The toner contains a binder resin, a pigment, and a prescribed azo compound wherein, designating as (A) the solubility of the azo compound in a toluene-hexane solubility test and as (B) the solubility of the binder resin constituting the toner in the toluene-hexane solubility test, the (A) and the (B) satisfy the relationship $|(B)-(A)| \leq 60$.

14 Claims, 4 Drawing Sheets

TONER

BACKGROUND OF THE INVENTION

1. Field of the Invention

The present invention relates to a toner that is used, for example, in electrophotographic methods, electrostatic recording methods, and toner jet methods.

2. Description of the Related Art

There has been increasing desire in recent years for less expensive and smaller copiers and printers.

Corresponding to this demand, toners are being required that provide a desirable image density at smaller amounts and that can generate a high image quality even during long-term use and use in a high-temperature, high-humidity environment or a low-temperature, low-humidity environment.

In response to these requirements, a method exists that provides a toner that even in small amounts exhibits a high tinting strength; this is achieved by using a pigment dispersing agent that has at least one aromatic skeleton as well as a base skeleton that is compatible with the binder resin, thereby maintaining pigment dispersity by π-π interactions by the π-electrons of the aromatic ring in the pigment dispersing agent (for example, Japanese Patent laid-open No. 2010-152208).

However, some problems are still present in terms of the offset resistance and fogging in a high-temperature, high-humidity environment or a low-temperature, low-humidity environment.

Moreover, a method exists that provides a toner in which the offset resistance coexists in balance with a high image quality; this is achieved by specifying certain prescribed ranges for the SP values of the binder resin and a resin used for pigment dispersion, thereby maintaining a uniform dispersion of the pigment and suppressing a highly disperse state by a polyolefin wax in the binder resin (for example, Japanese Patent laid-open No. H07-219274).

However, the tinting strength of the toner is not adequate due to an inadequate state of dispersion by the pigment in the toner and some problems are also still present with respect to fogging in a high-temperature, high-humidity environment or a low-temperature, low-humidity environment.

In addition to the preceding, various pigment dispersing agents have been proposed in order to improve the dispersion of the pigment in the toner. For example, a toner has been disclosed that contains a binder resin, carbon black, and a graft copolymer or block copolymer comprising a styrene-type polymer and an acrylate ester-type polymer or a methacrylate ester-type polymer (for example, Japanese Patent Publication No. 3,285,623).

A method has also been disclosed for producing a toner particle that contains an amide group-bearing compound and a zinc phthalocyanine compound (for example, Japanese Patent Publication No. 4,510,687).

However, in both instances some problems still remain with respect to the charging performance in particular in a high-temperature, high-humidity environment.

SUMMARY OF THE INVENTION

An object of the present invention is to provide a toner that solves the problems identified above.

Thus, an object of the present invention is to provide a toner that gives a satisfactory image density even at small amounts and that is free of image problems, such as fogging and a reduced offset resistance, even during long-term use and even during use in a high-temperature, high-humidity environment or a low-temperature, low-humidity environment.

The present invention relates to a toner that contains a binder resin, a pigment, and an azo compound, wherein the azo compound contains a polymer component, a moiety in the azo compound other than the polymer component is represented by the following general formula (1)

formula (1)

[C1]

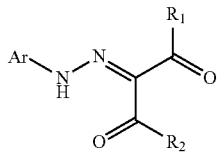

[in general formula (1), any one of $R_1$, $R_2$, and Ar is bound to the polymer component with a single bond or a linking group;

$R_1$ not bound to the polymer component represents a monovalent group selected from the group consisting of an alkyl group, phenyl group, $OR_4$ group, and $NR_5R_6$ group (in which $R_4$ to $R_6$ each independently represent a hydrogen atom, alkyl group, phenyl group, or aralkyl group);

$R_1$, which is bound to the polymer component with a single bond or a linking group, represents a divalent group of which a hydrogen atom is removed from the corresponding monovalent group of $R_1$ and the linking group is a divalent linking group selected from the group consisting of an amide group, ester group, urethane group, urea group, alkylene group, phenylene group, —O—, —$NR_3$—, and —$NHCH(CH_2OH)CH_2$— wherein $R_3$ represents a hydrogen atom, alkyl group, phenyl group, or aralkyl group; $R_2$ not bound to the polymer component represents a monovalent group selected from the group consisting of an alkyl group, phenyl group, $OR_8$ group, and $NR_9R_{10}$ group wherein $R_8$ to $R_{10}$ each independently represent a hydrogen atom, alkyl group, phenyl group, or aralkyl group; $R_2$, which is bound to the polymer component with a single bond or a linking group, represents a divalent group of which a hydrogen atom is removed from the corresponding monovalent group of $R_2$, and the linking group is a divalent linking group selected from the group consisting of an alkylene group, phenylene group, carboxylate ester group, carboxylamide group, sulfonate ester group, sulfonamide group, —O—, —$NR_7$—, and —$NHCH(CH_2OH)CH_2$— wherein $R_7$ represents a hydrogen atom, alkyl group, phenyl group, or aralkyl group;

Ar not bound to the polymer component represents an aryl group; Ar, which is bound to the polymer component with a single bond or a linking group, represents a divalent group of which a hydrogen atom is removed from the corresponding aryl group of Ar, and the linking group is a divalent linking group selected from the group consisting of an amide group, ester group, urethane group, urea group, alkylene group, phenylene group, —O—, —NR—, and —$NHCH(CH_2OH)CH_2$— wherein $R_3$ represents a hydrogen atom, alkyl group, phenyl group or aralkyl group); and designating as (A) the solubility for the azo compound in a toluene-hexane solubility test and designating as (B) the solubility for the binder resin in the toluene-hexane solubility test, the (A) and the (B) satisfy the relationship $|(B)-(A)| \leq 60$.

DESCRIPTION OF THE EMBODIMENTS

Figure 1:
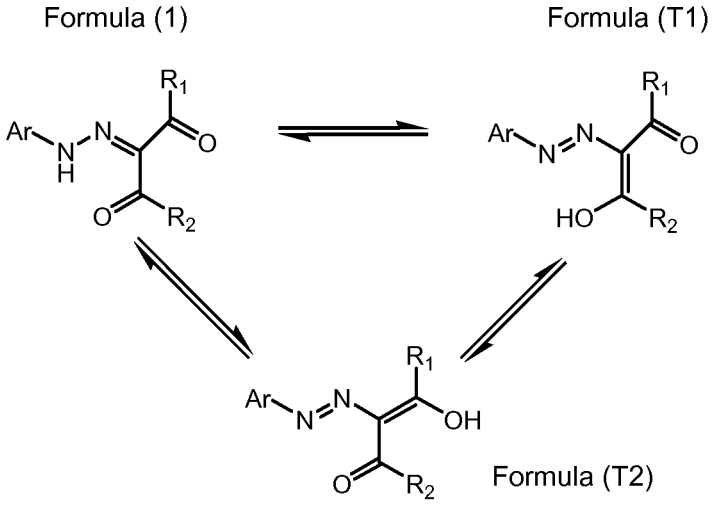
FIG. 1 is a diagram that shows the tautomers that the azo compound with general formula (1) can assume.

The present invention is described in detail herebelow.

The toner of the present invention accrues the effects of the present invention as described above by bringing the difference between (A) and (B) (|(B)−(A)|) into a favorable range in a toner containing a binder resin, pigment, and an azo compound having a prescribed structure, where (A) is the solubility for this azo compound in a toluene-hexane solubility test and (B) is the solubility for the binder resin in the toluene-hexane solubility test.

While the reasons for the appearance of the effects of the present invention are not necessarily clear, the present inventors hold the following views.

When the structure of a pigment dispersing agent includes an adsorption group that adsorbs to the surface of the pigment and a dispersing group that inhibits aggregation between pigment particles by, for example, steric hindrance, the adsorption force to the pigment surface exercised by the adsorption group is approximately determined by the polarity, hydrogen bonding, and π-π interactions by the π-electrons. For example, it is thought that when the pigment dispersing agent has a structure that contains an aromatic ring, interaction by the π-electrons in this aromatic ring is produced and the adsorption force by the adsorption group of the pigment dispersing agent to the pigment surface is then strengthened.

However, because toners are a composite of various materials, the adsorption force is believed to also be influenced by factors other than the π-π interactions by the π-electrons on the aromatic ring of the pigment dispersing agent. Generally, the binder resin constituting the toner is frequently a polyester, polyurethane, or styrene-acrylic resin, and, since all of these binder resins also contain aromatic rings, π-π interactions are also produced at the aromatic rings in the binder resin. As a result, the binder resin is thought to interfere with the pigment dispersing agent, resulting in a weakening of the π-π interaction effect by the pigment dispersing agent with the pigment and thus in a weakening of the adsorption force by the absorption group of the pigment dispersing agent for the pigment surface.

As shown below, the tautomers given by general formulas (T1) and (T2) below are present with the azo compound used by the present invention. Due to this, it is thought that, in addition to the π-π interactions at the aryl group in the azo compound with general formula (1), substantially stronger π-π interactions are obtained due to the azo bond directly connected to the aryl group in the azo skeleton moiety structure and due to the resonance structures due to the carbonyl groups, which influence this azo bond and are positioned to engage in resonance. It is also thought that the adsorption force by the azo compound for pigment is strengthened by the effect of the polarity of the hydroxyl group and carbonyl group and the amine structure in the azo skeleton moiety structure. Moreover, the adsorption force is believed to be further strengthened by the appearance of an effect due to hydrogen bonding between the pigment and the polar groups in the azo compound.

In addition to the preceding, the polymer component in the azo compound functions as a dispersing group and makes possible a thorough maintenance of the dispersed state of the pigment by inhibiting aggregation between pigment particles through, for example, steric hindrance.

Accordingly, these tautomers are also within the scope of the present invention.

The azo compound under consideration has less impact on the toner charging performance than is the case for the use of only a polar group, such as an amine structure or the carboxyl group, as the group that adsorbs to the pigment, as is seen in commercially available pigment dispersing agents. The reason for this is as follows: because this azo compound assumes the tautomers as shown below, there is little bias in terms of the electron distribution and there is then not a strong positivity or negativity in relation to the charging performance. In addition to this, the adsorption force to the pigment is stronger due to the three effects identified above, i.e., the π-π interactions, polarity, and hydrogen bonding, than for the case of polar groups alone, and as a consequence the dispersed state of the pigment is well maintained; in addition, release of the azo compound from the pigment is also inhibited and due to this excellent effects are generated not just for the tinting strength of the toner, but also for the charging performance.

[C2]

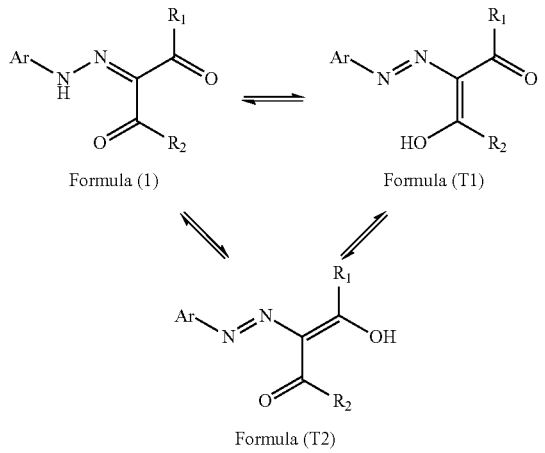

[$R_1$, $R_2$, and Ar in formulas (T1) and (T2) have the same definitions, respectively, as the $R_1$, $R_2$, and Ar in formula (1).]

(The Azo Compound Used in the Present Invention)

The azo compound of the present invention contains a polymer component and a moiety not including the polymer component is represented by the following general formula (1). This azo compound will be considered in detail.

formula (1)

[C3]

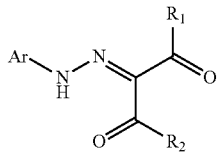

any one of $R_1$, $R_2$, and Ar is bound to the polymer component with a single bond or a linking group;

$R_1$ not bound to the polymer component represents a monovalent group selected from the group consisting of an alkyl group, phenyl group, $OR_4$ group, and $NR_5R_6$ group (in which $R_4$ to $R_6$ each independently represent a hydrogen atom, alkyl group, phenyl group, or aralkyl group);

$R_1$, which is bound to the polymer component with a single bond or a linking group, represents a divalent group of which a hydrogen atom is removed from the corresponding monovalent group of $R_8$ and the linking group is a divalent linking group selected from the group consisting of an amide group, ester group, urethane group, urea group, alkylene group, phenylene group, —O—, —$NR_3$—, and —$NHCH(CH_2OH)CH_2$— wherein $R_3$ represents a hydrogen atom, alkyl group, phenyl group, or aralkyl group;

$R_2$ not bound to the polymer component represents a monovalent group selected from the group consisting of an alkyl group, phenyl group, $OR_8$ group, and $NR_8R_{10}$ group wherein $R_8$ to $R_{10}$ each independently represent a hydrogen atom, alkyl group, phenyl group, or aralkyl group;

$R_2$, which is bound to the polymer component with a single bond or a linking group, represents a divalent group of which a hydrogen atom is removed from the corresponding monovalent group of $R_2$, and the linking group is a divalent linking group selected from the group consisting of an alkylene group, phenylene group, carboxylate ester group, carboxylamide group, sulfonate ester group, sulfonamide group, —O—, —$NR_7$—, and —$NHCH(CH_2OH)CH_2$— wherein $R_7$ represents a hydrogen atom, alkyl group, phenyl group, or aralkyl group;

Ar not bound to the polymer component represents an aryl group;

Ar, which is bound to the polymer component with a single bond or a linking group, represents a divalent group of which a hydrogen atom is removed from the corresponding aryl group of Ar, and the linking group is a divalent linking group selected from the group consisting of an amide group, ester group, urethane group, urea group, alkylene group, phenylene group, —O—, —$NR_3$—, and —$NHCH(CH_2OH)CH_2$— wherein $R_3$ represents a hydrogen atom, alkyl group, phenyl group or aralkyl group.

The $R_1$ and $R_2$ in general formula (1) are not particularly limited as long as the resonance structures in the tautomers are not impaired and can be freely selected from the hydrogen atom and the substituents listed above.

The alkyl group encompassed by $R_1$ and $R_2$ in general formula (1) can be exemplified in the present invention by alkyl groups having a straight-chain structure, branched structure, or cyclic structure, e.g., methyl, ethyl, n-propyl, n-butyl, n-pentyl, n-hexyl, isopropyl, isobutyl, sec-butyl, tert-butyl, and cyclohexyl.

The aralkyl group encompassed by $R_1$ and $R_2$ in general formula (1) can be exemplified in the present invention by benzyl and phenethyl.

Viewed from the standpoint of the affinity for the aforementioned pigment, $R_1$ in the present invention is preferably a $C_{1-6}$ alkyl group, the phenyl group, the $NH_2$ group, the $OCH_3$ group, or the $0CH_3C_6H_5$ group.

In addition, $R_1$ which is bound to the polymer component with a single or a linking group, preferably represents a divalent group of which a hydrogen atom is removed from the corresponding monovalent group of $R_1$ and the linking group bound to $R_1$ is preferably a divalent linking group selected from the group consisting of the amide group, ester group, urethane group, urea group, alkylene group, phenylene group, —O—, —NH—, and —$NHCH(CH_2OH)CH_2$—.

When the polymer component is bound to $R_1$ with a single bond, the polymer component is bound by substitution for a hydrogen atom on $R_1$; when $R_1$ is bound to a linking group as described above, bonding proceeds by substitution for a hydrogen atom on $R_1$.

The $R_1$ substituent in general formula (1) may be further substituted by a substituent or substituents insofar as the affinity with the pigment is not significantly impaired. The substituent in this case can be exemplified by halogen atoms, the nitro group, the amino group, the hydroxyl group, the cyano group, and the trifluoromethyl group.

Viewed from the standpoint of the affinity for the aforementioned pigment, $R_2$ in the present invention is preferably the $NR_2R_{10}$ group wherein $R_9$ is the hydrogen atom and $R_{10}$ is the phenyl group. The reason here is that this improves the effect of the π-π interactions due to the π-electrons (π-electron interactions) without impairing the effects due to the polarity of the azo compound. This is specifically due to the following: due to intramolecular hydrogen bonding between the hydrogen atom $R_9$ and the oxygen atom in the carbonyl group adjacent to the $R_1$, a π-plane is formed that causes π-electron interactions, while a π-plane originating with the phenyl group in $R_2$ is also present, and as a consequence the π-electron interaction effect is boosted by the presence of these two π-planes. In addition, the case in which $R_2$ is $NR_9R_{10}$, $R_9$ is the hydrogen atom, and $R_{10}$ is the phenyl group is preferred because the amine $NR_9$ forms, through intramolecular hydrogen bonding, a π-plane that causes π-electron interactions and as a consequence there is little impact on the charging performance and the positiveness in charging performance of the toner is also not strengthened.

On the other hand, $R_2$, which is bound to the polymer component with a single bond or a linking group, preferably represents a divalent group of which a hydrogen atom is removed from the corresponding monovalent group of $R_2$, and the linking group bound to $R_2$ is preferably a divalent linking group selected from the group consisting of the alkylene group, phenylene group, carboxylate ester group, carboxylamide group, sulfonate ester group, sulfonamide group, —O—, —NH—, and —$NHCH(CH_2OH)CH_2$—. In addition, when $R_2$ is bound to the polymer component, $R_2$ is more preferably the $NR_9R_{10}$ group wherein $R_9$ is the hydrogen atom, $R_{10}$ is the phenyl group, and the linking group is —NH—.

This is because the π-electron interactions of the azo compound, including the Ar, are stronger in particular than when the Ar in general formula (1) is bound to the polymer component. Thus, when the Ar is bound to the polymer component, the polymer component interferes with the π-electron cloud on the Ar and as a consequence the effects due to the three resonance structures described above, the polarity, and the π-electrons of the azo skeleton moiety structure in general formula (1) do not reach a maximum. In contrast to this, when $R_2$ is the $NR_9R_{10}$ group, $R_9$ is the hydrogen atom, $R_{10}$ is the phenyl group of which a hydrogen atom is removed, and this phenyl group is bound to the polymer with a divalent linking group, the effect that the polymer component exercises on the electron cloud of the azo skeleton moiety structure in formula (1) is reduced due to the action of the π-electrons on the phenyl group $R_{10}$. As a result, there is almost no reduction in the effects from the three resonance structures in general formulas (1), (T1), and (T2), the polarity, and the π-electrons of the azo skeleton moiety structure in general formula (1) and the effects of the present invention are then at a maximum.

When the polymer component is bound to $R_2$ with a single bond, the polymer component is bound by substitution for a hydrogen atom in $R_2$; when a linking group is bound to $R_2$, bonding proceeds by substitution for a hydrogen atom in $R_2$.

Ar represents an aryl group in the present invention and specifically represents, for example, the phenyl group or naphthyl group.

On the other hand, Ar, which is bound to the polymer component with a single bond or a linking group, preferably represents a divalent group of which a hydrogen atom is removed from the corresponding aryl group of Ar and the linking group bound to Ar is preferably a divalent linking group selected from the group consisting of the amide group, ester group, urethane group, urea group, alkylene group, phenylene group, —O—, —$NR_3$—, and —NHCH($CH_2$OH)$CH_2$—.

Moreover, the Ar may be further substituted with a substituent or substituents insofar as the previously described resonance structures are not hindered and the affinity for the pigment is not substantially impaired. The substituent in this case can be exemplified by alkyl groups, alkoxy groups, halogen atoms, the hydroxyl group, the cyano group, trifluoromethyl, the carboxyl group, carboxylate ester groups, and carboxylamide groups.

As noted above, when the polymer component is bound to Ar with a single bond, the polymer component is bound by substitution for a hydrogen atom on the Ar; when a linking group is bound to Ar, bonding proceeds via substitution for a hydrogen atom on the Ar or a hydrogen atom on a substituent on the Ar.

Viewed from the standpoint of the affinity for the pigment, the moiety other than the polymer component in the azo compound with general formula (1) preferably is represented by the following general formula (2) in the present invention.

formula (2)

[C4]

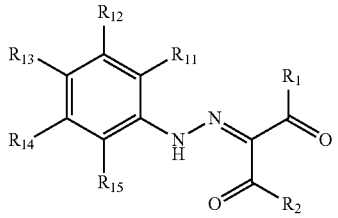

Any one of the $R_1$, $R_2$, and $R_{11}$ to $R_{15}$ in general formula (2) is bound to the polymer component with a single bond or a linking group.

The $R_1$ and $R_2$ and the linking group bound to $R_1$ or $R_2$ have the same definitions, respectively, as provided for $R_1$ and $R_2$ relative to formula (1).

$R_{11}$ to $R_{15}$ not bound to the polymer component each independently represent a monovalent group selected from the group consisting of the hydrogen atom, a $COOR_{16}$ group, and a $CONR_{12}R_{18}$ group (in which $R_{16}$ to $R_{18}$ each independently represent the hydrogen atom, an alkyl group, a phenyl group, or an aralkyl group).

The alkyl encompassed by $R_{16}$ to $R_{18}$ is preferably $C_{1-6}$ alkyl and can be exemplified by alkyl groups having a straight-chain structure, branched structure, or cyclic structure, e.g., methyl, ethyl, n-propyl, n-butyl, n-pentyl, n-hexyl, isopropyl, isobutyl, sec-butyl, tert-butyl, and cyclohexyl. Methyl, ethyl, n-propyl, and isopropyl are preferred among the preceding from the standpoint of avoiding a steric hindrance-induced decline in the affinity for the pigment.

The aralkyl encompassed by $R_{16}$ to $R_{18}$ can be exemplified by benzyl and phenethyl.

When the polymer component is bound to $R_1$, $R_2$, or any of $R_{11}$ to $R_{15}$ with a single bond, the polymer component is bound by substitution for a hydrogen atom on the $R_1$, $R_2$, or any of $R_{11}$ to $R_{15}$; when a linking group is bound to $R_1$, $R_2$, or any of $R_{11}$ to $R_{15}$, bonding proceeds by substitution for a hydrogen atom on the $R_1$, $R_2$, or any of $R_{11}$ to $R_{15}$.

The $R_{11}$ to $R_{15}$ in general formula (2) can be selected from the hydrogen atom, $COOR_{16}$ groups, and $CONR_{17}R_{18}$ groups, but, viewed from the standpoint of the affinity for the pigment, preferably at least one of $R_{11}$ to $R_{15}$ is a $COOR_{16}$ group or $CONR_{17}R_{18}$ group.

For example, when the pigment is carbon black, C. I. Pigment Yellow 74, 93, 139, 155, 180, or 185, C. I. Pigment Red 31, 122, 150, 170, 258, or 269, C. I. Pigment Violet 19, or C. I. Pigment Blue 25 or 26, the use of a $COOR_{16}$ group or $CONR_{17}R_{18}$ group for at least one of $R_{11}$ to $R_{15}$ results in hydrogen bonding by the azo compound of the present invention to carbonyl or secondary amine hydrogen in each of these pigments and thus in an even stronger adsorption between the azo compound and the pigment. Moreover, when the pigment is P.Y. 139, 155, 180, or 185, P.R. 31, 122, 150, or 269, P.V. 19, or carbon black with a primary particle diameter of from at least 14 nm to not more than 80 nm, the use of a $CONR_{17}R_{18}$ group for at least one of $R_{11}$ to $R_{15}$ in the azo compound of the present invention is preferred because this results in the interaction of the amide bond segment with the particular pigment and further strengthens the adsorption force of the adsorption group of the azo compound to the pigment.

The $R_{16}$ to $R_{18}$ in general formula (2) can be freely selected from the hydrogen atom and the substituents listed above, but, viewed from the standpoint of the affinity with the pigment, preferably $R_{16}$ is the methyl group and $R_{17}$ and $R_{18}$ are the hydrogen atom or the methyl group. Thus, in this configuration not only is steric hindrance not produced, but the presence of the ester bond or amide bond raises the adsorption force through the polarity and hydrogen bonding to the pigment.

Examples of combinations of the substituents in general formula (1) are provided and described in the following, but the present invention is not limited to these. The affinity to pigment is improved still further when general formula (1) is represented by the following general formula (3) or (4).

formula (3)

[C5]

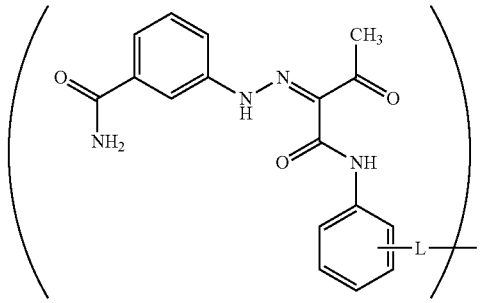

formula (4)

-continued

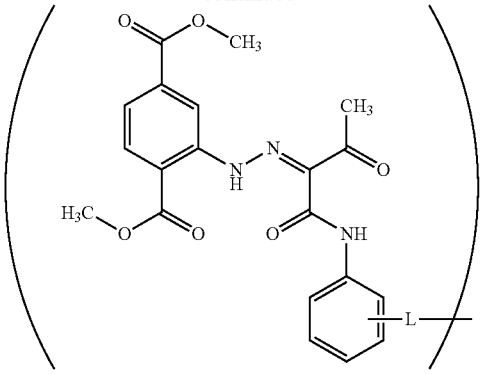

The maximum effect with respect to the pigment used in the present invention is expressed by having the azo bond segment that is bound to the phenyl group and not engaged in bonding to the polymer with a linking group and the amide group reside in the m-position to, as shown in general formula (3), but the o-position and p-position are also permissible.

The effects of the present invention are maximally expressed by having this amide group reside in the m-position because this provides the optimal positional relationship from the standpoint of effecting hydrogen bonding to carbonyl or secondary amine hydrogen in the aforementioned pigments.

In addition, the effects of the present invention are maximally expressed by having the two $COOCH_3$ groups in general formula (4) reside in the o-position and m-position to the azo bond segment that is bound to the phenyl group not engaged in bonding to the polymer with a linking group, but these two $COOCH_3$ groups may be present at any positions.

The "L" in general formulas (3) and (4) represents a linking group that links the polymer component to the azo skeleton moiety structure. This linking group L should be a divalent linking group but is not otherwise particularly limited, and is preferably a divalent linking group selected from the group consisting of alkylene groups, the phenylene group, —O—, —NH—, —NHCH($CH_2$OH)$CH_2$—, carboxylate ester groups, carboxylamide groups, sulfonate ester groups, and sulfonamide groups.

The bonding position of the linking group in general formulas (3) and (4) (the position of substitution for the hydrogen atom on the phenyl group) may be any position relative to the amide group selected from the o-position, m-position, and p-position, and the different positions of substitution have the same influence on the affinity for the pigment.

In order for the azo compound used by the present invention to thoroughly maintain the dispersed state of the pigment in the toner, the polymer component must be maintained in a state in which its molecular chain is thoroughly extended or stretched out in the binder resin that constitutes the toner. Due to this, the polymer component of the azo compound must exhibit an excellent affinity for the binder resin that constitutes the toner. The "affinity for the binder resin" referenced here is the compatibility with the binder resin and denotes the ease of intimate mixing. When the compatibility between the azo compound and the binder resin is poor, it will not be possible to inhibit pigment aggregation because the azo compound will aggregate with itself and because the molecular chain of the polymer component will also contract and a satisfactory steric repulsion effect will not be obtained since the molecular chain will not be adequately extended.

Accordingly, when, for example, the binder resin is a vinyl resin, a vinyl resin is preferably made the main component of the polymer component of the azo compound. When, on the other hand, the binder resin is a polyester resin, a polyester resin is preferably made the main component of the polymer component of the azo compound.

In addition, when the toner is produced by a dissolution suspension method, a structure that exhibits affinity for the organic solvent used during toner production is preferably selected for the polymer component of the azo compound.

As noted above, with reference to the polymer component in the present invention, a vinyl resin is preferably made the main component of the polymer component of the azo compound when the binder resin constituent of the toner is a vinyl resin. A polymer or copolymer containing a monomer unit represented by general formula (5) below as a constituent component is an example of a polymer component in which a vinyl resin is the main component. A copolymer is preferred in the present invention.

formula (5)

[C6]

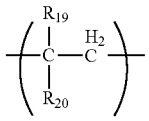

[In general formula (5), $R_{19}$ represents the hydrogen atom or an alkyl group having 1 or 2 carbon atoms and $R_{20}$ represents a phenyl group, carboxyl group, carboxylate ester group, aralkyl carboxylate ester group, or carboxylamide group.]

Viewed from the perspective of the polymerizability of the monomer unit, $R_{19}$ in general formula (5) is preferably a hydrogen atom or methyl group.

In addition, $R_{20}$ in general formula (5) is preferably a carboxylate ester group, carboxylamide group, phenyl group, or carboxyl group, while a phenyl group, carboxylate ester group, or carboxylamide group is preferred from the perspective of the compatibility and dispersibility of the azo compound in the binder resin constituent of the toner.

The carboxylate ester group and aralkyl carboxylate ester group is not particularly limited and can be exemplified by ester groups such as the methyl ester group, ethyl ester group, n-propyl ester group, isopropyl ester group, n-butyl ester group, isobutyl ester group, sec-butyl ester group, tert-butyl ester group, dodecyl ester group, 2-ethylhexyl ester group, stearyl ester group, phenyl ester group, benzyl ester group, and 2-hydroxyethyl ester group.

The carboxylamide group can be exemplified by amide groups such as the N-methylamide group, N,N-dimethylamide group, N,N-diethylamide group, N-isopropylamide group, N-tert-butylamide group, and N-phenylamide group.

The $R_{20}$ substituent in general formula (5) may itself be further substituted, and there is no particular restriction thereon as long as the polymerizability of the monomer unit is not impaired and the solubility of the azo compound is not significantly reduced. The substituent in this case can be exemplified by alkoxy groups, amino groups, and acyl groups.

Copolymers that contain a monomer unit represented by general formula (5) as a constituent component are more specifically exemplified in the following, but there is no limitation to these.

Favorable examples of the polymer component in the present invention are copolymers that contain a monomer unit selected from the group consisting of the following general formulas (6-1), (6-2), (6-3), and (6-4) as a constituent component.

formula (6-1)

[C7]

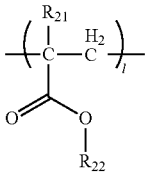

[In general formula (6-1), $R_{21}$ represents the hydrogen atom or an alkyl group having 1 or 2 carbon atoms; $R_{22}$ represents a $C_{1-22}$ alkyl group or an aralkyl group having 7 or 8 carbon atoms; and l represents 0 or a positive integer.]

$R_{21}$ in general formula (6-1) is preferably the hydrogen atom or a methyl group from the perspective of the polymerizability of the monomer unit.

In addition, viewed from the perspective of the dispersibility in and compatibility with the binder resin constituent of the toner, $R_{22}$ in general formula (6-1) is preferably a $C_{1-22}$ alkyl group or an aralkyl group having 7 or 8 carbon atoms and more preferably is a $C_{1-8}$ alkyl group or an aralkyl group having 7 or 8 carbon atoms. This alkyl group may have any structure selected from straight-chain, branched, and cyclic structures.

In addition, the aralkyl group encompassed by $R_{22}$ can be exemplified by the benzyl group, α-methylbenzyl group, and phenethyl group.

formula (6-2)

[C8]

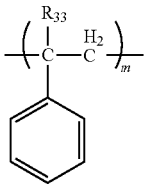

[In general formula (6-2), $R_{33}$ represents the hydrogen atom or an alkyl group having 1 or 2 carbon atoms and m represents 0 or a positive integer.]

formula (6-3)

[C9]

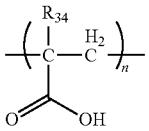

[In general formula (6-3), $R_{34}$ represents the hydrogen atom or an alkyl group having 1 or 2 carbon atoms and n represents 0 or a positive integer.]

formula (6-4)

[C10]

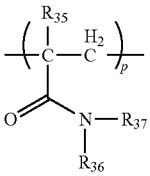

[In general formula (6-4), $R_{35}$ represents the hydrogen atom or an alkyl group having 1 or 2 carbon atoms; $R_{36}$ and $R_{37}$ each independently represent the hydrogen atom, a $C_{1-4}$ alkyl group, or the phenyl group; and p represents 0 or a positive integer.]

The compatibility of the azo compound with the binder resin constituent of the toner can be raised by changing the proportions of the monomer units represented by general formulas (5) and (6-1) to (6-4) in the polymer component of the present invention. For example, when the main binder resin constituting the toner is a styrene resin, the compatibility of the azo compound with the binder resin can be raised by using a large value for the constituent amount of a monomer unit in which $R_{20}$ in general formula (5) is the phenyl group (for example, general formula (6-2)).

Similarly, when the main binder resin constituent of the toner is a polyester resin, the compatibility of the azo compound with the binder resin can be raised when the polymer component is a polymer that contains a polyester resin.

As noted above, when a high compatibility obtains between the polymer component and the binder resin constituent of the toner, the polymer chain of the polymer component in the azo compound can maintain a satisfactorily elongated or stretched out state, and as a consequence a large steric repulsion effect is obtained and the dispersed state of the pigment can be well maintained.

Any polymer, e.g., a vinyl polymer-type resin, polyester, polyurethane, polyamide resin, or a hybrid resin in which a plurality of the preceding are chemically bound, can be used for the polymer component in the azo compound as long as the compatibility with the binder resin constituent of the toner is not significantly impaired.

The polymerization configuration for the polymer component in the azo compound can be exemplified by random copolymer, alternating copolymer, periodic copolymer, and block copolymer. The polymer component may have any structure selected from straight-chain structures, branched structures, and crosslinked structures.

The case in which the polymer component in the azo compound of the present invention has a polyester-type skeleton is described in detail herebelow.

When the binder resin constituent of the toner is a polyester resin, the polymer component of the azo compound preferably contains, viewed from the standpoint of the compatibility with the binder resin, a condensation-polymerized polymer that contains at least the monomer units represented by the following general formulas (7) and (8) as constituent components. Or, the presence of a condensation-polymerized polymer containing the monomer unit represented by general formula (32) below as a constituent component is preferred.

formula (7)

[C11]

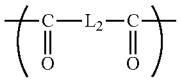

[$L_2$ in general formula (7) represents a divalent linking group.]

formula (8)

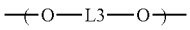

[$L_3$ in general formula (8) represents a divalent linking group.]

formula (32)

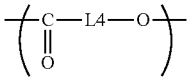

[$L_4$ in general formula (32) represents a divalent linking group.]

The divalent linking group represented by $L_2$ in general formula (7) is preferably an alkylene group, alkenylene group, or arylene group.

The alkylene groups encompassed by $L_2$ can be exemplified by alkylene groups having a straight-chain, branched, or cyclic structure, e.g., methylene, ethylene, trimethylene, propylene, tetramethylene, hexamethylene, neopentylene, heptamethylene, octamethylene, nonamethylene, decamethylene, undecamethylene, dodecamethylene, 1,3-cyclopentylene, 1,3-cyclohexylene, and 1,4-cyclohexylene.

The alkenylene groups encompassed by $L_2$ can be exemplified by vinylene, propenylene, and 2-butenylene.

The arylene groups encompassed by $L_2$ can be exemplified by 1,4-phenylene, 1,3-phenylene, 1,2-phenylene, 2,3-napthylene, 2,7-naphthylene, and 4,4'-biphenylene.

While $L_2$ can be freely selected from the substituents listed above, when viewed from the standpoint of the affinity with the dispersion medium and particularly the affinity with nonpolar solvents, it is preferably a phenylene group or an alkylene group having at least 6 carbon atoms and may be a combination of these.

The substituent $L_2$ may itself be further substituted by a substituent or substituents insofar as this does not significantly impair the affinity for the dispersion medium. In this case, the substituent that may be substituted thereon can be exemplified by methyl, halogen atoms, the carboxyl group, trifluoromethyl, and combinations of the preceding.

$L_3$ in general formula (8) represents a divalent linking group, but from the standpoint of the affinity with the dispersion medium $L_3$ is preferably an alkylene group or phenylene group or general formula (8) is preferably represented by the following general formula (33).

formula (33)

[C12]

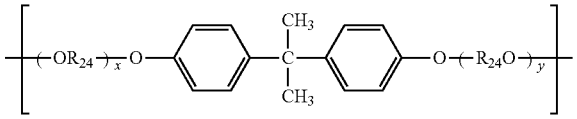

[In general formula (33), $R_{24}$ represents ethylene or propylene; x and y are each integers greater than or equal to 0; and the average value of x+y is from 2 to 10.]

The alkylene groups encompassed by $L_3$ in general formula (8) can be exemplified by alkylene groups having a straight-chain, branched, or cyclic structure, e.g., methylene, ethylene, trimethylene, propylene, tetramethylene, hexamethylene, neopentylene, heptamethylene, octamethylene, nonamethylene, decamethylene, undecamethylene, dodecamethylene, 1,3-cyclopentylene, 1,3-cyclohexylene, and 1,4-cyclohexylene.

The phenylene group encompassed by $L_3$ can be exemplified by 1,4-phenylene, 1,3-phenylene, and 1,2-phenylene.

While $L_3$ can be freely selected from the substituents listed above, when viewed from the standpoint of the affinity with the dispersion medium and particularly the affinity with nonpolar solvents, $L_3$ is preferably a phenylene group or an alkylene group having at least 6 carbon atoms or general formula (8) is preferably a bisphenol A derivative with general formula (33), and combinations of the preceding are also permissible.

The substituent $L_3$ may itself be further substituted by a substituent or substituents insofar as this does not significantly impair the affinity for the dispersion medium. In this case, the substituent can be exemplified by methyl, alkoxy groups, the hydroxyl group, halogen atoms, and combinations of the preceding.

$L_4$ in general formula (32) represents a divalent linking group and is preferably an alkylene group or alkenylene group.

The alkylene group encompassed by $L_4$ can be exemplified by alkylene groups having a straight-chain, branched, or cyclic structure, e.g., methylene, ethylene, trimethylene, propylene, tetramethylene, hexamethylene, neopentylene, heptamethylene, octamethylene, nonamethylene, decamethylene, undecamethylene, dodecamethylene, and 1,4-cyclohexylene.

The alkenylene group encompassed by $L_4$ can be exemplified by vinylene, propenylene, butenylene, butadienylene, pentenylene, hexenylene, hexadienylene, heptenylene, octenylene, decenylene, octadecenylene, eicosenylene, and triacontenylene. This alkenylene group may have any structure selected from straight-chain, branched, and cyclic structures. At least one or more double bonds should be present, and the double bond or double bonds may be located at any position.

The substituent $L_4$ may itself be further substituted by a substituent or substituents insofar as this does not significantly impair the affinity for the dispersion medium. In this case, the substituent can be exemplified by alkyl groups, alkoxy groups, the hydroxyl group, halogen atoms, and combinations of the preceding.

While $L_4$ can be freely selected from the substituents listed above, when viewed from the standpoint of the affinity for the dispersion medium and particularly the affinity for nonpolar solvents, $L_4$ is preferably an alkylene group or alkenylene group having at least 6 carbon atoms and combinations of the preceding are also permissible.

With regard to the location in the azo compound under consideration of the azo skeleton moiety structure bound to the polymer component with a single bond or a linking group, it may be scattered randomly or a single block or a plurality of blocks may be formed at a terminal to give an uneven distribution. Moreover, with regard to the number of azo skeleton moiety structures, a larger number provides a higher affinity for the pigment, but a tendency sets in for the affinity to the binder resin constituent of the toner to decline when the number is too large. Accordingly, the number of azo skeleton moiety structures, expressed per 100 monomer units that form the polymer component, is preferably in the range from 0.5 to 30 and more preferably in the range from 0.5 to 15.

The content of the azo compound in the present invention, expressed with reference to the total amount of pigment present in the toner, is preferably from at least 0.1 mass % to not more than 30 mass % and is more preferably from at least 0.5 mass % to not more than 15 mass %. The effects of the present invention tend to decline when the azo compound content is less than 0.1 mass % with reference to the total amount of pigment. When, on the other hand, 30 mass % is exceeded, a trend appears of an increase in the azo compound that is free and unadsorbed to the pigment, and as a consequence the toner charging performance tends to decline.

In addition, the content of the azo compound, expressed with reference to the mass of the toner, is preferably from at least 0.01 mass % to not more than 10.00 mass % and more preferably is from at least 0.01 mass % to not more than 5.00 mass %. The effects of the present invention tend to decline when the azo compound content is less than 0.01 mass % with reference to the mass of the toner. When, on the other hand, 10.00 mass % is exceeded, the toner charging performance tends to decline.

A characteristic feature of the toner of the present invention is that the solubility (A) for the azo compound in a toluene-hexane solubility test and the solubility (B) for the binder resin constituent of the toner in the toluene-hexane solubility test satisfy the relationship $|(B)-(A)|\leq 60$. The use of an azo compound and binder resin that satisfy this relationship provides an excellent compatibility between the azo compound and the binder resin and makes it possible for the effects of the present invention to be expressed. These (A) and (B) preferably satisfy the relationship $|(B)-(A)|\leq 47$, more preferably satisfy the relationship $|(B)-(A)|\leq 35$, and even more preferably satisfy the relationship $|(B)-(A)|\leq 30$.

In particular when the toner is produced by a suspension polymerization method, the polymerizable monomer declines as the polymerization reaction proceeds. This polymerizable monomer functions as a solvent for the azo compound and functions as a dispersion medium for the pigment. In addition, since the polymer yielded by the polymerization of this polymerizable monomer will become the binder resin constituent of the toner, the solubility properties of the polymerizable monomer will be about the same as the solubility properties of the binder resin constituent of the toner. Due to this, when the solubility (A) for the azo compound in the toluene-hexane solubility test and the solubility (B) for the binder resin constituent of the toner in the toluene-hexane solubility test is $|(B)-(A)|\leq 60$, preferably $|(B)-(A)|\leq 47$, more preferably $|(B)-(A)|\leq 35$, and even more preferably $|(B)-(A)|\leq 30$, the stage at which, due to the decline in the polymerizable monomer as the polymerization reaction progresses, the azo compound no longer dissolves in the polymerizable monomer and precipitates is satisfactorily delayed. This is preferred because as a result a state in which the azo skeleton unit of the azo compound is adsorbed to the pigment and the polymer chain of the polymer component is satisfactorily extended, can be maintained for a long period of time during the polymerization reaction and as a consequence the dispersed state of the pigment can be well maintained.

Moreover, it was discovered that toluene is favorable as an indicator for examining the range in which the effects of the present invention are expressed because with regard to solubility it has properties similar to those of the binder resin constituent of the toner, e.g., styrene-acrylate resin or polyester resin.

On the other hand, hexane is used as a poor solvent because hexane is a solvent compatible with toluene and because polarity-mediated effects must be exhibited in order for the azo compound to express the effects of the present invention and its solubility in nonpolar solvents is preferably not very high. In particular, since with regard to solubility hexane has properties similar to those of hydrocarbon waxes, the compatibility of the azo compound and binder resin constituent of the toner with hexane represents the compatibility of the azo compound and binder resin constituent of the toner with hydrocarbon waxes. As a consequence, differences in the solubility of the azo compound and the binder resin constituent of the toner with respect to toluene-hexane can serve as an indicator of the state of the azo compound in a toner that contains a hydrocarbon wax.

Accordingly, bringing the difference in the solubilities of the azo compound and the binder resin constituent of the toner into the prescribed range becomes a crucial factor for having a toner that contains a hydrocarbon wax exhibit the effects of the present invention.

The solubility (A) for the azo compound in the toluene-hexane solubility test and the solubility (B) for the binder resin constituent of the toner in the toluene-hexane solubility test preferably satisfy the relationship $(A)<(B)$ in the toner of the present invention. When the solubility (A) for the azo compound is less than the solubility (B) for the binder resin constituent of the toner, the azo compound then has a lower solubility with respect to hexane than the binder resin constituent of the toner. As a consequence, when the toner contains a hydrocarbon wax, the azo compound will have a lower compatibility with the hydrocarbon wax than the binder resin constituent of the toner. Accordingly, this is preferred with regard to the offset resistance because the azo compound does not end up englobing the hydrocarbon wax and the outmigration of the wax from the toner during fixing is not inhibited.

In addition, since hexane is a nonpolar solvent, when the relationship $(A)<(B)$ is satisfied according to a preferred embodiment, this suggests that the azo compound, which contributes to the dispersion of the pigment, has a higher polarity than the binder resin constituent of the toner. In this case, the polarity, which is one factor by which the azo compound exhibits an adsorption force for the pigment, is thought to be stronger than for the binder resin constituent of the toner and the azo compound is then able to exhibit the effects of the present invention without impediment due to interference from the binder resin component that is a constituent of the toner.

Viewed from the standpoint of the charging performance of the toner, the relationship $35\leq(A)$ is even more preferably satisfied because the polarity of the azo compound is then in an appropriate range and the hygroscopicity in a high-temperature, high-humidity environment is kept down.

Furthermore, it is even more preferred that the solubility (A) for the azo compound and the solubility (B) for the binder resin constituent of the toner satisfy the relationship $35\leq(A)<(B)$ because an excellent storage stability is then manifested in addition to the previously described effects with regard to the tinting strength and offset resistance of the toner and its charging performance in a high-temperature, high-humidity environment.

The solubility (C) in the toluene-hexane solubility test for the polymer component in the azo compound and the solubility (B) for the binder resin constituent of the toner preferably satisfy the relationship $|(B)-(C)|\leq 35$ in the toner of the present invention, while $|(B)-(C)|\leq 20$ is more preferred. The reason for this is as follows: when $|(B)-(C)|\leq 35$ obtains, the miscibility of the polymer component of the azo compound with the binder resin constituent of the toner is excellent and pigment aggregation is inhibited as a result.

In the particular case of toner production by a suspension polymerization method, when only a small difference exists between the solubility (C) for the polymer component in the azo compound in the toluene-hexane solubility test and the solubility (B) for the binder resin constituent of the toner in the toluene-hexane solubility test, the polymer component, which is the dispersing group in the azo compound, then has a good intimacy of mixing with the binder resin constituent of the toner and with the polymerizable monomer that is the building block for this binder resin. Due to this, the molecular chain of the polymer component in the azo compound is thoroughly extended in the polymerizable monomer and binder resin constituent of the toner over an extended period of time from the initial stage of the reaction to the later stages of the reaction in which the proportion of the binder resin has increased at the expense of the polymerizable monomer, and as a consequence the steric repulsion effect is satisfactorily manifested and pigment aggregation is inhibited and an excellent state can therefore be maintained for the state of pigment dispersion.

Moreover, the properties of the produced toner are influenced by the organic solvent when, as in the dissolution suspension method, the toner is produced by dissolving or dispersing the pigment and binder resin constituent of the toner in an organic solvent, granulating the resulting mixed solution in an aqueous medium, and removing the organic solvent present in the particles provided by granulation. The binder resin constituent of the toner is dissolved in the organic solvent, and due to this, when the azo compound is used, this azo compound preferably also exhibits solubility in the organic solvent since this enables the azo skeleton moiety structure to adsorb to the pigment and enables maintenance of a state in which the molecular chain of the polymer component is thoroughly extended, which as a consequence enables the thorough maintenance of a state of pigment dispersion that is the same as in suspension polymerization.

In particular, the polymer chain of the dissolved binder resin constituent of the toner proceeds to contract in the organic solvent removal step. However, the solubility (A) for the azo compound in the toluene-hexane solubility test and the solubility (B) for the binder resin constituent of the toner in the toluene-hexane solubility test desirably satisfy the relationship $|(B)-(A)|\leq 60$, preferably $|(B)-(A)|\leq 47$, more preferably $|(B)-(A)|\leq 35$, and even more preferably $|(B)-(A)|\leq 30$ because this makes it possible for the pigment to maintain an excellent state of dispersion in the binder resin constituent of the toner, without dragging into the organic solvent that is removed.

Moreover, when the solubility (C) in the toluene-hexane solubility test for the polymer component of the azo compound and the solubility (B) for the binder resin constituent of the toner satisfy the relationship $|(B)-(C)|\leq 35$, the polymer component of the azo compound exhibits an excellent miscibility with the binder resin constituent of the toner and as a result the polymer chain of the polymer component of the azo compound will be thoroughly extended and a large steric repulsion effect will be obtained. The dispersed state of the pigment can be well maintained as a consequence. $|(B)-(C)|\leq 20$ is even more preferred.

The method for determining the solubility (A) for the azo compound, the solubility (B) for the binder resin constituent of the toner, and the solubility (C) for the polymer component in the azo compound in the toluene-hexane solubility test is as follows.

<Method for Measuring the Solubility in the Toluene-Hexane Solubility Test>

The solubility in the toluene-hexane solubility test is measured as follows in the present invention on the azo compound, the binder resin constituent of the toner, and the polymer component of the azo compound.

60 mL of toluene is introduced into a cylindrical glass container having a diameter of 5 cm and a thickness of 1.75 mm.

0.4 g of the azo compound, binder resin, or polymer component is precisely weighed out and is added to the toluene-filled container and complete dissolution is carried out to obtain the measurement sample. Dispersion is performed for 5 minutes with an ultrasound disperser in order to remove the air bubbles and so forth in the measurement sample, thereby producing the measurement sample solution.

The measurement sample solution is set in a "WET-101P" powder wettability tester (Rhesca Co., Ltd.). The measurement sample solution is stirred at a rate of 5.0 $s^{-1}$ (300 rpm) using a magnetic stirrer. A fluororesin-coated egg-shaped stir bar with a length of 25 mm and a maximum waist diameter of 8 mm is used as the stir bar for the magnetic stirrer.

The transmittance of light at a wavelength of 780 nm is measured while hexane is continuously added dropwise through the powder wettability tester into the measurement sample solution at a rate of 0.8 mL/min. A hexane addition-transmittance curve is constructed and the hexane concentration is determined at the point at which the transmittance reaches a minimum.

When the azo compound is used for the measurement sample, this hexane concentration value is designated as the solubility (A) for the azo compound in the toluene-hexane solubility test, and when the binder resin is used as the measurement sample, this hexane concentration value is designated as the solubility (B) for the binder resin in the toluene-hexane solubility test. Similarly, when the polymer component of the azo compound is used as the measurement sample, this hexane concentration value is designated as the solubility (C) for this polymer component in the toluene-hexane test.

The hexane concentration (%) in the toluene/hexane mixed solvent is defined by the following formula.

$$\text{hexane concentration (\%)}=[\text{volume of hexane (vol)}/\{\text{volume of hexane (vol)}+\text{volume of toluene (vol)}\}]\times 100 \quad \text{[Math. 1]}$$

Using the conditions given above, the initial hexane concentration for the solubility is set to 0%; however, when the hexane concentration at which the measurement sample begins to precipitate is a fairly high concentration, the solubility of the present invention may be accurately determined using a suitable selection for the initial hexane concentration. In such a case, a toluene solution is first prepared using the measurement sample in the same concentration (60 mL toluene for 0.4 g of the measurement sample) as when the initial hexane concentration is set to 0%; hexane is added to this to suitably adjust the initial hexane concentration; and the resulting sample is then used for the measurement.

With regard to the solubility for the azo compound and the binder resin constituent of the toner, ordinarily the azo compound and binder resin are obtained by extraction from the toner, separation, and purification and the determination is made from the results of measurement thereon. Alternatively, when the binder resin constituent of the toner or the azo compound used have been identified by, for example, analysis, an azo compound or binder resin constituent of the toner having the same structure, composition, and properties may be prepared or acquired and submitted to the measurement and the determination may be made from these results. Similarly, with regard to the solubility for the polymer component in the azo compound, a polymer having the same structure, composition, and properties as the one used may be acquired or prepared and the determination can be made by measurement of the solubility using this polymer.

The glass-transition temperature (Tg) of the azo compound is preferably from at least 50° C. to not more than 150° C. and more preferably is from at least 55° C. to not more than 120° C. The storability of the toner declines when the glass-transition temperature (Tg) of the azo compound is less than 50° C. On the other hand, the fixing performance by the toner declines at above 150° C.

The adsorption rate to the pigment by the azo compound is preferably at least 30%, more preferably at least 50%, and even more preferably at least 70%. When the adsorption rate to the pigment by the azo compound is at least 30%, this overcomes interference at the pigment by other substances constituting the toner and the azo compound continues to adsorb to the pigment and the dispersed state of the pigment can be well maintained.

The acid value of the azo compound is preferably not more than 30 mg KOH/g and more preferably not more than 10 mg KOH/g. An acid value for the azo compound of not more than 30 mg KOH/g provides additional improvements in the charging performance during use in high-temperature, high-humidity environments. The acid value of the azo compound is preferably greater than or equal to 0 mg KOH/g.

When, in particular, the toner is produced in an aqueous medium and the acid value of the azo compound is not more than 30 mg KOH/g, the probability of the presence of the azo compound at the surface of the toner is readily reduced and as a result the probability that the pigment will also be present in the vicinity of the toner surface also tends to decline. Due to this, exposure of the pigment at the toner surface can be reduced. Thus, since the toner surface is made homogeneous, a reduction can be obtained in the release from the toner of the inorganic fine powder, such as silica, that is used attached to the toner surface in ordinary toners. This makes possible an improvement in the contamination of members, e.g., filming.

Furthermore, when the acid value of the azo compound is not more than 30 mg KOH/g and the solubility (A) for the azo compound and the solubility (B) for the binder resin constituent of the toner satisfy the relationship $35 \leq (A) < (B)$, the probability of occurrence in the vicinity of the toner surface tends to decline not only for the pigment but also for the wax. This makes possible as a result an inhibition of contamination by the toner of the toner layer thickness control member and the toner carrying member.

When the toner particles are produced using a suspension polymerization method, and viewed from the perspective of execution without inhibiting the polymerization reaction of the polymerizable monomer, the addition of a polar resin is preferred in the present invention when the aforementioned polymerizable monomer composition is prepared. This polar resin is preferably a copolymer of styrene and (meth)acrylic acid; a copolymer of an unsaturated carboxylic acid, e.g., acrylic acid or methacrylic acid, and also an unsaturated dibasic acid and an unsaturated dibasic acid anhydride or these monomers with a styrenic monomer; a polyester resin; or an epoxy resin. This polar resin preferably does not contain a monomer-reactable unsaturated group in its molecule. The amount of addition of this polar resin, expressed with reference to the polymerizable monomer, is preferably from 0.1 to 30 mass % and is more preferably from 0.5 to 20 mass %. Viewed from the standpoint of the environmental stability, this polar resin preferably has an acid value of from at least 5.0 mg KOH/g to not more than 30.0 mg KOH/g.

The acid value of the azo compound is preferably less than the acid value of the polar resin. The reason for this is as follows: when the acid value of the azo compound is less than the acid value of the polar resin, the occurrence of the azo compound at the toner surface is impeded and as a result exposure of the pigment to the toner surface can be reduced.

This azo compound may have an amine value, and the amine value of the azo compound is preferably not more than 30 mg KOH/g, more preferably not more than 10 mg KOH/g, and even more preferably not more than 5 mg KOH/g. When the azo compound has an amine value of not more than 30 mg KOH/g, the charging performance during use in high-temperature, high-humidity environments is improved. Particularly in the case of a negative charging toner, the charging performance declines when the amine value of the azo compound exceeds 30 mg KOH/g. The amine value of the azo compound is preferably greater than or equal to 0 mg KOH/g.

Preferably the ratio (AmV/AV) between the amine value (AmV) and the acid value (AV) of the azo compound is not more than 0.5 and the acid value of the azo compound is not more than 30 mg KOH/g in the present invention. When toner is a negative charging toner and this ratio (AmV/AV) is not more than 0.5, the toner charging performance exhibits an excellent environmental stability and an excellent charging performance is exhibited in both low-temperature, low-humidity environments and high-temperature, high-humidity environments. In particular, a toner having a sharp particle size distribution is obtained when toner production is carried out by granulation in an aqueous medium. When this ratio (AmV/AV) is not more than 0.5, a good balance is obtained for the polarity of the azo compound and the surface tension during granulation in an aqueous medium is optimized.

The azo compound in the present invention has a number-average molecular weight (Mn), as measured using gel permeation chromatography (GPC), preferably from at least 500 to not more than 200,000, more preferably from at least 2,000 to not more than 50,000, and even more preferably from at least 3,000 to not more than 30,000.

An excellent storage stability and a high dispersibility-enhancing effect for the pigment are obtained when the number-average molecular weight (Mn) of the azo compound is at least 500. On the other hand, at up to 200,000, no problems occur with regard to the affinity for the binder resin constituent of the toner and the fixing performance is also not impaired. In addition, when the azo compound has a number-average molecular weight (Mn) of not more than 200,000, crosslinking occurs between pigment particles and pigment aggregation is prevented. Furthermore, with regard to toner production in an aqueous medium, the toner composition and the polymerizable monomer composition will not have a high viscosity and a toner with a sharp particle diameter distribution will be obtained.

The azo compound under consideration can be synthesized according to known methods.

The method for synthesizing this azo compound can be exemplified by the methods indicated in (i) to (iv) below.

An example of the scheme in method (i) is shown below and will be described in detail.

Method (i)

[C13]

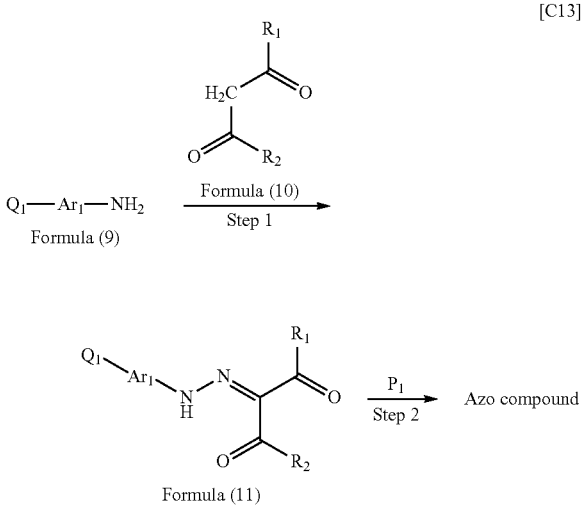

[$R_1$ and $R_2$ in general formulas (10) and (11) are defined, respectively, as for $R_1$ and $R_2$ in general formula (1). $Ar_1$ in general formulas (9) and (11) represents an arylene group. $P_1$ is the polymer component and is, for example, a copolymer containing the monomer unit represented in, for example, general formula (5), as a constituent component. $Q_1$ in general formulas (9) and (11) represents a substituent that reacts with $P_1$ to form a single bond or a divalent linking group.]

In the scheme for method (i) provided as an example above, the azo compound can be synthesized using a step 1, in which the azo skeleton moiety structure with general formula (11) (also referred to below as the "azo skeleton moiety structure (11)") is synthesized by the diazo coupling of the compound with general formula (10) with the aniline derivative with general formula (9), and a step 2, in which the azo skeleton moiety structure (11) is bound to the polymer component $P_1$ by, for example, a condensation reaction.

The molecular weight distribution and molecular structure of the polymer component represented by $P_1$ can be adjusted using known methods. For example, a polymer component having a controlled molecular weight distribution and molecular structure can be prepared by using, for example, a method that uses an addition fragmentation-type chain transfer agent, the NMP method, ATRP method, or RAFT method, and also the MADIX method or DT method.

The aforementioned step 2 is described as follows. Known methods can be used for step 2. For example, an azo compound can be synthesized in which $P_1$ and $Q_1$ are bound by a carboxylamide bond by using a carboxyl group-containing polymer component $P_1$ and an azo skeleton moiety structure (11) in which $Q_1$ is an amino group-containing substituent. Specifically, the Schotten-Baumann method can be used or a method can be used that produces the carboxylamide bond using a dehydration condensation agent such as 1-ethyl-3-(3-dimethylaminopropyl)carbodiimide hydrochloride.

An example of the scheme in method (ii) is shown below and will be described in detail.

Method (ii)

[C14]

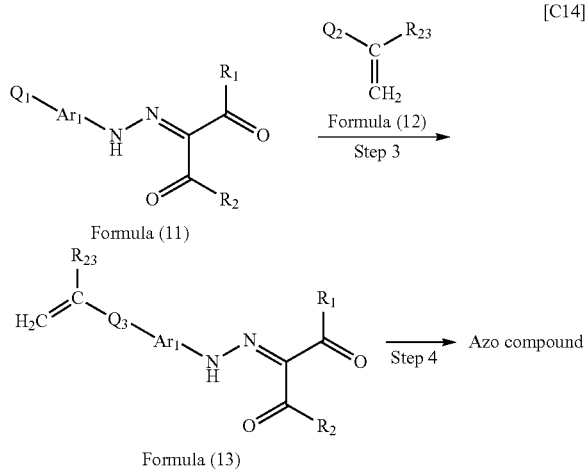

[$R_1$, $R_2$, $Ar_1$, and $Q_1$ in general formula (11) are defined, respectively, as for $R_1$, $R_2$, $Ar_1$, and $Q_1$ in general formula (11) in the preceding scheme for method (i). $Q_2$ in general formula (12) represents a substituent that reacts with $Q_1$ in general formula (11) to form the $Q_3$ in formula (13). The $R_{23}$ in general formulas (12) and (13) represents the hydrogen atom or an alkyl group, while $Q_3$ represents a substituent that will constitute the divalent linking group and is formed by the reaction of $Q_1$ in general formula (11) and $Q_2$ in general formula (12).]

In the scheme for method (ii) provided as an example above, the azo compound can be synthesized using a step 3, in which the azo skeleton moiety structure with general formula (11) is reacted with the vinyl group-containing compound with general formula (12) (also referred to below as the "vinyl group-containing compound (12)") to synthesize the polymerizable functional group-containing azo skeleton moiety structure with general formula (13) (also referred to below as the "azo skeleton moiety structure (13)"), and a step 4, in which the polymerizable functional group-containing azo skeleton moiety structure (13) is copolymerized with a monomer unit represented by, for example, general formula (5).

For example, a polymerizable functional group-containing azo skeleton moiety structure (13) in which the linking group is a urethane group can be synthesized by using an isocyanate group-functional vinyl group-containing compound (12) (for example, 2-isocyanatoethyl methacrylate [trade name: "Karenz MOI", from Showa Denko K.K.]) and an azo skeleton moiety structure (11) in which $Q_1$ is a hydroxyl group-containing substituent.

An example of the scheme in method (iii) is shown below and will be described in detail.

Method (iii)

[C15]

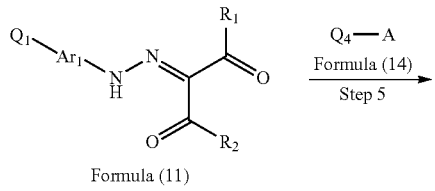

-continued

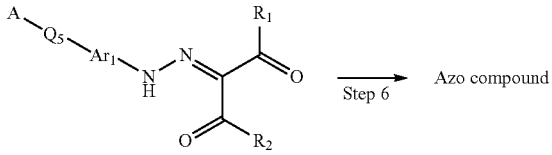

Formula (15)

[$R_1$, $R_2$, $Ar_1$, and $Q_1$ in general formula (11) are defined, respectively, as for $R_1$, $R_2$, $Ar_1$, and $Q_1$ in general formula (11) in the preceding scheme for method (i). $Q_4$ in general formula (14) represents a substituent (for example, the carboxyl group) that reacts with $Q_1$ in general formula (11) to form $Q_5$ in general formula (15). A represents the chlorine atom, bromine atom, or iodine atom. $R_1$, $R_2$, and $Ar_1$ in general formula (15) are defined as for $R_1$, $R_2$, and $Ar_1$ in general formula (11), while $Q_5$ represents a linking group that is formed by the reaction of $Q_1$ in general formula (11) and $Q_4$ in general formula (14).]

In the scheme for method (iii) provided as an example above, the azo compound can be synthesized using a step 5, in which the halogen atom-containing azo skeleton moiety structure (15) represented by general formula (15) (also referred to below as the "azo skeleton moiety structure (15)") is synthesized by reacting the azo skeleton moiety structure with general formula (11) with a halogen atom-containing compound with general formula (14) (also referred to below as the "halogen atom-containing compound (14)"), and a step 6, in which copolymerization with a monomer unit represented by, for example, general formula (5), is performed using the halogen atom-containing azo skeleton moiety structure (15) as the polymerization initiator.

The corresponding acid halide or anhydride can be similarly used in the present invention for the carboxyl group-functional halogen atom-containing compound (14).

Using the ATRP method in method (i) and the halogen atom-containing azo skeleton moiety structure (15) as the polymerization initiator, the azo compound can be synthesized in step 6 by polymerization with a monomer unit represented by general formula (5) in the presence of a metal catalyst and a ligand.

Considering the case in which $R_2$ in general formula (1) is the $NR_9R_{10}$ group, $R_9$ is the hydrogen atom, and $R_{10}$ is the phenyl group, the azo compound can be synthesized, for example, by the following method (iv).

Method (iv)

[C16]

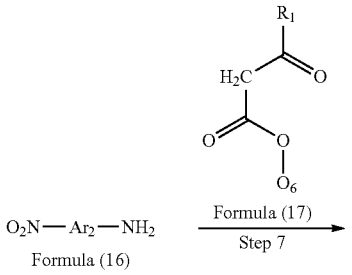

-continued

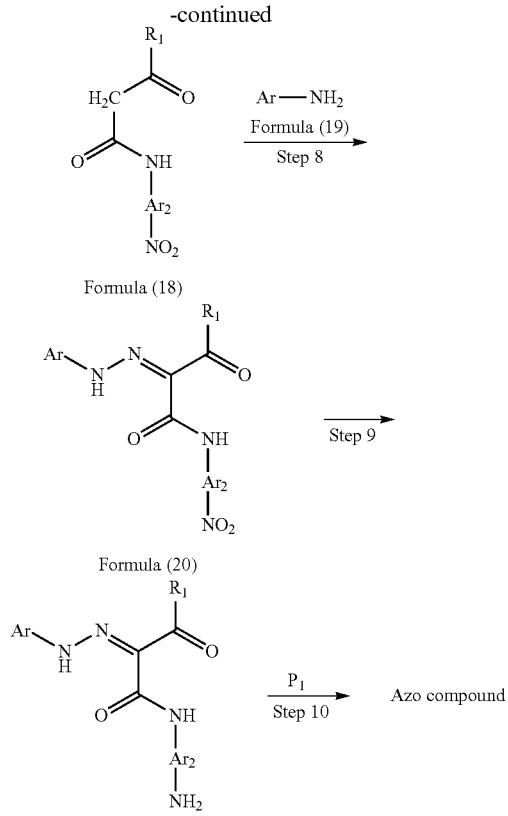

[$Ar_2$ in general formulas (16), (18), (20), and (21) represents an arylene group. $R_1$ in formulas (17), (18), (20), and (21) is defined as for $R_1$ in general formula (1). $Q_6$ in general formula (17) represents a substituent that is eliminated when the amide group in formula (18) is formed by the reaction with the amino group in general formula (16). $P_1$ is defined as for $P_1$ in the scheme provided above for method (i).]

In the scheme for method (iv) provided as an example above, the azo compound can be obtained using a step 7, in which the compound with general formula (18) is obtained by an amidation between the aniline derivative with general formula (16) and the compound with general formula (17); a step 8, in which the azo skeleton moiety structure with general formula (20) is obtained by coupling between the compound with general formula (18) and the diazo component of the aniline analogue with general formula (19); a step 9, in which the azo skeleton moiety structure with general formula (21) is obtained by reducing the nitro group in the azo skeleton moiety structure with general formula (20) with a reducing agent to the amino group; and a step 10, in which the amino group in the azo skeleton moiety structure with general formula (21) is bound by amidation of a carboxyl group in the separately synthesized polymer component represented by P.

When $R_1$ in general formula (17) is the methyl group, the azo compound can also be synthesized by the method using diketene in place of the compound with general formula (17).

The azo compound can be synthesized in step 10 by effecting bonding by, for example, amidation of the carboxyl group in the polymer component $P_1$ with the amino group in the azo skeleton moiety structure with general formula (21) using the same method as in step 2 in the scheme provided above for method (i). Otherwise, bonding may also be carried out by reacting the amino group in the azo skeleton moiety structure with general formula (21) with an epoxy group present in the polymer component $P_1$ (for example, a copolymer of 2,3-epoxypropyl methacrylate).

The compounds obtained in each of the steps in the synthesis methods provided as examples above can be purified using the usual methods for the isolation•purification of organic compounds. These isolation•purification methods can be exemplified by recrystallization and/or reprecipitation using an organic solvent and column chromatography using, for example, silica gel. The high-purity compound can be obtained by carrying out purification using a single one of these methods or a combination of two or more of these methods.

Structural analysis of the obtained azo compound is performed according to the following procedures.

<Structural Analysis of the Azo Compound>

Structural analysis of the azo compound is performed by elucidating the compositional ratios by NMR measurement and through the number-average molecular weight (Mn) provided by gel permeation chromatography (GPC).

(Measurement of the $^1$H-NMR (Nuclear Magnetic Resonance) Spectrum)

The compositional ratios for the azo compound are determined based on the measurement results in the $^1$H-NMR spectrum obtained using the following measurement instrumentation and measurement conditions.

measurement instrument: JNM-EX400 FT-NMR instrument (from JEOL Ltd.)
measurement frequency: 400 MHz
pulse condition: 5.0 μs
frequency range: 10500 Hz
number of integrations: 1024
measurement temperature: 60° C.
sample: 50 mg of the measurement sample is introduced into a sample tube with an inner diameter of 5 mm; $CDCl_3$ is added as the solvent; and the sample to be used is prepared by dissolution in a thermostat at 40° C.

(Measurement of the Number-Average Molecular Weight of the Azo Compound by GPC)

The number-average molecular weight (Mn) of the azo compound of the present invention is measured according to the following procedure using gel permeation chromatography (GPC).

The sample is dissolved in tetrahydrofuran (THF) over 24 hours at room temperature. The obtained solution is filtered using a "MYSHORI Disk" solvent-resistant membrane filter with a pore diameter of 0.2 μm (TOSOH CORPORATION) to obtain a sample solution. The sample solution is adjusted so as to provide a concentration of THF-soluble components of approximately 0.8 mass %. Measurement is performed under the following conditions using this sample solution.

instrument: HLC8120 GPC (detector: RI) (TOSOH CORPORATION)
columns: 7 column train of Shodex KF-801, 802, 803, 804, 805, 806, and 807 (Showa Denko K.K.)
eluent: tetrahydrofuran (THF)
flowrate: 1.0 mL/min
oven temperature: 40.0° C.
sample injection amount: 0.10 mL The sample molecular weight is determined using a molecular weight calibration curve constructed using standard polystyrene resin (for example, product name: "TSK Standard Polystyrene F-850, F-450, F-288, F-128, F-80, F-40, F-20, F-10, F-4, F-2, F-1, A-5000, A-2500, A-1000, A-500", from TOSOH CORPORATION).

(The Binder Resin Used in the Present Invention)

Known binder resins can be used for the binder resin constituent of the toner that is used in the present invention, and specific examples are styrene-methacrylic acid copolymers, styrene-acrylic acid copolymers, polyester resins, epoxy resins, and styrene-butadiene copolymers.

(The Wax Used in the Present Invention).

The toner of the present invention may contain a wax. In such a case, at least one wax has a melting point (temperature corresponding to the maximum endothermic peak in the DSC heat absorption curve in the temperature range from 20 to 200° C.) preferably from at least 30° C. to not more than 120° C. and more preferably from at least 50° C. to not more than 100° C. In addition, it is preferably a solid wax at room temperature, and in particular a solid wax with a melting point of from at least 50° C. to not more than 100° C. is preferred from the standpoint of the blocking resistance, multisheet durability, fixing performance, and offset resistance of the toner.

A known wax can be used for the wax, for example, a petroleum wax or a derivative thereof, e.g., a paraffin wax, polyolefin wax, microcrystalline wax, polymethylene wax such as a Fischer-Tropsch wax, amide wax, and petrolatum; natural waxes and their derivatives, e.g., montan wax and derivatives thereof, carnauba wax, and candelilla wax; hardened castor oil and derivatives thereof; and plant waxes, animal waxes, higher fatty acids, long-chain alcohols, ester waxes, ketone waxes, and derivatives thereof such as graft compounds and block compounds. A single one of these may be used or combinations may be used.

A hydrocarbon wax is preferred for the wax in the present invention because the effects of the present invention are then substantially expressed. The reason for this is as follows: as noted above, when the solubility for the azo compound as the toluene-hexane solubility is in an appropriate range, the azo compound has a favorable compatibility with respect to the binder resin constituent of the toner and the hydrocarbon wax, which is a hydrocarbon like hexane, and an excellent offset resistance is obtained since the azo compound does not englobe the hydrocarbon wax.

The content of the wax in the toner of the present invention, expressed with respect to 100 mass parts of the binder resin, is preferably from at least 5 mass parts to not more than 30 mass parts, more preferably from at least 5 mass parts to not more than 20 mass parts, and even more preferably from at least 8 mass parts to not more than 15 mass parts. When the amount of wax addition is smaller than the lower limit, the offset-reducing effect readily decline; when it exceeds the upper limit, the antiblocking effect declines and the anti-offset effect is also easily negatively affected and melt adhesion by the toner to the drum and melt adhesion by the toner to developing sleeve then readily occurs.

There are no particular limitations on the extraction method when extraction of the wax from the toner is required in order to determine the properties referenced above, and any method can be used. For example, a prescribed amount of the toner can be subjected to Soxhlet extraction with toluene; the solvent can be removed from the obtained toluene-soluble matter; and the chloroform-insoluble matter can then be obtained. This is followed by analytical determination by, for example, an IR method.

In addition, with regard to a quantitative determination, quantitative analysis is carried out by, for example, DSC. Measurement in the present invention is performed using a DSC-2920 from TA Instruments Japan Inc.

The measurement method is the same as for the determination of the glass-transition temperature (Tg) of the azo compound. The glass-transition point is taken to be the intersection between the differential heat curve and the line for the midpoint between the baseline prior to the appearance of the specific heat change and the baseline after the appearance of the specific heat change. In addition, the maximum endothermic peak temperature of the wax component is obtained from the DSC curve obtained during temperature ramp up.

(The Charge Control Agent Used in the Present Invention)

A known charge control agent can be used in the toner of the present invention.

The content of the charge control agent, expressed per 100 mass parts of the binder resin in the toner, is preferably from at least 0.01 mass parts to not more than 20 mass parts and is more preferably from at least 0.5 mass parts to not more than 10 mass parts.

(The Pigment Used in the Present Invention)

The toner of the present invention contains a pigment as a colorant. Copper phthalocyanine compounds and their derivatives, anthraquinone compounds, and basic dye lake compounds can be used as the pigment used as a cyan colorant. Specific examples are as follows: C. I. Pigment Blue 15, C. I. Pigment Blue 15:1, C. I. Pigment Blue 15:2, C. I. Pigment Blue 15:3, and C. I. Pigment Blue 15:4.

Condensed azo compounds, diketopyrrolopyrrole compounds, anthraquinones, quinacridone compounds, basic dye lake compounds, naphthol compounds, benzimidazolone compounds, thioindigo compounds, and perylene compounds can be used as the pigment used as a magenta colorant. Specific examples are as follows: C. I. Pigment Violet 19, C. I. Pigment Red 31, C. I. Pigment Red 122, C. I. Pigment Red 150, and C. I. Pigment Red 269.

Condensed azo compounds, isoindolinone compounds, anthraquinone compounds, azo metal complexes, methine compounds, and allylamide compounds can be used as the pigment used as a yellow colorant. Specific examples are as follows: C. I. Pigment Yellow 74, C. I. Pigment Yellow 93, C. I. Pigment Yellow 120, C. I. Pigment Yellow 151, C. I. Pigment Yellow 155, C. I. Pigment Yellow 180, and C. I. Pigment Yellow 185.

Carbon black, magnetic bodies, and species adjusted to be black using the aforementioned yellow, magenta, and cyan colorants can be used as the black colorant.

The pigment content, expressed per 100 mass parts of the polymerizable monomer or binder resin, is preferably from at least 1 mass part to not more than 20 mass parts.

The use ratio (mass basis) between the azo compound and the pigment in the toner of the present invention is preferably from 0.1:100 to 30:100 and more preferably is from 0.5:100 to 15:100.

A single one of these colorants may be used or a mixture of these colorants may be used, and they may be used in a solid solution state.

(Other Additives Used in the Present Invention)

Within a range in which the effects of the present invention are not impaired, various known inorganic and organic additives can be used in the toner of the present invention in order to impart various properties thereto. Viewed from the perspective of the durability when added to the toner, the additives used preferably have a particle diameter that is not more than three-tenths of the weight-average particle diameter of the toner particles. The additive particle diameter denotes its average particle diameter as determined by observation of the surface of the toner particle with a scanning electron microscope.

The content of these additives, expressed per 100 mass parts of the toner, is preferably from at least 0.01 mass parts to not more than 5 mass parts and more preferably is from at least 0.02 mass parts to not more than 3 mass parts.

A single one of these additives may be used or a plurality may be used in combination.

In addition, these additives may be subjected to a hydrophobic treatment. While various coupling agents, e.g., a silane coupling agent or titanium coupling agent, can be used in the hydrophobic treatment method, raising the hydrophobicity using a silicone oil is more preferred because this can inhibit moisture adsorption by an inorganic fine powder in the presence of high humidities and can inhibit contamination of, e.g., control members and charging members, and thus can yield a high-quality image.

(Methods for Producing the Toner of the Present Invention)

Methods for producing the toner of the present invention are described in the following.

The method of producing the toner of the present invention can be exemplified by methods that yield a toner such as pulverization methods, suspension polymerization methods, dispersion polymerization methods, and suspension granulation methods in which toner is prepared by the granulation in an aqueous medium of a solution•dispersion of the starting materials in an organic solvent. In particular, toner production by a suspension polymerization method is preferred for its simple production process and its ability to easily provide the intended toner. As compared to suspension granulation methods, there is no impairment of the effects of the present invention by the outmigration to the toner surface of solvent during the desolventizing step occasioned by the use of an organic solvent, and a toner having an excellent charging performance is obtained. As a consequence, an excellent charge ramp up and initial image density are obtained and suspension polymerization is thus preferred.

The execution of suspension polymerization by preliminarily preparing a polymerizable monomer composition containing the pigment, azo compound, and polymerizable monomer and forming a state in which the azo compound is adsorbed to the pigment, then adding the wax as necessary, and producing the toner in an aqueous medium, is preferred for the expression of the effects of the present invention.

In those instances in which the toner is produced by preparing a mixed solution by dissolving or dispersing a binder resin-containing toner composition in an organic solvent, granulating this mixed solution in an aqueous medium, and removing the organic solvent present in the particles provided by granulation, toner production by preliminarily preparing a mixed solution in which a toner composition containing the pigment, azo compound, and binder resin is dissolved or dispersed in an organic solvent and forming a state in which the azo compound is adsorbed to the pigment, then adding the wax as necessary, and after dissolution granulating this mixed solution in an aqueous medium, is again preferred for the expression of the effects of the present invention.

The measurement methods used by the present invention are described in the following.

<Method for Measuring the Glass-Transition Temperature of the Azo Compound>

The glass-transition temperature (Tg) of the azo compound of the present invention can be determined by measurement by differential scanning calorimetry (DSC).

In terms of the measurement principle, the DSC measurement is preferably performed using a high-precision internal heating-type input-compensated differential scanning calorimeter. For example, a DSC-7 from PerkinElmer Inc. and a DSC-2920 from TA Instruments Japan Inc. can be used. The measurements are performed in the present invention using a DSC-2920 from TA Instruments Japan Inc.

The measurement is performed based on ASTM D-3418-82. 10 mg of the measurement sample is precisely weighed out and introduced into an aluminum pan. Using an empty aluminum pan as the reference, the measurement is performed in the temperature range from 30 to 200° C. at a rate of temperature rise of 10° C./min. The change in the specific heat is obtained in the temperature range from 40° C. to 100° C. during the temperature ramp-up process. The glass-transition temperature is taken to be the temperature at the intersection between the differential heat curve and the line for the midpoint between the baseline prior to the appearance of the specific heat change during this process and the baseline after the appearance of the specific heat change.

<Method for Measuring the Adsorption Rate to the Pigment by the Azo Compound>

The adsorption rate to the pigment by the azo compound was measured as follows.

[Construction of the Calibration Curve]

(A) 5 mL of a "styrene solution of the azo compound", which contains the azo compound in styrene at a styrene/azo compound mass ratio of 5.0/0.1, is prepared ("solution 1"). Styrene is added to this solution 1 to prepare solutions diluted to provide content ratios for the azo compound of ½, ¼, ⅕, and 1/10, respectively (these are respectively denoted below as "solution 2", "solution 3", "solution 4", and "solution 5").

(B) Solutions 1, 2, 3, 4, and 5 were allowed to stand for 24 hours at 25° C. and were filtered across a solvent-resistant membrane filter having a pore diameter of 0.2 μm to provide the sample solutions. The azo compound was measured using GPC under the conditions given below and a calibration curve was constructed using the azo compound concentration (g/mL) in the liquid medium. This same process was carried out for each of the azo compounds used by the present invention and the respective calibration curves were constructed for the individual azo compounds.

high-speed GPC instrument: "HLC-8220GPC" [from TOSOH CORPORATION]
column: 2×LF-804
eluent: THF
flowrate: 1.0 mL/min
oven temperature: 40° C.
amount of sample injection: 0.025 mL

[Measurement of the Adsorption Rate]

(A) Using the same pigment as in the toner that is actually prepared, styrene, and the same azo compound as in the toner that is actually prepared, a dispersion was prepared at a pigment/styrene/azo compound=1.0/5.0/0.1 mass ratio. This dispersion was allowed to stand for 24 hours at 25° C. and was then subjected to centrifugal separation using the following conditions.

high-speed centrifuge: H-9R from KOKUSAN Co. Ltd.
sedimentation tube: PPT-010
sample: introduction of composition corresponding to about 80% of the volume of the sedimentation tube
centrifugation conditions: 10000 rpm×3 min (25° C.)

(B) The supernatant was recovered from the centrifugally separated composition and filtered on a filter (Millex LH, pore diameter=0.45 μm, diameter=13 mm, from Nihon Millipore K.K.) and the concentration of the azo compound in the supernatant was measured using the previously described GPC and the same conditions as for the calibration curve.

(C) The adsorption rate (%) was determined from these measurement results using the following formula.

adsorption rate (%)={azo compound concentration in solution 1 (g/mL)−azo compound concentration in the supernatant for the composition (g/mL)}/{azo compound concentration in solution 1 (g/mL)}×100

<Method for Measuring the Acid Value>

The acid value is the number of milligrams of potassium hydroxide required to neutralize the acid present in 1 g of the sample. That is, the acid value refers to the number of milligrams of potassium hydroxide required to neutralize, for example, the free fatty acid and resin-based acid, present in 1 g of the sample.

The acid value is measured in the present invention based on JIS K 0070-1992. The measurement is specifically carried out using the following procedure.

(1) Reagent Preparation

A phenolphthalein solution is obtained by dissolving 1.0 g phenolphthalein in 90 mL ethyl alcohol (95 vol %) and bringing to 100 mL by the addition of ion-exchanged water.

7 g special-grade potassium hydroxide is dissolved in 5 mL water and brought to 1 L by the addition of ethyl alcohol (95 vol %). After standing for 3 days in a base-resistant container isolated from contact with, e.g., carbon dioxide, filtration is performed to obtain the potassium hydroxide solution. The obtained potassium hydroxide solution is stored in a base-resistant container. The factor for this potassium hydroxide solution is determined as follows: 25 mL of 0.1 mol/L hydrochloric acid is taken to an Erlenmeyer flask; several drops of the above-described phenolphthalein solution are added; titration is performed with the potassium hydroxide solution; and the factor is determined from the amount of the potassium hydroxide solution required for neutralization. The 0.1 mol/L hydrochloric acid is prepared based on JIS K 8001-1998.

(2) Procedure (A) The Main Test 2.0 g of the sample is precisely weighed into a 200-mL Erlenmeyer flask; 100 mL of a toluene/ethanol (2:1) mixed solution is added; and dissolution is carried out over 5 hours. Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) the Blank Test

Titration is performed using the same procedure as described above, but omitting the sample (i.e., only the toluene/ethanol (2:1) mixed solution is used).

(3) Calculation of the Acid Value

The acid value is calculated by substituting the obtained results into the following equation.

$$AV=[(B-A)\times f\times 5.61]/S$$

wherein

AV: acid value (mg KOH/g)
A: amount of addition of the potassium hydroxide solution in the blank test (mL)
B: amount of addition of the potassium hydroxide solution in the main test (mL)
f: factor for the potassium hydroxide solution
S: sample (g)

<Method for Measuring the Amine Value>

The amine value is measured in the present invention based on JIS K 7237-1995. The measurement is specifically carried out using the following procedure.

(1) Reagent Preparation 0.1 g Crystal Violet is dissolved in 100 mL acetic acid to obtain a Crystal Violet solution. 8.5 mL perchloric acid is slowly added with mixing to a solution that has been preliminarily prepared by mixing 500 mL acetic acid with 200 mL acetic anhydride. This is brought to a total of 1 L by the addition of acetic acid and is then allowed to stand for 3 days to give a perchloric acid/acetic acid solution. The factor for this perchloric acid/acetic acid solution is determined as follows: 0.1 g potassium hydrogen phthalate is weighed to 1 mg and is dissolved in 20 mL acetic acid; 90 mL o-nitrotoluene is then added; several drops of the Crystal Violet solution are added and titration is performed with the perchloric acid/acetic acid solution; and the factor is determined from the amount of perchloric acid/acetic acid solution required for neutralization.

(2) Procedure (A) the Main Test 2.0 g of the sample is precisely weighed into a 200-mL beaker; 100 mL of an o-nitrotoluene/acetic acid (9:2) mixed solution is added; and dissolution is carried out over 3 hours. Several drops of the Crystal Violet solution are then added as the indicator and titration is carried out using the perchloric acid/acetic acid solution. The endpoint of the titration is taken to be when the blue color of the indicator converts to a green color and the green color persists for approximately 30 seconds.

(B) the Blank Test

The test is performed using the same procedure as described above, but omitting the sample (i.e., only the o-nitrotoluene/acetic acid (9:2) mixed solution is used).

(3) Calculation of the Amine Value

The amine value is calculated by substituting the obtained results into the following equation.

$$AmV=[(D-C)\times f\times 5.61]/S$$

wherein

AmV: amine value (mg KOH/g)

C: amount of addition of the perchloric acid/acetic acid solution in the blank test (mL)

D: amount of addition of the perchloric acid/acetic acid solution in the main test (mL)

f: factor for the perchloric acid/acetic acid solution

S: sample (g)

EXAMPLES

The present invention is specifically described below using examples, but the following examples in no way limit the present invention. In the following examples, "parts" and "%" are both on a weight basis.

Examples of the production of the azo compound used by the present invention will now be described.

<Production Example for Azo Compound Polymer Component (A-1)>

While operating under replacement with nitrogen, 100 parts of propylene glycol monomethyl ether were heated under reflux at a liquid temperature of at least 120° C. and to this was added dropwise over 3 hours a mixture of 152 parts of styrene, 38 parts of n-butyl acrylate, 10 parts of acrylic acid (styrene/n-butyl acrylate/acrylic acid=10.5/2.1/1.0 [molar ratio]), and 1.25 parts of tert-butylperoxy benzoate [organoperoxide-type polymerization initiator, product name: "PERBUTYL Z", from NOF CORPORATION]. After the completion of addition, the solution was stirred for 3 hours and was then distilled at normal pressure while raising the temperature to a solution temperature of 170° C. After a solution temperature of 170° C. had been reached, distillation was carried out for 1 hour at a reduced pressure of 1 hPa in order to remove the solvent and obtain a solid resin. This solid was dissolved in tetrahydrofuran and reprecipitated with n-hexane and the precipitated solid was filtered off to obtain polymer component (A-1). The properties of the obtained polymer component (A-1) are given in Table 1.

<Production Examples for Azo Compound Polymer Components (A-2) to (A-11) and (A-19) to (A-25)>

With regard to polymer components (A-2) to (A-11) and (A-19) to (A-25), azo compound polymer components (A-2) to (A-11) and (A-19) to (A-25) were produced proceeding as for polymer component (A-1), but changing the type of polymerizable monomer and the compositional ratio as shown in Table 1. The total mass of the polymerizable monomer was the same as for polymer component (A-1).

The properties of the obtained polymer components (A-2) to (A-11) and (A-19) to (A-25) are given in Table 1.

<Production Example for Azo Compound Polymer Component (A-12)>

Azo compound polymer component (A-12) was produced proceeding as for polymer component (A-11), but changing the 1.25 mass parts of PERBUTYL Z to 20.0 mass parts of PERBUTYL D [NOF CORPORATION] and carrying out a supplemental addition with the polymerizable monomer of 0.20 mass parts of trimethylolpropane tris(3-mercaptopropionate) [Sakai Chemical Industry Co., Ltd.] (a β-mercaptopropionic acid). The properties of the obtained polymer component (A-12) are given in Table 1.

<Production Examples for Azo Compound Polymer Components (A-13) and (A-14)>

Azo compound polymer components (A-13) and (A-14) were produced proceeding as for polymer component (A-12), but changing the trimethylolpropane tris(3-mercaptopropionate) [Sakai Chemical Industry Co., Ltd.] (a β-mercaptopropionic acid) to 0.15 mass parts and 0.10 mass parts, respectively. The properties of the obtained polymer components (A-13) and (A-14) are shown in Table 1.

<Production Examples for Azo Compound Polymer Components (A-15) to (A-18)>

Azo compound polymer components (A-15) to (A-18) were produced proceeding as for polymer component (A-11), but changing the PERBUTYL Z to 0.90 mass parts, 0.80 mass parts, 0.70 mass parts, and 0.55 mass parts, respectively. The properties of the obtained polymer components (A-15) to (A-18) are shown in Table 1.

<Production Example for Azo Compound Polymer Component (A-26)>

The following were introduced into an autoclave fitted with a vacuum system, water separator, nitrogen gas introduction device, temperature measurement device, and stirring device:

terephthalic acid: 21 mass parts, isophthalic acid: 21 mass parts, bisphenol A-2 mol propylene oxide adduct: 120 mass parts, and dibutyltin oxide: 0.030 mass parts.

A reaction was carried out for 15 hours at 220° C. under normal pressure and a nitrogen atmosphere and for an additional 2.5 hours under a vacuum of 10 to 20 mmHg to obtain a polyester resin 1 (polymer component (A-26)). The properties of polyester resin 1 are as follows: Mw=12,000, Mw/Mn=2.49, Tg=74.9 (° C.), acid value=12.1 (mg KOH/g).

TABLE 1

| polymer | compositional ratio (molar ratio) | | | | | | | | | molecular weight | acid value | amine value |
|---|---|---|---|---|---|---|---|---|---|---|---|---|
| segment no. | St | AA | AAm | MA | BA | HexA | StMA | BzMA | EPMA | Mn | (mg KOH/g) | (mg KOH/g) |
| A-1 | 11.00 | 1.00 | 0.00 | 0.00 | 2.00 | 0.00 | 0.00 | 0.00 | 0.00 | 15000 | 30.0 | 0.0 |
| A-2 | 7.00 | 1.00 | 0.00 | 0.00 | 0.60 | 0.00 | 0.00 | 0.00 | 0.00 | 15000 | 63.0 | 0.0 |
| A-3 | 8.00 | 1.00 | 0.00 | 0.00 | 0.60 | 0.00 | 0.00 | 0.00 | 0.00 | 15000 | 55.0 | 0.0 |
| A-4 | 11.00 | 1.00 | 0.33 | 0.00 | 0.60 | 0.00 | 0.00 | 0.00 | 0.00 | 15000 | 40.0 | 20.0 |
| A-5 | 11.00 | 1.00 | 0.13 | 0.00 | 0.60 | 0.00 | 0.00 | 0.00 | 0.00 | 15000 | 40.0 | 9.0 |
| A-6 | 11.00 | 1.00 | 0.09 | 0.00 | 0.60 | 0.00 | 0.00 | 0.00 | 0.00 | 15000 | 40.0 | 6.0 |
| A-7 | 11.00 | 1.00 | 0.06 | 0.00 | 0.60 | 0.00 | 0.00 | 0.00 | 0.00 | 15000 | 40.0 | 3.0 |
| A-8 | 12.00 | 1.00 | 0.00 | 0.00 | 0.60 | 0.00 | 0.00 | 0.00 | 0.00 | 15000 | 37.0 | 0.0 |
| A-9 | 15.00 | 1.00 | 0.18 | 0.00 | 0.60 | 0.00 | 0.00 | 0.00 | 0.00 | 15000 | 32.0 | 10.0 |
| A-10 | 15.00 | 1.00 | 0.06 | 0.00 | 0.60 | 0.00 | 0.00 | 0.00 | 0.00 | 15000 | 32.0 | 3.0 |
| A-11 | 15.00 | 1.00 | 0.00 | 0.00 | 0.60 | 0.00 | 0.00 | 0.00 | 0.00 | 15000 | 32.0 | 0.0 |
| A-12 | 15.00 | 1.00 | 0.00 | 0.00 | 0.60 | 0.00 | 0.00 | 0.00 | 0.00 | 1800 | 32.0 | 0.0 |
| A-13 | 15.00 | 1.00 | 0.00 | 0.00 | 0.60 | 0.00 | 0.00 | 0.00 | 0.00 | 2500 | 32.0 | 0.0 |
| A-14 | 15.00 | 1.00 | 0.00 | 0.00 | 0.60 | 0.00 | 0.00 | 0.00 | 0.00 | 3500 | 32.0 | 0.0 |
| A-15 | 15.00 | 1.00 | 0.00 | 0.00 | 0.60 | 0.00 | 0.00 | 0.00 | 0.00 | 28000 | 32.0 | 0.0 |
| A-16 | 15.00 | 1.00 | 0.00 | 0.00 | 0.60 | 0.00 | 0.00 | 0.00 | 0.00 | 35000 | 32.0 | 0.0 |
| A-17 | 15.00 | 1.00 | 0.00 | 0.00 | 0.60 | 0.00 | 0.00 | 0.00 | 0.00 | 45000 | 32.0 | 0.0 |
| A-18 | 15.00 | 1.00 | 0.00 | 0.00 | 0.60 | 0.00 | 0.00 | 0.00 | 0.00 | 55000 | 32.0 | 0.0 |
| A-19 | 15.00 | 1.00 | 0.00 | 0.60 | 0.00 | 0.00 | 0.00 | 0.00 | 0.00 | 15000 | 32.0 | 0.0 |
| A-20 | 12.00 | 1.00 | 0.00 | 0.00 | 3.50 | 0.00 | 0.00 | 0.00 | 0.00 | 15000 | 32.0 | 0.0 |
| A-21 | 15.00 | 1.00 | 0.00 | 0.00 | 0.00 | 0.60 | 0.00 | 0.00 | 0.00 | 15000 | 32.0 | 0.0 |
| A-22 | 15.00 | 1.00 | 0.00 | 0.00 | 0.00 | 0.00 | 0.60 | 0.00 | 0.00 | 15000 | 32.0 | 0.0 |
| A-23 | 15.00 | 1.00 | 0.00 | 0.00 | 0.00 | 0.00 | 0.00 | 0.60 | 0.00 | 15000 | 32.0 | 0.0 |
| A-24 | 17.00 | 1.00 | 0.00 | 0.00 | 0.60 | 0.00 | 0.00 | 0.00 | 0.00 | 15000 | 28.0 | 0.0 |
| A-25 | 63.00 | 0.00 | 0.00 | 0.00 | 0.60 | 0.00 | 0.00 | 0.00 | 3.00 | 15000 | 0.0 | 0.0 |

St: styrene, AA: acrylic acid, AAm: acrylamide, MA: methyl acrylate, BA: n-butyl acrylate, HexA: n-hexyl acrylate, StMA: stearyl methacrylate, BzMA: benzyl methacrylate, EPMA: 2,3-epoxypropyl methacrylate <Production Example for Azo Compound 1 Compound (23)>

Azo compound 1 [compound (23)] having the structure shown below was produced according to the following scheme.

[C17]

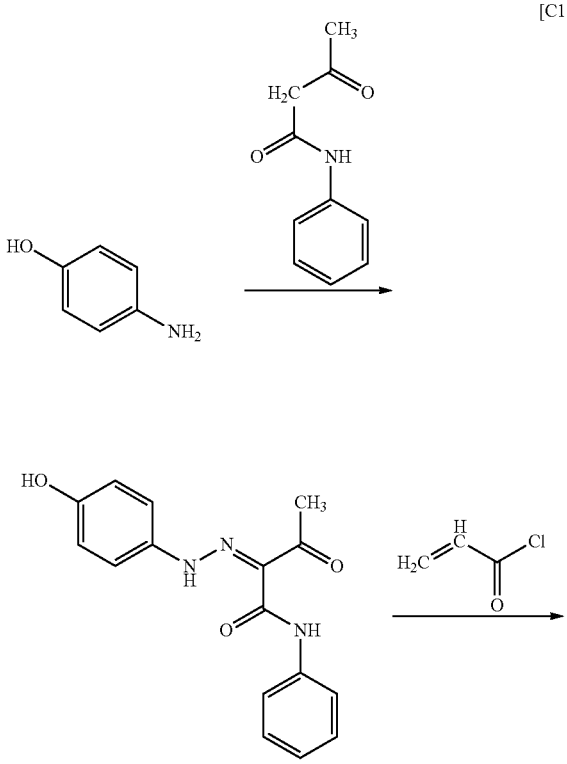

(21)

-continued

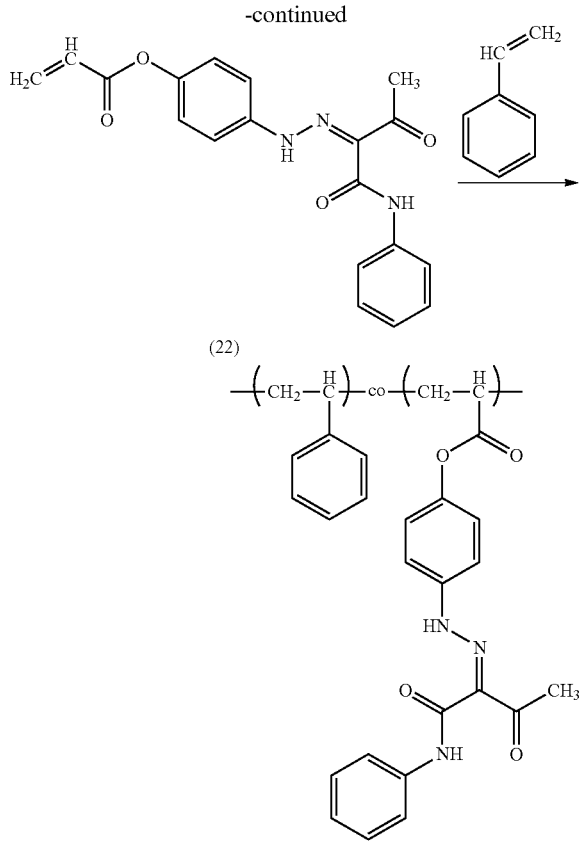

(22)

(23)

[The "co" in the structural formula given above is a notation that indicates that the sequence of the individual monomer units constituting the copolymer is random.]

First, 30.0 parts of water and 11.0 parts of concentrated hydrochloric acid were added to 5.00 parts of 4-aminophenol (Tokyo Chemical Industry Co., Ltd.) and ice cooling to 10° C. or below was performed. To this solution was added 3.46 parts of sodium nitrite dissolved in 8.10 parts of water and a reaction was run for 1 hour at the same temperature. 0.657 parts of sulfamic acid was then added and stirring was performed for an additional 20 minutes (the obtained solution is referred to as the "diazonium salt solution"). 8.13 parts of acetoacetoanilide (Tokyo Chemical Industry Co., Ltd.) was added to 48.0 parts of water and ice cooling to 10° C. or below was carried out and the diazonium salt solution referenced above was added. This was followed by the addition of 14.3 parts of sodium carbonate dissolved in 80.0 parts of water and reaction for 2 hours at 10° C. or below. After the completion of the reaction, 50 parts of water was added and stirring was performed for 30 minutes and the solid was filtered off and purified by recrystallization from N,N-dimethylformamide to obtain compound (21).

Then, 3.00 parts of compound (21) and 1.20 parts of triethylamine were added to 30.0 parts of chloroform with ice cooling to 10° C. or below. To this solution was added 1.03 parts of acryloyl chloride (Tokyo Chemical Industry Co., Ltd.) and a reaction was carried out for 20 minutes at the same temperature. This was extracted with chloroform followed by concentration and purification to obtain compound (22).

9.44 parts of N,N-dimethylformamide, 1.06 parts of compound (22), and 0.327 parts of azobisisobutyronitrile were then added to 10 mass parts of styrene and stirring was performed for 2 hours at 80° C. under a nitrogen atmosphere. After the completion of the reaction, azo compound 1, which is compound (23), was obtained by purification by recrystallization from N,N-dimethylformamide. The properties of the obtained azo compound 1 are given in Table 3.

[Analytical Results for Azo Compound 1]

[1] Result of measurement of the molecular weight (GPC): number-average molecular weight (Mn)=15,000

[2] Result of measurement of the acid value: 0 mg KOH/g

Figure 2:
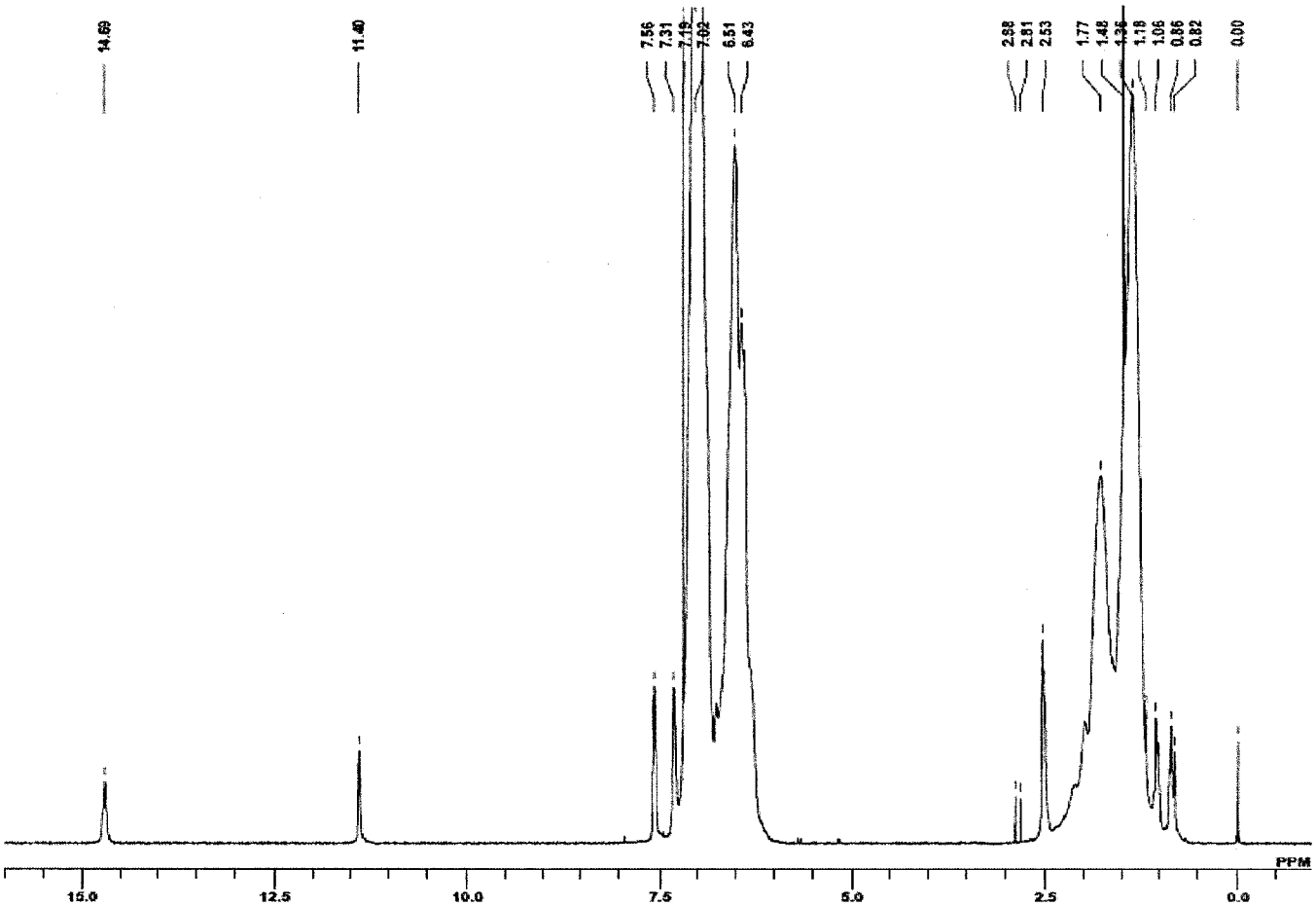
FIG. 2 is a diagram that shows the $^{1}$H-NMR spectrum, at 400 MHz and room temperature in $CDCl_3$, of azo compound 1.

[3] $^1$H-NMR (400 MHz, $CDCl_3$, room temperature) results (refer to FIG. 2): δ [ppm]=14.69 (s, 1H), 11.40 (s, 1H), 7.56 (s, 2H), 7.31 (s, 2H), 7.19-6.43 (m, 135H), 2.53 (s, 3H), 2.47-1.05 (m, 97H)

<Production Examples for Azo Compounds 2 to 7 and 54 to 60>

Azo compounds 2 to 7 and 54 to 60 were produced proceeding as for azo compound 1, but changing the azo skeleton moiety structure and polymer component as in Table 2. The properties of the obtained azo compounds 2 to 7 and 54 to 60 are shown in Table 3.

<Production Example for Azo Compound 8 [Compound (27)]>

Compound (26), having the azo skeleton moiety structure shown by the following structure, was produced according to the following scheme.

[C18]

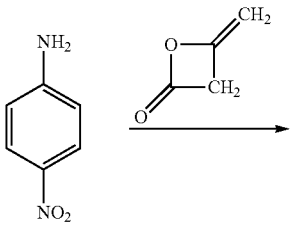

-continued

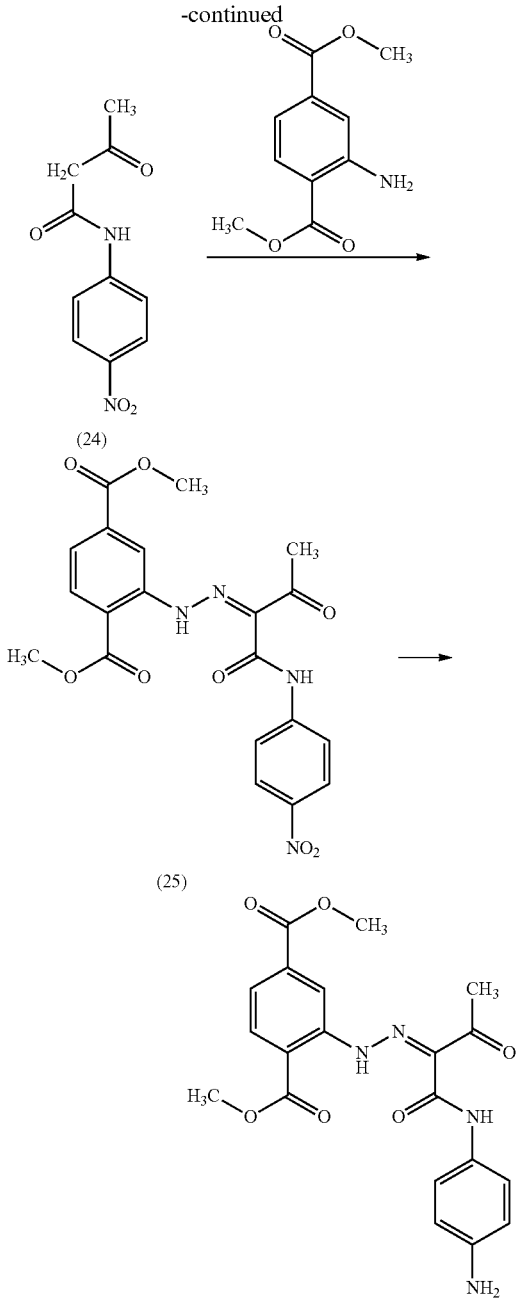

First, 3.11 parts of 4-nitroaniline (Tokyo Chemical Industry Co., Ltd.) was added to 30 parts of chloroform; ice cooling to 10° C. or below was carried out; and 1.89 parts of diketene (Tokyo Chemical Industry Co., Ltd.) was added. This was followed by stirring for 2 hours at 65° C. After completion of the reaction, compound (24) was obtained by extraction with chloroform and concentration.

Then, 40.0 parts of methanol and 5.29 parts of concentrated hydrochloric acid were added to 4.25 parts of dimethyl 2-aminoterephthalate (Merck Ltd.) and ice cooling to 10° C. or below was carried out. To this solution was added 2.10 parts of sodium nitrite dissolved in 6.00 parts of water and a reaction was run for 1 hour at the same temperature. 0.990 parts of sulfamic acid was added and stirring was performed for an additional 20 minutes (the obtained solution is referred to as the "diazonium salt solution"). 4.51 parts of compound (24) was added to 70.0 parts of methanol, ice cooling to 10° C. or below was carried out, and the diazonium salt solution referenced above was added. This was followed by the addition of 5.83 parts of sodium acetate dissolved in 7.00 parts of water and a reaction was run for 2 hours at 10° C. or below. After the completion of the reaction, 300 parts of water was added; stirring was carried out for 30 minutes; and the solid was filtered off and purified by recrystallization from N,N-dimethylformamide to obtain compound (25). 8.58 parts of compound (25) and 0.4 parts of palladium/active carbon (5% palladium) were then added to 150 parts of N,N-dimethylformamide and stirring was carried out for 3 hours at 40° C. under a hydrogen gas atmosphere (reaction pressure from 0.1 to 0.4 MPa). After the completion of the reaction, the solution was filtered off and concentrated to obtain compound (26).

The amino group in compound (26), which is the azo skeleton moiety structure, was bound by amidation of the carboxyl group in the polymer component (A-1) to produce azo compound 8 [compound (27)] according to the following scheme.

[The "co" in the structural formulas given above is a notation that indicates that the sequence of the individual monomer units constituting the copolymer is random.]

First, 1.98 parts of compound (26) was added to 500 parts of tetrahydrofuran and dissolution was carried out with heating to 80° C. After dissolution, the temperature was lowered to 50° C. and 15 parts of polymer component (A-1) was added and dissolved; 1.96 parts of 1-ethyl-3-(3-dimethylaminopropyl)carbodiimide•hydrochloride (EDC•HCl) was added and stirring was carried out for 5 hours at 50° C.; the solution temperature was then gradually returned to room temperature; and the reaction was completed by stirring overnight. After the completion of the reaction, the solution was filtered and concentrated and azo compound 8, which is compound (27), was produced by purification by reprecipitation with methanol.

Using the various instrumentation described above, it was confirmed that the obtained azo compound 8 had the structure given in the preceding formula. The analytical results are provided below. In addition, the properties of the obtained azo compound 8 are given in Table 3.

[C19]

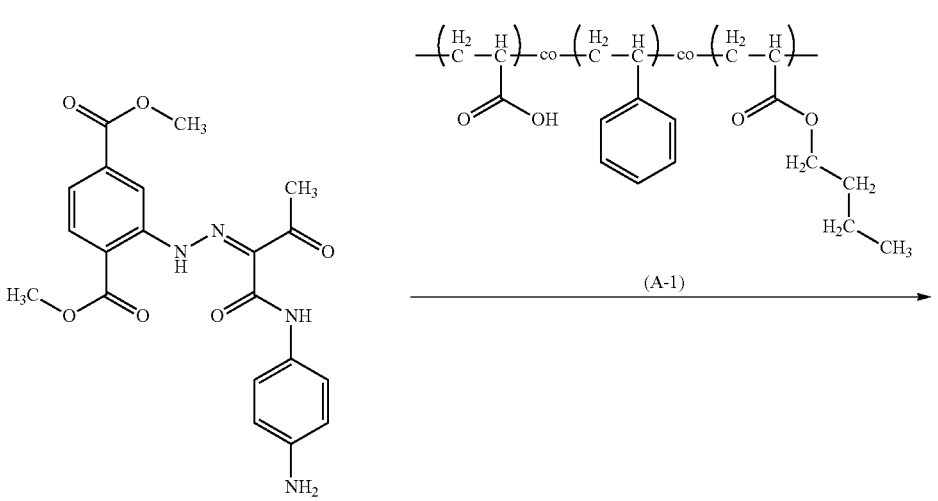

(26)

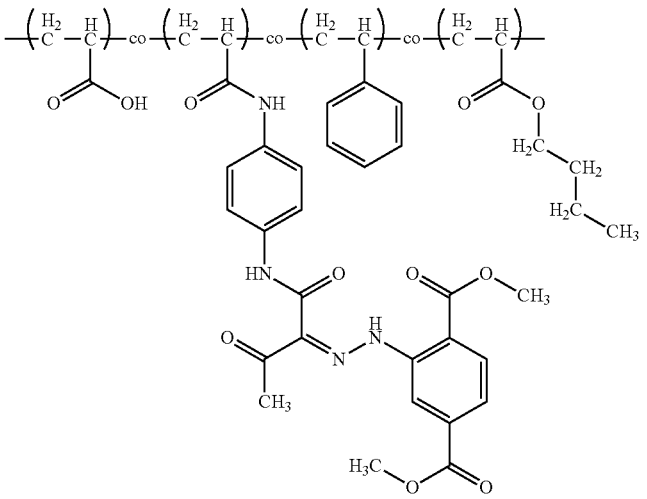

(27)

[Analytical Results for Azo Compound 8]

[1] Result of measurement of the molecular weight (GPC): number-average molecular weight (Mn)=15,000

[2] Result of measurement of the acid value: 7.3 mg KOH/g

Figure 3:
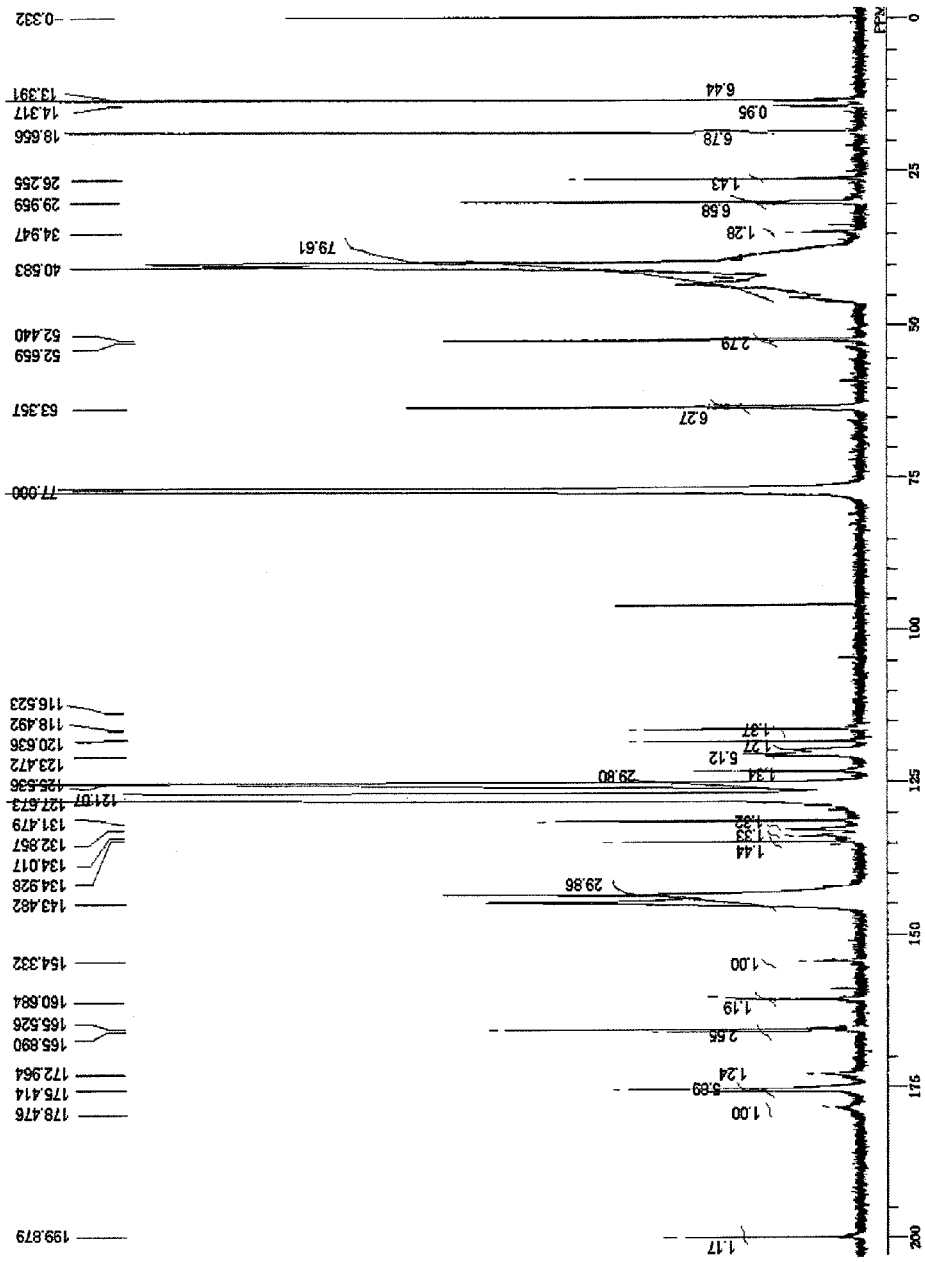
FIG. 3 is a diagram that shows the $^{13}$C-NMR spectrum, at 400 MHz and room temperature in $CDCl_3$, of azo compound 8.

[3] $^{13}$C-NMR (600 MHz, $CDCl_3$, room temperature) results (refer to FIG. 3): δ [ppm]=199.88, 178.45, 175.41, 172.96, 165.89, 165.52, 160.684, 154.34, 143.48, 134.93, 134.02, 132.86, 131.48, 127.67, 125.54, 120.64, 118.49, 116.52, 63.36, 52.66, 52.44, 40.58, 34.95, 30.08, 26.26, 18.66, 14.32, 13.39

<Production Examples for Azo Compounds 9 to 28, 30 to 34, and 36 to 53>

Azo compounds 9 to 28, 30 to 34, and 36 to 53 were produced proceeding as for azo compound 8, but changing the azo skeleton moiety structure and polymer component as shown in Table 2. The properties of the obtained azo compounds 9 to 28, 30 to 34, and 36 to 53 are given in Table 3.

<Production Example for Azo Compound 35>

The compound (28) indicated below, which is an azo skeleton moiety structure, was obtained by changing the 4-nitroaniline in the production of the azo skeleton moiety structure of azo compound 8 to 3-nitroaniline and changing the dimethyl 2-aminoterephthalate therein to 3-aminobenzamide. Then, 3.00 parts of compound (28) and 1.20 parts of triethylamine were added to 30.0 parts of chloroform and ice cooling to 10° C. or below was performed. To this solution was added 1.03 parts of acryloyl chloride (Tokyo Chemical Industry Co., Ltd.) and a reaction was run for 20 minutes at the same temperature. Extraction of this with chloroform, concentration, and purification yielded compound (32). 9.44 parts of N,N-dimethylformamide, 1.06 parts of compound (32), and 0.327 parts of azobisisobutyronitrile were then added to 10 mass parts of styrene and stirring was performed for 2 hours at 80° C. under a nitrogen atmosphere. After the completion of the reaction, azo compound 35 was produced by purification by recrystallization from N,N-dimethylformamide. The properties of the obtained azo compound 35 are shown in Table 3.

[C20]

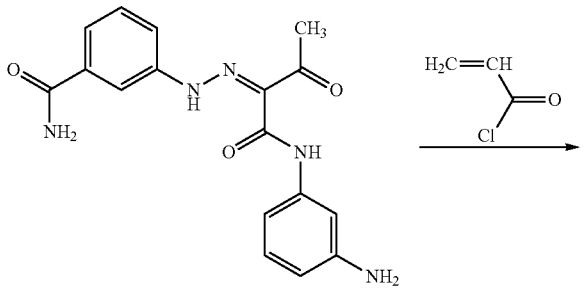

(28)

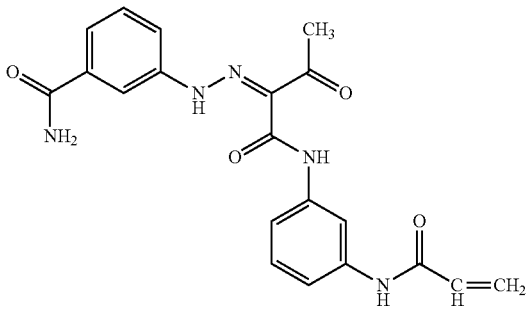

(32)

<Production Example for Azo Compound 29>

Azo compound 29 was obtained proceeding as for azo compound 8, but changing the 4.25 parts of dimethyl 2-aminoterephthalate to 4.25 parts of methyl 6-amino-2-naphthoate (Tokyo Chemical Industry Co., Ltd.). The properties of the obtained azo compound 29 are given in Table 3.

<Production Example for Azo Compound 61>

Azo compound 61 [compound (29)] was produced according to the following scheme.

[C21]

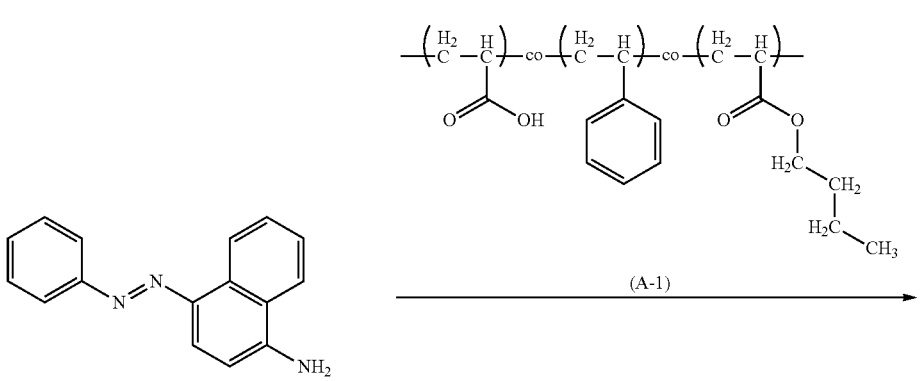

-continued

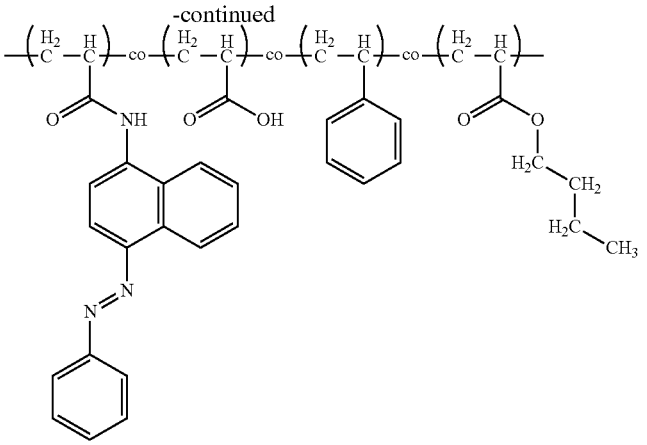

(29)

Azo compound 61 was obtained proceeding as in the polymer bonding step of the Production Example for Azo Compound 8, but changing the 1.98 parts of compound (26) to 1.98 parts of 4-phenylazo-1-naphthylamine (Tokyo Chemical Industry Co., Ltd.). The properties of the obtained azo compound 61 are given in Table 3.

<Production Example for Azo Compound 62>

Azo compound 62 [compound (31)] was produced according to the following scheme.

[C22]

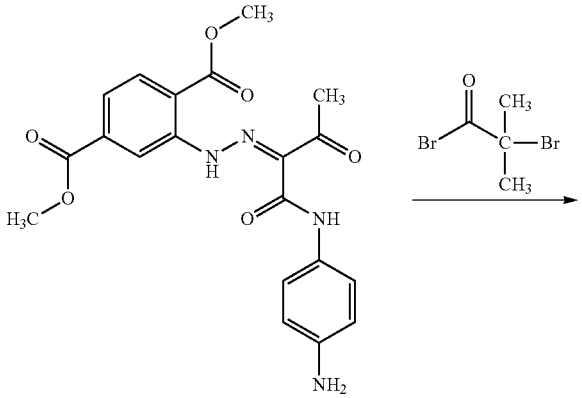

(26)

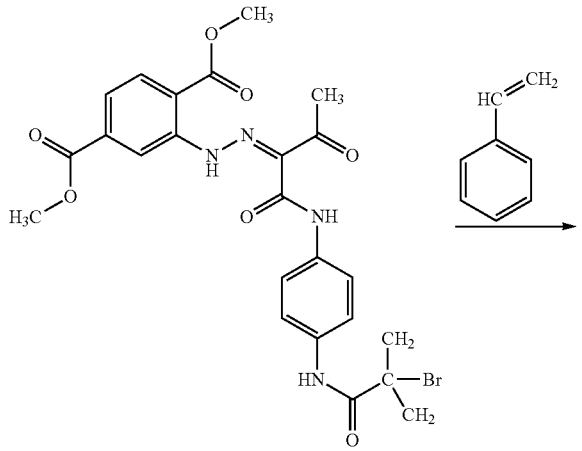

(30)

-continued

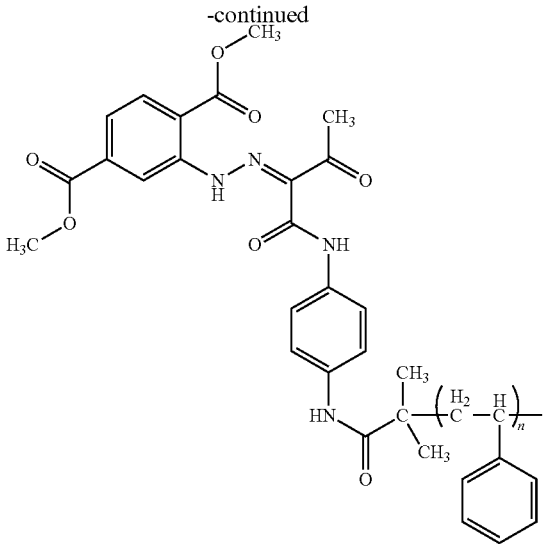

(31)

First, 5.00 parts of compound (26) and 1.48 parts of triethylamine were added to 25.0 parts of chloroform and ice cooling to 10° C. or below was carried out. 2.07 parts of 2-bromoisobutyryl bromide (by Tokyo Chemical Industry Co., Ltd) was also added and stirring was performed for 6 hours at room temperature. After the completion of the reaction, compound (30) was obtained by extraction with chloroform and concentration.

Then, 2.50 parts of compound (30), 140 parts of styrene, 1.77 parts of N,N,N',N",N"-pentamethyldiethylenetriamine, and 0.64 parts of copper(I) bromide were added to 50.0 parts of N,N-dimethylformamide. This was followed by stirring for 45 minutes at 120° C. under a nitrogen atmosphere. After the completion of the reaction, azo compound 62, which is compound (31), was produced by extraction with chloroform and purification by reprecipitation with methanol.

Using the various instrumentation described above, it was confirmed that the obtained azo compound 62 had the structure given in the preceding formula. The analytical results are provided below. In addition, the properties of the obtained azo compound 62 are given in Table 3.

[Analytical Results for Azo Compound 62]

[1] Result of measurement of the molecular weight (GPC): number-average molecular weight (Mn)=21,000

[2] Result of measurement of the acid value: 0 mg KOH/g

Figure 4:
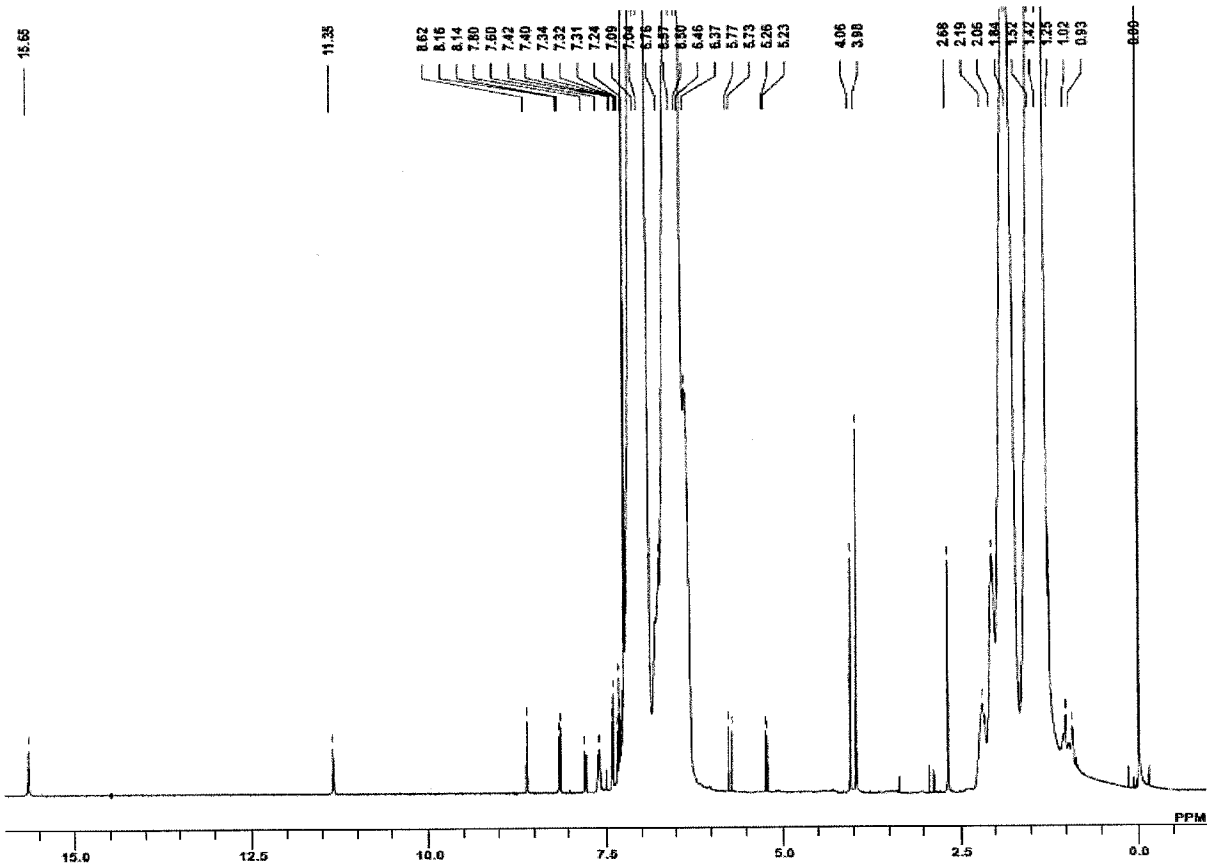
FIG. 4 is a diagram that shows the $^{1}$H-NMR spectrum, at 400 MHz and room temperature in $CDCl_3$, of azo compound 62.

[3] $^1$H-NMR (400 MHz, $CDCl_3$, room temperature) results (refer to FIG. 4): δ [ppm]=15.65 (s, 1H), 11.35 (s, 1H), 8.62 (s, 1H), 7.37-6.27 (m, 1294H), 4.06 (s, 3H), 3.98 (s, 3H), 2.47-1.05 (m, 786H)

TABLE 2

| azo compound No. | polymer component | azo skeleton moiety structure (W2) | | | | | | |
|---|---|---|---|---|---|---|---|---|
| | | $R_1$ | $R_2$ | $R_{11}$ | $R_{12}$ | $R_{13}$ | $R_{14}$ | $R_{15}$ |
| 1 | St = 10 | $CH_3$ | NHPh | H | H | Ar-1 | H | H |
| 2 | St/BA/AA = 9.78/0.11/0.11 | $CH_3$ | NHPh | $CH_3$ | $CH_3$ | Ar-1 | H | H |
| 3 | St/BA/AA = 9.78/0.11/0.11 | $CH_3$ | $NHCH_3$ | $CH_3$ | $CH_3$ | Ar-1 | H | H |
| 4 | St/BA/AA = 9.78/0.11/0.11 | $CH_3$ | $CH_3$ | $CH_3$ | $CH_3$ | Ar-1 | H | H |
| 5 | St/BA/AA = 9.78/0.11/0.11 | $CH_3$ | Ph | $CH_3$ | $CH_3$ | Ar-1 | H | H |
| 6 | St/BA/AA = 9.78/0.11/0.11 | $OCH_3$ | $CH_3$ | $CH_3$ | $CH_3$ | Ar-1 | H | H |
| 7 | St/BA/AA = 9.78/0.11/0.11 | $OCH_2Ph$ | $CH_3$ | $CH_3$ | $CH_3$ | Ar-1 | H | H |
| 8 | A-1 | $CH_3$ | $R_2$-1 | H | $COOCH_3$ | H | H | $COOCH_3$ |
| 9 | A-1 | $CH_3$ | $R_2$-2 | H | H | H | $CONH_2$ | H |
| 10 | A-1 | $CH_3$ | $R_2$-1 | H | H | H | $CONH_2$ | H |
| 11 | A-1 | $CH_3$ | $R_2$-2 | H | CONHPh | H | H | $OCH_3$ |
| 12 | A-1 | $CH_3$ | $R_2$-2 | H | $CONH_2$ | H | H | $OCH_3$ |
| 13 | A-1 | $CH_3$ | $R_2$-2 | H | $CONH_2$ | H | H | $CH_3$ |
| 14 | A-1 | $CH_3$ | $R_2$-2 | H | H | $CONHCH_3$ | H | H |
| 15 | A-1 | $CH_3$ | $R_2$-2 | H | H | H | H | $CONH_2$ |
| 16 | A-1 | $CH_3$ | $R_2$-2 | H | $COOCH_3$ | H | H | $CH_3$ |
| 17 | A-1 | $CH_3$ | $R_2$-2 | H | COOH | H | H | $COOCH_3$ |
| 18 | A-1 | $CH_3$ | $R_2$-2 | H | $COOCH_3$ | H | $COOCH_3$ | H |
| 19 | A-1 | $CH_3$ | $R_2$-2 | H | H | $COOCH_2CH_2$ | H | H |
| 20 | A-1 | $CH_3$ | $R_2$-2 | $CH_3$ | $COOCH_2$ | H | H | H |
| 21 | A-1 | $CH_3$ | $R_2$-2 | H | $OCH_3$ | COOH | H | Cl |
| 22 | A-1 | $CH_3$ | $R_2$-2 | H | Ph | OH | Ph | H |
| 23 | A-1 | $CH_3$ | $R_2$-2 | H | H | $C(CH_3)_3$ | H | H |
| 24 | A-25 | $CH_3$ | $R_2$-3 | H | $COOCH_3$ | H | H | $COOCH_3$ |
| 25 | A-26 | $CH_3$ | $R_2$-4 | H | $COOCH_3$ | H | H | $COOCH_3$ |
| 26 | A-1 | $R_1$-1 | NHPh | H | $COOCH_3$ | H | H | $COOCH_3$ |
| 27 | A-1 | $R_1$-1 | $NHCH_3$ | H | $COOCH_3$ | H | H | $COOCH_3$ |
| 28 | A-1 | $R_1$-1 | OEt | H | $COOCH_3$ | H | H | $COOCH_3$ |
| 29 | A-1 | $CH_3$ | $R_2$-2 | | | naphthalene skeleton (W1) | | |
| 30 | A-2 | $CH_3$ | $R_2$-2 | H | H | H | $CONH_2$ | H |
| 31 | A-3 | $CH_3$ | $R_2$-2 | H | H | H | $CONH_2$ | H |
| 32 | A-8 | $CH_3$ | $R_2$-2 | H | H | H | $CONH_2$ | H |
| 33 | A-11 | $CH_3$ | $R_2$-2 | H | H | H | $CONH_2$ | H |
| 34 | A-24 | $CH_3$ | $R_2$-2 | H | H | H | $CONH_2$ | H |
| 35 | St = 10 (*1) | $CH_3$ | $R_2$-2 | H | H | H | $CONH_2$ | H |
| 36 | A-19 | $CH_3$ | $R_2$-2 | H | H | H | $CONH_2$ | H |
| 37 | A-20 | $CH_3$ | $R_2$-2 | H | H | H | $CONH_2$ | H |
| 38 | A-21 | $CH_3$ | $R_2$-2 | H | H | H | $CONH_2$ | H |
| 39 | A-22 | $CH_3$ | $R_2$-2 | H | H | H | $CONH_2$ | H |
| 40 | A-23 | $CH_3$ | $R_2$-2 | H | H | H | $CONH_2$ | H |
| 41 | A-12 | $CH_3$ | $R_2$-2 | H | H | H | $CONH_2$ | H |
| 42 | A-13 | $CH_3$ | $R_2$-2 | H | H | H | $CONH_2$ | H |
| 43 | A-14 | $CH_3$ | $R_2$-2 | H | H | H | $CONH_2$ | H |
| 44 | A-15 | $CH_3$ | $R_2$-2 | H | H | H | $CONH_2$ | H |
| 45 | A-16 | $CH_3$ | $R_2$-2 | H | H | H | $CONH_2$ | H |
| 46 | A-17 | $CH_3$ | $R_2$-2 | H | H | H | $CONH_2$ | H |
| 47 | A-18 | $CH_3$ | $R_2$-2 | H | H | H | $CONH_2$ | H |
| 48 | A-4 | $CH_3$ | $R_2$-2 | H | H | H | $CONH_2$ | H |
| 49 | A-5 | $CH_3$ | $R_2$-2 | H | H | H | $CONH_2$ | H |
| 50 | A-6 | $CH_3$ | $R_2$-2 | H | H | H | $CONH_2$ | H |
| 51 | A-7 | $CH_3$ | $R_2$-2 | H | H | H | $CONH_2$ | H |
| 52 | A-9 | $CH_3$ | $R_2$-2 | H | H | H | $CONH_2$ | H |
| 53 | A-10 | $CH_3$ | $R_2$-2 | H | H | H | $CONH_2$ | H |
| 54 | St/BA/AA = 29.34/0.33/0.33 | $CH_3$ | NHPh | $CH_3$ | $CH_3$ | Ar-1 | H | H |
| 55 | St/BA/AA = 4.86/0.06/0.06 | $CH_3$ | NHPh | $CH_3$ | $CH_3$ | Ar-1 | H | H |
| 56 | St/BA/AA = 3.26/0.04/0.04 | $CH_3$ | NHPh | $CH_3$ | $CH_3$ | Ar-1 | H | H |
| 57 | St/BA/AA = 2.45/0.03/0.03 | $CH_3$ | NHPh | $CH_3$ | $CH_3$ | Ar-1 | H | H |
| 58 | St/BA/AA = 1.50/0.02/0.02 | $CH_3$ | NHPh | $CH_3$ | $CH_3$ | Ar-1 | H | H |
| 59 | St/BA/AA = 1.09/0.01/0 01 | $CH_3$ | NHPh | $CH_3$ | $CH_3$ | Ar-1 | H | H |
| 60 | St/BA/AA = 9.78/0.11/0.11 | $CH_3$ | NHPh | $CH_3$ | $CH_3$ | Ar-2 | H | H |
| 62 | only St (*2) | $CH_3$ | (*3) | H | $COOCH_3$ | H | H | $COOCH_3$ |

(*1), (*2), (*3): The details of the production methods for azo compounds 35 and 62 are described in the examples.

Ph: phenyl group

St: styrene, BA: n-butyl acrylate, AA: acrylic acid

TABLE 3

| No. | acid value (AV) (mg KOH/g) | amine value (AmV) (mg KOH/g) | AmV/AV | Mn | Tg (° C.) | solubility (A) (%) | solubility (C) (%) | mol % azo skeleton (in the azo compound) |
|---|---|---|---|---|---|---|---|---|
| 1 | 0.0 | 0 | 0.00 | 15000 | 75.1 | 47.1 | 80.3 | 3.52 |
| 2 | 8.0 | 0 | 0.00 | 15000 | 76.8 | 47.5 | 61.5 | 3.23 |
| 3 | 8.0 | 0 | 0.00 | 15000 | 76.7 | 46.9 | 61.5 | 3.94 |
| 4 | 8.0 | 0 | 0.00 | 15000 | 76.9 | 46.8 | 61.5 | 4.19 |
| 5 | 8.0 | 0 | 0.00 | 15000 | 76.1 | 47.3 | 61.5 | 3.39 |
| 6 | 8.0 | 0 | 0.00 | 15000 | 75.3 | 46.7 | 61.5 | 3.93 |
| 7 | 8.0 | 0 | 0.00 | 15000 | 75.4 | 46.9 | 61.5 | 3.03 |
| 8 | 7.0 | 0 | 0.00 | 15000 | 76.5 | 48.3 | 67.8 | 3.50 |
| 9 | 7.0 | 0.5 | 0.07 | 15000 | 109.5 | 47.9 | 67.8 | 4.30 |
| 10 | 7.0 | 0.5 | 0.07 | 15000 | 109.2 | 46.1 | 67.8 | 4.30 |
| 11 | 7.0 | 0.25 | 0.04 | 15000 | 108.5 | 46.5 | 67.8 | 3.24 |
| 12 | 7.0 | 0.5 | 0.07 | 15000 | 108.4 | 46.8 | 67.8 | 3.93 |
| 13 | 7.0 | 0.5 | 0.07 | 15000 | 108.6 | 47.1 | 67.8 | 4.12 |
| 14 | 7.0 | 0.0 | 0.00 | 15000 | 100.5 | 46.5 | 67.8 | 4.11 |
| 15 | 7.0 | 0.0 | 0.00 | 15000 | 101.3 | 46.2 | 67.8 | 4.30 |
| 16 | 7.0 | 0.0 | 0.00 | 15000 | 76.5 | 48.6 | 67.8 | 3.94 |
| 17 | 7.0 | 0.0 | 0.00 | 15000 | 76.5 | 45.5 | 67.8 | 3.63 |
| 18 | 7.0 | 0.0 | 0.00 | 15000 | 76.5 | 48.6 | 67.8 | 3.50 |
| 19 | 7.0 | 0.0 | 0.00 | 15000 | 76.5 | 48.5 | 67.8 | 3.80 |
| 20 | 7.0 | 0.0 | 0.00 | 15000 | 76.5 | 48.4 | 67.8 | 3.79 |
| 21 | 7.0 | 0.0 | 0.00 | 15000 | 76.5 | 46.8 | 67.8 | 3.56 |
| 22 | 7.0 | 0.0 | 0.00 | 15000 | 76.5 | 49.2 | 67.8 | 3.07 |
| 23 | 7.0 | 0.0 | 0.00 | 15000 | 76.5 | 48.5 | 67.8 | 4.13 |
| 24 | 7.0 | 0.0 | 0.00 | 15000 | 76.5 | 48.5 | 67.2 | 3.50 |
| 25 | 2.0 | 0.0 | 0.00 | 4800 | 75.8 | 15.9 | 28.9 | 3.50 |
| 26 | 7.0 | 0.25 | 0.04 | 15000 | 76.5 | 47.5 | 67.8 | 3.02 |
| 27 | 7.0 | 0.25 | 0.04 | 15000 | 76.5 | 47.3 | 67.8 | 3.48 |
| 28 | 7.0 | 0 | 0.00 | 15000 | 76.5 | 47.1 | 67.8 | 3.35 |
| 29 | 8.0 | 0 | 0.00 | 15000 | 65.8 | 49.1 | 67.8 | 3.56 |
| 30 | 37.0 | 0 | 0.00 | 15000 | 125.8 | 24.5 | 45.3 | 4.17 |
| 31 | 29.0 | 0 | 0.00 | 15000 | 118.6 | 27.5 | 52.8 | 4.18 |
| 32 | 12.0 | 0 | 0.00 | 15000 | 111.2 | 35.5 | 62.5 | 4.20 |
| 33 | 8.0 | 0 | 0.00 | 15000 | 110.2 | 46.5 | 67.3 | 4.21 |
| 34 | 4.0 | 0 | 0.00 | 15000 | 109.1 | 55.4 | 69.8 | 4.21 |
| 35 | 0.0 | 0 | 0.00 | 15000 | 108.4 | 48.3 | 71.7 | 4.30 |
| 36 | 8.0 | 0 | 0.00 | 15000 | 107.4 | 41.2 | 65.1 | 4.14 |
| 37 | 8.0 | 0 | 0.00 | 15000 | 108.7 | 44.5 | 74.8 | 4.38 |
| 38 | 8.0 | 0 | 0.00 | 15000 | 109.8 | 70.5 | 72.5 | 4.25 |
| 39 | 8.0 | 0 | 0.00 | 15000 | 126.5 | 85.1 | 83.5 | 4.52 |
| 40 | 8.0 | 0 | 0.00 | 15000 | 108.3 | 61.5 | 68.2 | 4.28 |
| 41 | 8.0 | 0 | 0.00 | 1800 | 53.8 | 70.1 | 72.1 | 4.21 |
| 42 | 8.0 | 0 | 0.00 | 2500 | 56.7 | 68.5 | 70.5 | 4.21 |
| 43 | 8.0 | 0 | 0.00 | 3500 | 58.1 | 66.7 | 70.3 | 4.21 |
| 44 | 8.0 | 0 | 0.00 | 23000 | 109.8 | 45.3 | 67.8 | 4.21 |
| 45 | 8.0 | 0 | 0.00 | 33000 | 112.5 | 42.8 | 67.8 | 4.21 |
| 46 | 8.0 | 0 | 0.00 | 45000 | 113.4 | 38.7 | 67.8 | 4.21 |
| 47 | 8.0 | 0 | 0.00 | 55000 | 113.9 | 35.8 | 67.8 | 4.21 |
| 48 | 15.0 | 20.0 | 1.33 | 15000 | 126.3 | 23.1 | 50.7 | 4.16 |
| 49 | 15.0 | 9.0 | 0.60 | 15000 | 119.2 | 26.3 | 53.9 | 4.18 |
| 50 | 15.0 | 6.0 | 0.40 | 15000 | 113.4 | 28.5 | 56.1 | 4.18 |
| 51 | 15.0 | 3.0 | 0.20 | 15000 | 112.1 | 35.5 | 60.1 | 4.19 |
| 52 | 8.0 | 10.0 | 1.25 | 15000 | 112.3 | 40.5 | 68.1 | 4.19 |
| 53 | 8.0 | 3.0 | 0.38 | 15000 | 109.8 | 44.8 | 72.4 | 4.20 |
| 54 | 8.0 | 0 | 0.00 | 15000 | 76.8 | 49.7 | 61.5 | 1.08 |
| 55 | 8.0 | 0 | 0.00 | 15000 | 76.8 | 45.6 | 61.2 | 6.46 |
| 56 | 8.0 | 0 | 0.00 | 15000 | 76.8 | 43.8 | 61.2 | 9.69 |
| 57 | 8.0 | 0 | 0.00 | 15000 | 76.8 | 42.1 | 61.2 | 12.92 |
| 58 | 8.0 | 0 | 0.00 | 15000 | 76.8 | 39.5 | 61.2 | 16.15 |
| 59 | 8.0 | 0 | 0.00 | 15000 | 76.8 | 25.1 | 62.0 | 22.80 |
| 60 | 8.0 | 0 | 0.00 | 15000 | 76.8 | 49.7 | 61.5 | 1.08 |
| 61 | 8.0 | 0 | 0.00 | 15000 | 76.8 | 50.3 | 67.8 | 3.23 |
| 62 | 0.0 | 0 | 0.00 | 21338 | 93.5 | 56.3 | 80.3 | 0.50 |

The azo skeleton moiety structures referenced in Table 2 are described below.

general formula (W1)

[C23]

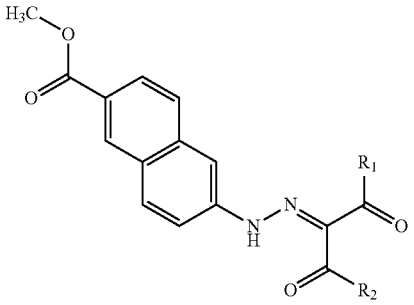

general formula (W2)

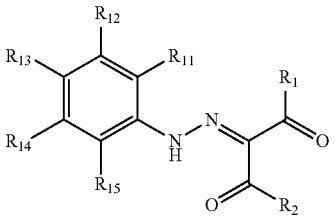

[$R_1$, $R_2$, and $R_{11}$ to $R_{15}$ in general formulas (W1) and (W2) respectively represent the substituents indicated in Table 2. The ($R_1$-1), ($R_2$-1) to ($R_2$-4) and (Ar-1) and (Ar-2) in Table 2 respectively represent the following structures.]

($R_1$-1)

[C24]

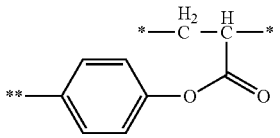

[The "*" in ($R_1$-1) above represents incorporation by chemical bonding into the polymer component and bonding with the polymer. The "", on the other hand, represents bonding with the "" in the general formulas given below.]

($R_2$-1)

[C25]

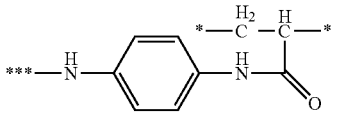

($R_2$-2)

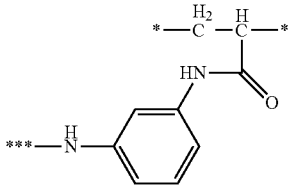

-continued ($R_2$-3)

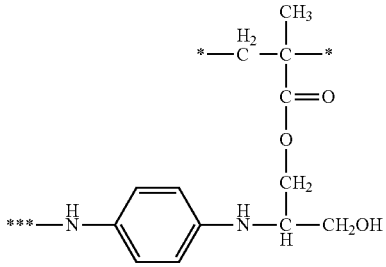

($R_2$-4)

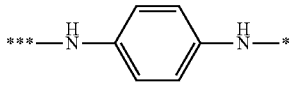

[The "*" in ($R_2$-1) to ($R_2$-3) above represents incorporation by chemical bonding in the polymer component and bonding with the polymer. In addition, the "*" in ($R_2$-4) represents a bond segment with a carboxyl group originating in the polyester comprising the polymer component. The "*", on the other hand, represents bonding with the "*" in the general formulas below.]

(Ar-1)

[C26]

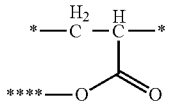

(Ar-2)

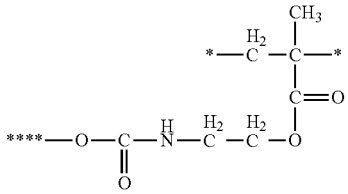

[The "*" in (Ar-1) and (Ar-2) above represents incorporation by chemical bonding in the polymer component and bonding with the polymer. The "**", on the other hand, represents bonding with the "**" in the general formulas given below.]

[C27]

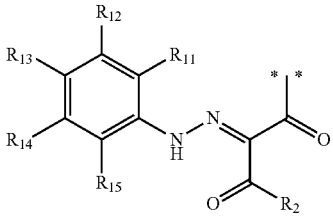

-continued

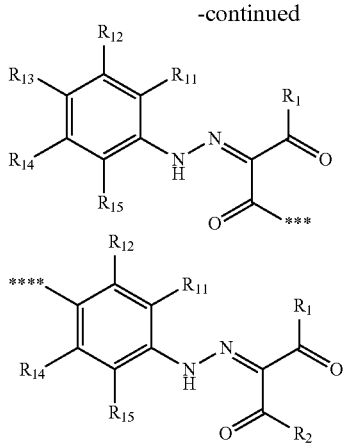

[$R_1$, $R_2$, and $R_{11}$ to $R_{15}$ in the general formulas respectively represent the substituents indicated in Table 2. The ($R_1^{-1}$). ($R_2$-1) to ($R_2$-4) and (Ar-1) and (Ar-2) in Table 2 respectively represent the structures indicated above. The "", "*" and "**" respectively represent bonding with the "", "*", and "**" of ($R_1$-1), ($R_2$-1) to ($R_2$-4) and (Ar-1) and (Ar-2).]

<Example of the Production of Polyester Resin for Use as the Toner Binder Resin>

The following were introduced into an autoclave fitted with a vacuum system, water separator, nitrogen gas introduction device, temperature measurement device, and stirring device:

terephthalate: 11 mass parts, isophthalate: 31 mass parts, bisphenol A-2 mol propylene oxide adduct: 59 mass parts, bisphenol A-3 mol propylene oxide adduct: 37 mass parts, and potassium oxalate titanate: 0.025 mass parts.

A reaction was carried out for 22 hours at 220° C. under normal pressure and a nitrogen atmosphere and for an additional 1.5 hours under a vacuum of 10 to 20 mmHg to obtain a polyester resin 2. The properties of the obtained polyester resin 2 are as follows: Mw=8750, Mw/Mn=2.55, Tg=61.2 (° C.), acid value=8.1 (mg KOH/g).

[Production of Hydrophobic Silica 1]

100 parts of silica (AEROSIL 200CF, from Nippon Aerosil Co., Ltd) was treated with 10 parts of hexamethyldisilazane and additionally with 20 parts of a chlorophenylsilicone oil to give hydrophobic silica 1. The primary particle diameter of hydrophobic silica 1 was 12 nm and its hydrophobicity was 97.

[Production of Hydrophobic Titanium Oxide 1]

100 parts of titanium oxide (P25, from Nippon Aerosil Co., Ltd.) was treated with 20 parts of γ-mercaptopropyltrimethoxysilane in toluene and was filtered and dried to obtain a hydrophobic titanium oxide 1. The primary particle diameter of hydrophobic titanium oxide 1 was 25 nm and its hydrophobicity was 60.

[Production of Noncrystalline Polyester Resin]

The following were introduced into an autoclave fitted with a vacuum system, water separator, nitrogen gas introduction device, temperature measurement device, and stirring device:

terephthalic acid: 45.0 mass parts, dodecenylsuccinic acid: 3 mass parts, trimellitic acid: 0.45 mass parts, bisphenol A-2 mol propylene oxide adduct: 55 mass parts, bisphenol A-3 mol propylene oxide adduct: 64 mass parts, and dibutyltin oxide: 0.030 mass parts.

A reaction was carried out for 25 hours at 220° C. under normal pressure and a nitrogen atmosphere and for an additional 1 hour under a vacuum of 10 to 20 mmHg. After this, the temperature was dropped to 170° C. and 0.09 parts of trimellitic anhydride was added and a reaction was carried out for 1.5 hours at 170° C. to obtain a noncrystalline polyester resin.

Example 1

15.3 mass parts of sodium phosphate and 4.9 mass parts of 10% hydrochloric acid were introduced into 1,000 mass parts of ion-exchanged water and the temperature was held for 60 minutes at 65° C. while carrying out an $N_2$ purge. While stirring at 12,000 rpm using a TK Homomixer (Tokushu Kika Kogyo Co., Ltd.), an aqueous calcium chloride solution, prepared by dissolving 8.5 mass parts of calcium chloride in 10 mass parts of ion-exchanged water, was introduced all at once to yield an aqueous medium containing a dispersion stabilizer.

Then,

| | |
|---|---|
| styrene | 48 mass parts |
| carbon black (product name: Printex 35 from Orion Engineered Carbons (Pty) Ltd.) | 7.0 mass parts |
| azo compound 8 | 0.50 mass parts |
| charge control agent (BONTRON E-89 from ORIENT CHEMICAL INDUSTRIES CO., LTD.) | 0.40 mass parts |

were introduced into an Attritor disperser (Mitsui Miike Chemical Engineering Machinery Co., Ltd.) and were dispersed for 5 hours at 220 rpm using zirconia beads having a diameter of 1.7 mm to yield a masterbatch dispersion.

The following were added to the above-described polymerizable monomer composition.

| | |
|---|---|
| styrene | 32 mass parts |
| n-butyl acrylate | 20 mass parts |
| noncrystalline polyester resin (Mw = 10,000, acid value = 10.0) | 2.5 mass parts |
| synthetic wax (product name: "Sasol SPRAY30", melting point = 98° C., from Schumann Sasol) | 12 mass parts |

While holding the temperature at 69° C., dissolution and dispersion to homogeneity was carried out using a TK Homomixer (Tokushu Kika Kogyo Co., Ltd.) at 500 rpm. Into this was then dissolved 2.5 mass parts of t-hexylperoxy pivalate (NOF CORPORATION, product name: "PERHEXYL PV", molecular weight: 202, 10-hour half-life: 53.2° C.) as a polymerization initiator, thereby yielding a polymerizable monomer composition.

This polymerizable monomer composition was introduced into the above-described aqueous medium and granulation was performed at pH 5.5 by stirring for 5 minutes and 65° C. under an $N_2$ purge at 10,000 rpm using a TK Homomixer. After this, a reaction was carried out for 6 hours at 65° C. while stirring with a paddle impeller; the temperature was raised to 90° C.; and a reaction was carried out for an additional 6 hours. The reactor was cooled after the completion of the polymerization reaction. This was followed by washing with ion-exchanged water, drying, and pneumatic classification to obtain black particles.

To 100 mass parts of the obtained black particles was added 0.3 mass parts of hydrophobic titanium oxide 1 and mixing was carried out with a Henschel mixer (Mitsui Miike Chemical Engineering Machinery Co., Ltd.), and then 1.5 mass parts of hydrophobic silica 1 was added and mixing was carried out with a Henschel mixer (Mitsui Miike Chemical Engineering Machinery Co., Ltd.) to obtain a toner 1 containing external additives. The properties of the obtained toner 1 are given in Table 5.

With regard to the solubility (C) for azo compound 8, this measurement was performed using a sample having an acid value adjusted to be the same as the acid value of azo compound 8 by carrying out the methyl esterification of the same molar amount of carboxyl groups in polymer component (A-1) as was bound to the azo skeleton moiety structure.

Specifically, of the acrylic acid in polymer component (A-1), the monomer was changed from acrylic acid to methyl acrylate for the same molar amount as was bound to the azo skeleton moiety structure, and the solubility was measured using the polymer produced otherwise the same as polymer component (A-1).

The solubility (B) for the binder resin constituent of the toner was determined as follows.

The molecular weight of the THF-soluble matter in toner 1 was measured by GPC to determine the molecular weight and molecular weight distribution corresponding to the styrene/n-butyl acrylate copolymer that was the binder resin constituent of the toner, and Mp=25,000, Mw=35,000, and Mn=15,000 were thus obtained for toner 1. In addition, toner 1 was dissolved in deuterochloroform and compositional analysis of the soluble matter was performed by $^{1}$H-NMR to obtain styrene:n-butyl acrylate=80:20 (weight ratio).

Solution polymerization was run in toluene at styrene:n-butyl acrylate=80:20 (weight ratio) to produce a polymer having the same molecular weight and molecular weight distribution as the binder resin constituent of toner 1, and this was used as the sample for the solubility testing of the binder resin constituent of the toner. The polymerization initiator used during this sample preparation was the same t-hexylperoxy pivalate (NOF CORPORATION, product name: "PERHEXYL PV", molecular weight: 202, 10-hour half-life: 53.2° C.) as used for toner 1. The same results were also obtained when the solubility was measured on a solubility test sample obtained by dissolving toner 1 in THF and filtering to remove the insoluble matter, e.g., pigment and so forth, and then isolating the binder resin constituent of the toner using preparative liquid chromatography.

Examples 2 to 9, 14, 20 to 76, and 82

External additive-containing toners 2 to 9, 14, 20 to 76, and 82 were prepared proceeding as in Example 1, but changing the type and amount of addition of the azo compound and the type of pigment as indicated in Table 4. The properties of the obtained toners 2 to 9, 14, 20-76, and 82 are given in Table 5.

Examples 16 to 19

External additive-containing toners 16 to 19 were prepared proceeding as in Example 1, but changing the synthetic wax (product name: "Sasol SPRAY30", melting point=98° C., from Schumann•Sasol) to, respectively, paraffin wax (product name: "HNP-9", melting point: 76° C., from Nippon Seiro Co., Ltd.), behenyl behenate (melting point: 72° C.), plant wax (product name: "Carnauba No. 1", melting point: 83° C., from S. Kato & Co.), and dipentaerythritol stearic acid ester (melting point: 76° C.). The properties of the obtained toners 16 to 19 are given in Table 5.

Example 10

(Synthesis of the Toner Binder)

660 mass parts of a bisphenol A-2 mol ethylene oxide adduct, 100 mass parts of a bisphenol A-2 mol propylene oxide adduct, 290 mass parts of terephthalic acid, and 2.5 mass parts of tetrabutoxytitanate were introduced into a reactor equipped with a condenser, stirrer, and nitrogen introduction tube and a reaction was run for 12 hours at 220° C. and normal pressure and then additionally for 6.5 hours under a vacuum of 10 to 15 mmHg. This was followed by cooling to 190° C. and 32 parts of phthalic anhydride was added and a reaction was run for 2 hours. Cooling to 80° C. was then carried out and a reaction was run for 2 hours with 180 mass parts of isophorone diisocyanate in ethyl acetate to obtain an isocyanate-containing prepolymer (1). 267 mass parts of prepolymer (1) and 14 mass parts of isophoronediamine were then reacted for 2 hours at 50° C. to obtain a urea-modified polyester resin (A) having a weight-average molecular weight of 65,000.

Proceeding as described above, 624 mass parts of the bisphenol A-2 mol ethylene oxide adduct, 100 mass parts of the bisphenol A-2 mol propylene oxide adduct, 138 mass parts of terephthalic acid, 138 mass parts of isophthalic acid, and 2.5 mass parts of tetrabutoxytitanate were introduced and polycondensed for 5 hours at 230° C. and normal pressure followed by reaction for an additional 5.5 hours under a vacuum of 10 to 15 mmHg, thereby yielding an unmodified polyester resin (a) having a peak molecular weight of 6,300.

250 mass parts of the urea-modified polyester (A) and 750 mass parts of the unmodified polyester resin (a) were dissolved and mixed in 2,000 mass parts of ethyl acetate solvent to provide an ethyl acetate solution of toner binder (1).

(Toner Production)

240 mass parts of the ethyl acetate solution of toner binder (1), 5.6 mass parts of carbon black (product name: "Printex 35", from Orion Engineered Carbons GmbH), 0.4 mass parts of azo compound 25, 1.0 mass parts of an aluminum compound of 3,5-di-tert-butylsalicylic acid [BONTRON E88 (from ORIENT CHEMICAL INDUSTRIES CO., LTD.)], and 15 mass parts of a synthetic wax (product name: "Sasol SPRAY30", melting point=98° C., from Schumann•Sasol) were introduced into a beaker and stirred at 12,000 rpm at 55° C. using a TK Homomixer and were uniformly dissolved and dispersed to obtain a toner stock solution. 706 parts of ion-exchanged water, 294 parts of a 10% suspension of hydroxyapatite [Supertite 10 (from Nippon Chemical Industries Co., Ltd.)], and 0.17 parts sodium dodecylbenzenesulfonate were introduced into a beaker and were uniformly dissolved. Then, while stirring at 12,000 rpm and 55° C. using a TK Homomixer, the toner stock solution was introduced and stirring was carried out for 3 hours. The mixture was subsequently transferred to a flask fitted with a stirring rod and thermometer and the temperature was raised to 98° C. and the solvent was removed. The aqueous medium was cooled and washing with ion-exchanged water was carried out. This was followed by drying and pneumatic classification to obtain black particles. To 100 mass parts of the obtained black particles was added 0.3 mass parts of hydrophobic titanium oxide 1 and mixing was carried out with a Henschel mixer (Mitsui Miike Chemical Engineering Machinery Co., Ltd.), and then 1.5 mass parts of hydrophobic silica 1 was added and mixing was carried out with a Henschel mixer (Mitsui Miike Chemical Engineering Machinery Co., Ltd.) to obtain a toner 10 containing external additives. The properties of the obtained toner 10 are given in Table 5.

The solubility for polymer component (A-26) was taken to be the solubility (C) for azo compound 25. With regard to the solubility (B) of the binder resin constituent of the toner, this was determined by carrying out the measurement using a 25:75 mixture (mass ratio) of the urea-modified polyester resin (A) and the unmodified polyester resin (a) used for toner 10.

Examples 11 to 13 and 15

External additive-containing toners 11 to 13 and 15 were produced proceeding as in toner production Example 10, but changing the type of azo compound and the type of pigment as indicated in Table 4. The properties of the obtained toners 11 to 13 and 15 are given in Table 5.

Example 77

| | |
|---|---|
| polyester resin 2 (Mw = 8750, Mw/Mn = 2.55, Tg = 61.2 (° C.), acid value = 8.1 (mg KOH/g)) | 100 mass parts |
| carbon black (product name: "Printex 35", from Orion Engineered Carbons GmbH) | 7.0 mass parts |
| azo compound 25 | 0.5 mass parts |
| charge control agent (product name: "BONTRON E-89" from ORIENT CHEMICAL INDUSTRIES CO., LTD.) | 0.5 mass parts |
| synthetic wax (product name: "Sasol SPRAY30", melting point = 98° C., from Schumann • Sasol) | 3.0 mass parts |

These materials were mixed with a Henschel mixer and were then melt-kneaded using a twin-screw kneading extruder at 125° C. The kneaded material was gradually cooled to room temperature and was then subjected to coarse pulverization using a cutter mill, pulverization using a pulverizer that used a jet current, and pneumatic classification to produce black particles.

To 100 mass parts of the obtained black particles was added 0.3 mass parts of hydrophobic titanium oxide 1 and mixing was carried out with a Henschel mixer (Mitsui Miike Chemical Engineering Machinery Co., Ltd.), and then 1.5 mass parts of hydrophobic silica 1 was added and mixing was carried out with a Henschel mixer (Mitsui Miike Chemical Engineering Machinery Co., Ltd.) to obtain a toner 77 containing external additives. The properties of the obtained toner 77 are given in Table 5.

With regard to the solubility (B) for the binder resin constituent of the toner, polyester resin 2 was used as the sample for the solubility testing.

Example 78

An external additive-containing toner 78 was produced proceeding as in Example 77, but changing the polyester resin 2 to a styrene/n-butyl acrylate copolymer (Tg 59.1° C., molecular weight: Mw=27,000). The properties of the obtained toner 78 are given in Table 5.

Example 79

An external additive-containing toner 79 was produced proceeding as in toner production Example 77, but changing azo compound 25 to azo compound 23. The properties of the obtained toner 79 are given in Table 5.

Example 80

An external additive-containing toner 80 was produced proceeding as in toner production Example 78, but changing azo compound 25 to azo compound 23. The properties of the obtained toner 80 are given in Table 5.

Comparative Example 1

An external additive-containing toner 81 was produced proceeding as in toner production Example 1, but omitting the addition of azo compound 8. The properties of the obtained toner 81 are given in Table 5.

Comparative Example 2

An external additive-containing toner 82 was produced proceeding as in toner production Example 1, but changing the azo compound 8 to polymer component (A-23). The properties of the obtained toner 82 are given in Table 5.

Comparative Example 3

An external additive-containing toner 83 was produced proceeding as in toner production Example 1, but changing the 0.50 mass parts of azo compound 8 to 0.04 mass parts of the azo skeleton moiety structure (compound 28). The properties of the obtained toner 83 are given in Table 5.

Comparative Example 4

An external additive-containing toner 84 was produced proceeding as in toner production Example 1, but changing azo compound 8 to azo compound 61. The properties of the obtained toner 84 are given in Table 5.

Comparative Example 5

An external additive-containing toner 85 was produced proceeding as in toner production Example 78, but omitting the addition of azo compound 25. The properties of the obtained toner 85 are given in Table 5.

Comparative Example 6

An external additive-containing toner 86 was produced proceeding as in toner production Example 78, but changing azo compound 25 to azo compound 61. The properties of the obtained toner 86 are given in Table 5.

Test Examples 1 to 80

Various image evaluations were performed using the evaluation instrumentation on each of the above-described toners 1 to 80. The results of these image evaluations are given in Table 6.

Comparative Test Examples 1 to 6

Various image evaluations were performed using the evaluation instrumentation on each of the above-described toners 81 to 86. The results of these image evaluations are given in Table 6.

TABLE 4

| toner No. | type of pigment | type of azo compound | amount of azo compound addition (mass parts) | (mass parts of the azo compound/mass parts of the pigment) · 100 | type of wax |
|---|---|---|---|---|---|
| 1 | CB | 8 | 0.50 | 7.1 | Sasol SPRAY30 |
| 2 | CB | 9 | 0.50 | 7.1 | Sasol SPRAY30 |
| 3 | CB | 10 | 0.50 | 7.1 | Sasol SPRAY30 |
| 4 | CB | 9 | 0.04 | 0.6 | Sasol SPRAY30 |
| 5 | CB | 9 | 0.99 | 14.0 | Sasol SPRAY30 |
| 6 | CB | 9 | 1.98 | 28.0 | Sasol SPRAY30 |
| 7 | PR122 | 9 | 0.50 | 7.1 | Sasol SPRAY30 |
| 8 | PR150 | 9 | 0.50 | 7.1 | Sasol SPRAY30 |
| 9 | PY155 | 9 | 0.50 | 7.1 | Sasol SPRAY30 |
| 10 | CB | 25 | 0.50 | 7.1 | Sasol SPRAY30 |
| 11 | PR122 | 25 | 0.50 | 7.1 | Sasol SPRAY30 |
| 12 | PY180 | 25 | 0.50 | 7.1 | Sasol SPRAY30 |
| 13 | PY185 | 25 | 0.50 | 7.1 | Sasol SPRAY30 |
| 14 | CB | 25 | 0.50 | 7.1 | Sasol SPRAY30 |
| 15 | CB | 8 | 0.50 | 7.1 | Sasol SPRAY30 |
| 16 | CB | 9 | 0.50 | 7.1 | HNP-9 |
| 17 | CB | 9 | 0.50 | 7.1 | behenyl behenate |
| 18 | CB | 9 | 0.50 | 7.1 | Carnauba No. 1 |
| 19 | CB | 9 | 0.50 | 7.1 | dipentaerythritol stearic acid ester |
| 20 | CB | 30 | 0.50 | 7.1 | Sasol SPRAY30 |
| 21 | CB | 31 | 0.50 | 7.1 | Sasol SPRAY30 |
| 22 | CB | 32 | 0.50 | 7.1 | Sasol SPRAY30 |
| 23 | CB | 33 | 0.50 | 7.1 | Sasol SPRAY30 |
| 24 | CB | 34 | 0.50 | 7.1 | Sasol SPRAY30 |
| 25 | CB | 35 | 0.50 | 7.1 | Sasol SPRAY30 |
| 26 | CB | 36 | 0.50 | 7.1 | Sasol SPRAY30 |
| 27 | CB | 37 | 0.50 | 7.1 | Sasol SPRAY30 |
| 28 | CB | 38 | 0.50 | 7.1 | Sasol SPRAY30 |
| 29 | CB | 39 | 0.50 | 7.1 | Sasol SPRAY30 |
| 30 | CB | 40 | 0.50 | 7.1 | Sasol SPRAY30 |
| 31 | CB | 41 | 0.50 | 7.1 | Sasol SPRAY30 |
| 32 | CB | 42 | 0.50 | 7.1 | Sasol SPRAY30 |
| 33 | CB | 43 | 0.50 | 7.1 | Sasol SPRAY30 |
| 34 | CB | 44 | 0.50 | 7.1 | Sasol SPRAY30 |
| 35 | CB | 45 | 0.50 | 7.1 | Sasol SPRAY30 |
| 36 | CB | 46 | 0.50 | 7.1 | Sasol SPRAY30 |
| 37 | CB | 47 | 0.50 | 7.1 | Sasol SPRAY30 |
| 38 | CB | 48 | 0.50 | 7.1 | Sasol SPRAY30 |
| 39 | CB | 49 | 0.50 | 7.1 | Sasol SPRAY30 |
| 40 | CB | 50 | 0.50 | 7.1 | Sasol SPRAY30 |
| 41 | CB | 51 | 0.50 | 7.1 | Sasol SPRAY30 |
| 42 | CB | 52 | 0.50 | 7.1 | Sasol SPRAY30 |
| 43 | CB | 53 | 0.50 | 7.1 | Sasol SPRAY30 |
| 44 | CB | 11 | 0.50 | 7.1 | Sasol SPRAY30 |
| 45 | CB | 12 | 0.50 | 7.1 | Sasol SPRAY30 |
| 46 | CB | 13 | 0.50 | 7.1 | Sasol SPRAY30 |
| 47 | CB | 14 | 0.50 | 7.1 | Sasol SPRAY30 |
| 48 | CB | 15 | 0.50 | 7.1 | Sasol SPRAY30 |
| 49 | CB | 16 | 0.50 | 7.1 | Sasol SPRAY30 |
| 50 | PB(15:3) | 17 | 0.50 | 7.1 | Sasol SPRAY30 |
| 51 | CB | 18 | 0.50 | 7.1 | Sasol SPRAY30 |
| 52 | CB | 19 | 0.50 | 7.1 | Sasol SPRAY30 |
| 53 | CB | 20 | 0.50 | 7.1 | Sasol SPRAY30 |
| 54 | CB | 21 | 0.50 | 7.1 | Sasol SPRAY30 |
| 55 | CB | 22 | 0.50 | 7.1 | Sasol SPRAY30 |
| 56 | CB | 23 | 0.50 | 7.1 | Sasol SPRAY30 |
| 57 | CB | 24 | 0.50 | 7.1 | Sasol SPRAY30 |
| 58 | CB | 26 | 0.50 | 7.1 | Sasol SPRAY30 |
| 59 | CB | 27 | 0.50 | 7.1 | Sasol SPRAY30 |
| 60 | CB | 28 | 0.50 | 7.1 | Sasol SPRAY30 |
| 61 | CB | 1 | 0.50 | 7.1 | Sasol SPRAY30 |
| 62 | CB | 2 | 0.50 | 7.1 | Sasol SPRAY30 |
| 63 | CB | 3 | 0.50 | 7.1 | Sasol SPRAY30 |
| 64 | CB | 4 | 0.50 | 7.1 | Sasol SPRAY30 |
| 65 | CB | 5 | 0.50 | 7.1 | Sasol SPRAY30 |
| 66 | CB | 6 | 0.50 | 7.1 | Sasol SPRAY30 |
| 67 | CB | 7 | 0.50 | 7.1 | Sasol SPRAY30 |
| 68 | CB | 60 | 0.50 | 7.1 | Sasol SPRAY30 |
| 69 | CB | 29 | 0.50 | 7.1 | Sasol SPRAY30 |
| 70 | CB | 54 | 0.50 | 7.1 | Sasol SPRAY30 |
| 71 | CB | 55 | 0.50 | 7.1 | Sasol SPRAY30 |
| 72 | CB | 56 | 0.50 | 7.1 | Sasol SPRAY30 |
| 73 | CB | 57 | 0.50 | 7.1 | Sasol SPRAY30 |
| 74 | CB | 58 | 0.50 | 7.1 | Sasol SPRAY30 |
| 75 | CB | 59 | 0.50 | 7.1 | Sasol SPRAY30 |

TABLE 4-continued

| toner No. | type of pigment | type of azo compound | amount of azo compound addition (mass parts) | (mass parts of the azo compound/mass parts of the pigment) · 100 | type of wax |
|---|---|---|---|---|---|
| 76 | CB | 62 | 0.50 | 7.1 | Sasol SPRAY30 |
| 77 | CB | 25 | 0.50 | 7.1 | Sasol SPRAY30 |
| 78 | CB | 25 | 0.50 | 7.1 | Sasol SPRAY30 |
| 79 | CB | 23 | 0.50 | 7.1 | Sasol SPRAY30 |
| 80 | CB | 23 | 0.50 | 7.1 | Sasol SPRAY30 |
| 81 | CB | — | — | — | Sasol SPRAY30 |
| 82 | CB | — | — | — | Sasol SPRAY30 |
| 83 | CB | — | — | — | Sasol SPRAY30 |
| 84 | CB | 61 | 0.50 | 7.1 | Sasol SPRAY30 |
| 85 | CB | — | — | — | Sasol SPRAY30 |
| 86 | CB | 61 | 0.50 | 7.1 | Sasol SPRAY30 |

TABLE 5

| toner No. | toner particle diameter (D4) | particle diameter distribution (D4/D1) | solubility (A) | solubility (B) | solubility (C) | solubility (B) − solubility (A) | solubility (B) − solubility (C) | adsorption rate of azo compound to pigment (%) |
|---|---|---|---|---|---|---|---|---|
| 1 | 6.5 | 1.18 | 48.3 | 75.5 | 67.8 | 27.2 | 7.7 | 94 |
| 2 | 6.5 | 1.18 | 47.9 | 75.5 | 67.8 | 27.6 | 7.7 | 97 |
| 3 | 6.5 | 1.18 | 46.1 | 75.5 | 67.8 | 29.4 | 7.7 | 97 |
| 4 | 6.5 | 1.18 | 47.9 | 75.5 | 67.8 | 27.6 | 7.7 | 97 |
| 5 | 6.5 | 1.18 | 47.9 | 75.5 | 67.8 | 27.6 | 7.7 | 97 |
| 6 | 6.5 | 1.18 | 47.9 | 75.5 | 67.8 | 27.6 | 7.7 | 97 |
| 7 | 6.5 | 1.25 | 47.9 | 75.5 | 67.8 | 27.6 | 7.7 | 95 |
| 8 | 6.5 | 1.21 | 47.9 | 75.5 | 67.8 | 27.6 | 7.7 | 80 |
| 9 | 6.5 | 1.18 | 47.9 | 75.5 | 67.8 | 27.6 | 7.7 | 75 |
| 10 | 6.5 | 1.26 | 15.9 | 37.8 | 28.9 | 21.9 | 8.9 | 97 |
| 11 | 6.5 | 1.26 | 15.9 | 37.8 | 28.9 | 21.9 | 8.9 | 95 |
| 12 | 6.5 | 1.26 | 15.9 | 37.8 | 28.9 | 21.9 | 8.9 | 80 |
| 13 | 6.5 | 1.26 | 15.9 | 37.8 | 28.9 | 21.9 | 8.9 | 80 |
| 14 | 6.5 | 1.25 | 15.9 | 75.5 | 28.9 | 59.6 | 46.6 | 97 |
| 15 | 6.5 | 1.28 | 48.3 | 37.8 | 67.8 | −10.5 | −30.0 | 94 |
| 16 | 5.5 | 1.22 | 47.9 | 75.5 | 67.8 | 27.6 | 7.7 | 97 |
| 17 | 6.8 | 1.22 | 47.9 | 75.5 | 67.8 | 27.6 | 7.7 | 97 |
| 18 | 7.5 | 1.22 | 47.9 | 75.5 | 67.8 | 27.6 | 7.7 | 97 |
| 19 | 6.1 | 1.22 | 47.9 | 75.5 | 67.8 | 27.6 | 7.7 | 97 |
| 20 | 6.5 | 1.30 | 24.5 | 75.5 | 45.3 | 51.0 | 30.2 | 92 |
| 21 | 6.5 | 1.22 | 27.5 | 75.5 | 52.8 | 48.0 | 22.7 | 92 |
| 22 | 6.5 | 1.18 | 35.5 | 75.5 | 62.5 | 40.0 | 13.0 | 97 |
| 23 | 6.5 | 1.18 | 46.5 | 75.5 | 67.3 | 29.0 | 8.2 | 97 |
| 24 | 6.5 | 1.18 | 55.4 | 75.5 | 69.8 | 20.1 | 5.7 | 97 |
| 25 | 6.5 | 1.18 | 48.3 | 75.5 | 71.7 | 27.2 | 3.8 | 97 |
| 26 | 6.5 | 1.18 | 41.2 | 75.5 | 65.1 | 34.3 | 10.4 | 97 |
| 27 | 6.5 | 1.18 | 44.5 | 75.5 | 74.8 | 31.0 | 0.7 | 97 |
| 28 | 6.5 | 1.18 | 70.5 | 75.5 | 72.5 | 5.0 | 3.0 | 97 |
| 29 | 6.5 | 1.18 | 85.1 | 75.5 | 83.5 | −9.6 | −8.0 | 97 |
| 30 | 6.5 | 1.18 | 61.5 | 75.5 | 68.2 | 14.0 | 7.3 | 90 |
| 31 | 6.5 | 1.18 | 70.1 | 75.5 | 72.1 | 5.4 | 3.4 | 97 |
| 32 | 6.5 | 1.18 | 68.5 | 75.5 | 70.5 | 7.0 | 5.0 | 97 |
| 33 | 6.5 | 1.18 | 66.7 | 75.5 | 70.3 | 8.8 | 5.2 | 97 |
| 34 | 6.5 | 1.18 | 45.3 | 75.5 | 67.8 | 30.2 | 7.7 | 97 |
| 35 | 6.5 | 1.18 | 42.8 | 75.5 | 67.8 | 32.7 | 7.7 | 97 |
| 36 | 6.5 | 1.18 | 38.7 | 75.5 | 67.8 | 36.8 | 7.7 | 97 |
| 37 | 6.5 | 1.18 | 35.8 | 75.5 | 67.8 | 39.7 | 7.7 | 90 |
| 38 | 6.5 | 1.25 | 23.1 | 75.5 | 50.7 | 52.4 | 24.8 | 95 |
| 39 | 6.5 | 1.23 | 26.3 | 75.5 | 53.9 | 49.2 | 21.6 | 95 |
| 40 | 6.5 | 1.20 | 28.5 | 75.5 | 56.1 | 47.0 | 19.4 | 95 |
| 41 | 6.5 | 1.18 | 35.5 | 75.5 | 60.1 | 40.0 | 15.4 | 95 |
| 42 | 6.5 | 1.23 | 40.5 | 75.5 | 68.1 | 35.0 | 7.4 | 97 |
| 43 | 6.5 | 1.18 | 44.8 | 75.5 | 72.4 | 30.7 | 3.1 | 97 |
| 44 | 6.5 | 1.18 | 46.5 | 75.5 | 67.8 | 29.0 | 7.7 | 95 |
| 45 | 6.5 | 1.18 | 46.8 | 75.5 | 67.8 | 28.7 | 7.7 | 95 |
| 46 | 6.5 | 1.18 | 47.1 | 75.5 | 67.8 | 28.4 | 7.7 | 90 |
| 47 | 6.5 | 1.18 | 46.5 | 75.5 | 67.8 | 29.0 | 7.7 | 85 |
| 48 | 6.5 | 1.18 | 46.2 | 75.5 | 67.8 | 29.3 | 7.7 | 90 |
| 49 | 6.5 | 1.18 | 48.6 | 75.5 | 67.8 | 26.9 | 7.7 | 70 |
| 50 | 6.5 | 1.18 | 45.5 | 75.5 | 67.8 | 30.0 | 7.7 | 57 |
| 51 | 6.5 | 1.18 | 48.6 | 75.5 | 67.8 | 26.9 | 7.7 | 75 |
| 52 | 6.5 | 1.18 | 48.5 | 75.5 | 67.8 | 27.0 | 7.7 | 75 |
| 53 | 6.5 | 1.18 | 48.4 | 75.5 | 67.8 | 27.1 | 7.7 | 51 |
| 54 | 6.5 | 1.18 | 46.8 | 75.5 | 67.8 | 28.7 | 7.7 | 35 |
| 55 | 6.5 | 1.18 | 49.2 | 75.5 | 67.8 | 26.3 | 7.7 | 55 |

TABLE 5-continued

| toner No. | toner particle diameter (D4) | particle diameter distribution (D4/D1) | solubility (A) | solubility (B) | solubility (C) | solubility (B) − solubility (A) | solubility (B) − solubility (C) | adsorption rate of azo compound to pigment (%) |
|---|---|---|---|---|---|---|---|---|
| 56 | 6.5 | 1.18 | 48.5 | 75.5 | 67.8 | 27.0 | 7.7 | 40 |
| 57 | 6.5 | 1.18 | 48.5 | 75.5 | 67.2 | 27.0 | 8.3 | 95 |
| 58 | 6.5 | 1.18 | 47.5 | 75.5 | 67.8 | 28.0 | 7.7 | 70 |
| 59 | 6.5 | 1.18 | 47.3 | 75.5 | 67.8 | 28.2 | 7.7 | 60 |
| 60 | 6.5 | 1.18 | 47.1 | 75.5 | 67.8 | 28.4 | 7.7 | 60 |
| 61 | 6.5 | 1.18 | 47.1 | 75.5 | 80.3 | 28.4 | −4.8 | 40 |
| 62 | 6.5 | 1.18 | 47.5 | 75.5 | 61.5 | 28.0 | 14 | 45 |
| 63 | 6.5 | 1.18 | 46.9 | 75.5 | 61.5 | 28.6 | 14 | 40 |
| 64 | 6.5 | 1.18 | 46.8 | 75.5 | 61.5 | 28.7 | 14 | 30 |
| 65 | 6.5 | 1.18 | 47.3 | 75.5 | 61.5 | 28.2 | 14 | 35 |
| 66 | 6.5 | 1.18 | 46.7 | 75.5 | 61.5 | 28.8 | 14 | 35 |
| 67 | 6.5 | 1.18 | 46.9 | 75.5 | 61.5 | 28.6 | 14 | 35 |
| 68 | 6.5 | 1.18 | 49.7 | 75.5 | 61.5 | 25.8 | 14 | 45 |
| 69 | 6.5 | 1.18 | 49.1 | 75.5 | 67.8 | 26.4 | 7.7 | 32 |
| 70 | 6.5 | 1.18 | 49.7 | 75.5 | 61.5 | 25.8 | 14 | 35 |
| 71 | 6.5 | 1.18 | 45.6 | 75.5 | 61.2 | 29.9 | 14.3 | 50 |
| 72 | 6.5 | 1.18 | 43.8 | 75.5 | 61.2 | 31.7 | 14.3 | 60 |
| 73 | 6.5 | 1.18 | 42.1 | 75.5 | 61.2 | 33.4 | 14.3 | 60 |
| 74 | 6.5 | 1.18 | 39.5 | 75.5 | 61.2 | 36.0 | 14.3 | 50 |
| 75 | 6.5 | 1.18 | 25.1 | 75.5 | 62.0 | 50.4 | 13.5 | 32 |
| 76 | 6.5 | 1.18 | 56.3 | 75.5 | 80.3 | 19.2 | −4.8 | 91 |
| 77 | 6.5 | 1.25 | 15.9 | 40.5 | 28.9 | 24.6 | 11.6 | 75 |
| 78 | 6.5 | 1.25 | 15.9 | 74.6 | 28.9 | 58.7 | 45.7 | 75 |
| 79 | 6.5 | 1.25 | 48.5 | 40.5 | 67.8 | −8 | −27.3 | 50 |
| 80 | 6.5 | 1.25 | 48.5 | 74.6 | 67.8 | 26.1 | 6.8 | 50 |
| 81 | 6.5 | 1.18 | — | 75.5 | — | — | — | — |
| 82 | 6.5 | 1.20 | — | 75.5 | — | — | — | 25(*) |
| 83 | 6.5 | 1.20 | — | 75.5 | — | — | — | 92(*) |
| 84 | 6.5 | 1.20 | 50.3 | 75.5 | 67.8 | 25.2 | 7.7 | 24 |
| 85 | 6.5 | 1.26 | — | 75.5 | — | — | — | — |
| 86 | 6.5 | 1.26 | 50.3 | 75.5 | 67.8 | 25.2 | 7.7 | 24 |

(*)No azo compound is present, but the same measurement as with the azo compound is done.

D4: weight-average particle diameter, D1: number-average particle diameter

TABLE 6

| | fogging | | | image | filming | | melt adhesion or sticking of the toner to the toner layer thickness control member | | fixing | offset | storage |
|---|---|---|---|---|---|---|---|---|---|---|---|
| | N/N | H/H | L/L | density | N/N | L/L | N/N | H/H | performance | resistance | stability |
| Example 1 | 0.3 | 0.3 | 0.3 | 1.40 | A | A | A | A | A | A | A |
| Example 2 | 0.3 | 0.3 | 0.3 | 1.40 | A | A | A | A | A | A | A |
| Example 3 | 0.3 | 0.3 | 0.3 | 1.40 | A | A | A | A | A | A | A |
| Example 4 | 0.3 | 0.3 | 0.3 | 1.40 | A | A | A | A | A | A | A |
| Example 5 | 0.3 | 0.3 | 0.3 | 1.40 | A | A | A | A | A | A | A |
| Example 6 | 0.3 | 0.3 | 0.3 | 1.40 | A | A | A | A | A | A | A |
| Example 7 | 0.3 | 0.3 | 0.3 | 1.40 | A | A | A | A | A | A | A |
| Example 8 | 0.3 | 0.3 | 0.3 | 1.40 | A | A | A | A | A | A | A |
| Example 9 | 0.3 | 0.3 | 0.3 | 1.40 | A | A | A | A | A | A | A |
| Example 10 | 1.0 | 1.0 | 1.0 | 1.40 | A | A | A | A | A | A | A |
| Example 11 | 1.0 | 1.0 | 1.0 | 1.40 | A | A | A | A | A | A | A |
| Example 12 | 1.0 | 1.0 | 1.0 | 1.40 | A | A | A | A | A | A | A |
| Example 13 | 1.0 | 1.0 | 1.0 | 1.40 | A | A | A | A | A | A | A |
| Example 14 | 1.5 | 1.5 | 1.5 | 1.34 | A | A | A | A | A | A | A |
| Example 15 | 1.5 | 1.5 | 1.5 | 1.40 | A | A | A | B | A | C | A |
| Example 16 | 0.3 | 0.5 | 0.3 | 1.40 | A | A | A | A | A | A | A |
| Example 17 | 0.3 | 0.3 | 0.3 | 1.40 | A | A | A | A | A | B | A |
| Example 18 | 0.3 | 0.3 | 0.3 | 1.40 | A | A | A | A | A | B | A |
| Example 19 | 0.3 | 0.3 | 0.3 | 1.40 | A | A | A | A | A | B | A |
| Example 20 | 1.0 | 1.4 | 1.0 | 1.34 | A | B | A | B | A | A | A |
| Example 21 | 1.0 | 1.2 | 1.0 | 1.36 | A | A | A | B | A | A | A |
| Example 22 | 0.6 | 0.6 | 0.6 | 1.39 | A | A | A | A | A | A | A |
| Example 23 | 0.3 | 0.3 | 0.3 | 1.40 | A | A | A | A | A | A | A |
| Example 24 | 0.3 | 0.3 | 0.3 | 1.40 | A | A | A | A | A | A | A |
| Example 25 | 0.3 | 0.3 | 0.3 | 1.40 | A | A | A | A | A | A | A |
| Example 26 | 0.3 | 0.3 | 0.3 | 1.40 | A | A | A | A | A | A | A |
| Example 27 | 0.3 | 0.3 | 0.3 | 1.40 | A | A | A | A | A | A | A |
| Example 28 | 0.3 | 0.3 | 0.3 | 1.40 | A | A | A | A | A | A | A |
| Example 29 | 0.4 | 0.4 | 0.4 | 1.40 | A | A | A | B | A | C | A |
| Example 30 | 0.3 | 0.3 | 0.3 | 1.40 | A | A | A | A | A | A | A |
| Example 31 | 0.6 | 0.6 | 0.6 | 1.32 | A | A | A | A | A | A | B |

TABLE 6-continued

| | fogging | | | image | filming | | melt adhesion or sticking of the toner to the toner layer thickness control member | | fixing | offset | storage |
|---|---|---|---|---|---|---|---|---|---|---|---|
| | N/N | H/H | L/L | density | N/N | L/L | N/N | H/H | performance | resistance | stability |
| Example 32 | 0.6 | 0.6 | 0.6 | 1.34 | A | A | A | A | A | A | A |
| Example 33 | 0.3 | 0.3 | 0.3 | 1.40 | A | A | A | A | A | A | A |
| Example 34 | 0.3 | 0.3 | 0.3 | 1.40 | A | A | A | A | A | A | A |
| Example 35 | 0.3 | 0.3 | 0.3 | 1.40 | A | A | A | A | A | A | A |
| Example 36 | 0.3 | 0.3 | 0.3 | 1.39 | A | A | A | A | A | A | A |
| Example 37 | 0.3 | 0.3 | 0.3 | 1.39 | A | A | A | A | B | A | A |
| Example 38 | 1.0 | 1.4 | 1.0 | 1.37 | A | B | A | A | A | A | A |
| Example 39 | 1.0 | 1.1 | 1.0 | 1.37 | A | B | A | A | A | A | A |
| Example 40 | 0.6 | 0.9 | 0.6 | 1.37 | A | B | A | A | A | A | A |
| Example 41 | 0.6 | 0.6 | 0.6 | 1.38 | A | A | A | A | A | A | A |
| Example 42 | 0.5 | 0.5 | 0.5 | 1.39 | A | A | A | A | A | A | A |
| Example 43 | 0.3 | 0.3 | 0.3 | 1.40 | A | A | A | A | A | A | A |
| Example 44 | 0.6 | 0.8 | 0.6 | 1.37 | A | A | A | A | A | A | A |
| Example 45 | 0.6 | 0.8 | 0.6 | 1.37 | A | A | A | A | A | A | A |
| Example 46 | 0.6 | 0.8 | 0.6 | 1.37 | A | A | A | A | A | A | A |
| Example 47 | 0.6 | 0.8 | 0.8 | 1.37 | A | A | A | A | A | A | A |
| Example 48 | 0.6 | 0.8 | 0.8 | 1.37 | A | A | A | A | A | A | A |
| Example 49 | 0.6 | 0.8 | 0.6 | 1.37 | A | A | A | A | A | A | A |
| Example 50 | 0.6 | 1.2 | 0.6 | 1.30 | A | A | A | A | A | A | A |
| Example 51 | 0.6 | 0.8 | 0.6 | 1.37 | A | A | A | A | A | A | A |
| Example 52 | 0.6 | 0.8 | 0.7 | 1.37 | A | A | A | A | A | A | A |
| Example 53 | 0.6 | 0.8 | 0.6 | 1.36 | A | A | A | A | A | A | A |
| Example 54 | 0.6 | 0.8 | 0.7 | 1.34 | A | A | A | A | A | A | A |
| Example 55 | 0.6 | 0.9 | 0.8 | 1.33 | A | A | A | A | A | A | A |
| Example 56 | 0.6 | 0.9 | 0.8 | 1.33 | A | A | A | A | A | A | A |
| Example 57 | 0.6 | 0.8 | 0.6 | 1.37 | A | A | A | A | A | A | A |
| Example 58 | 1.0 | 1.1 | 1.0 | 1.33 | A | A | A | A | A | A | A |
| Example 59 | 1.0 | 1.1 | 1.0 | 1.32 | A | A | A | A | A | A | A |
| Example 60 | 1.0 | 1.1 | 1.0 | 1.32 | A | A | A | A | A | A | A |
| Example 61 | 1.3 | 1.3 | 1.3 | 1.30 | A | B | A | A | A | A | A |
| Example 62 | 1.3 | 1.3 | 1.3 | 1.30 | A | B | A | A | A | A | A |
| Example 63 | 1.3 | 1.3 | 1.3 | 1.28 | A | B | A | A | A | A | A |
| Example 64 | 1.3 | 1.3 | 1.3 | 1.25 | A | B | A | A | A | A | A |
| Example 65 | 1.3 | 1.3 | 1.3 | 1.25 | A | B | A | A | A | A | A |
| Example 66 | 1.3 | 1.3 | 1.3 | 1.25 | A | B | A | A | A | A | A |
| Example 67 | 1.3 | 1.3 | 1.3 | 1.25 | A | B | A | A | A | A | A |
| Example 68 | 1.3 | 1.3 | 1.3 | 1.29 | A | B | A | A | A | A | A |
| Example 69 | 1.5 | 1.5 | 1.5 | 1.25 | A | A | A | A | A | A | A |
| Example 70 | 1.3 | 1.3 | 1.3 | 1.25 | A | B | A | A | A | A | A |
| Example 71 | 1.3 | 1.3 | 1.3 | 1.30 | A | B | A | A | A | A | A |
| Example 72 | 1.3 | 1.3 | 1.3 | 1.31 | A | B | A | A | A | A | A |
| Example 73 | 1.3 | 1.3 | 1.3 | 1.32 | A | B | A | A | A | A | A |
| Example 74 | 1.3 | 1.3 | 1.3 | 1.30 | A | B | A | A | A | A | A |
| Example 75 | 1.6 | 1.6 | 1.6 | 1.25 | A | B | A | B | A | A | A |
| Example 76 | 0.3 | 0.3 | 0.3 | 1.37 | A | A | A | A | A | A | A |
| Example 77 | 1.8 | 1.8 | 1.8 | 1.39 | B | B | B | B | A | A | B |
| Example 78 | 1.8 | 2.0 | 1.8 | 1.34 | B | B | B | B | A | A | B |
| Example 79 | 1.8 | 2.0 | 1.8 | 1.34 | B | B | B | B | A | C | B |
| Example 80 | 1.8 | 1.8 | 1.8 | 1.39 | B | B | B | B | A | A | A |
| Comparative Example 1 | 1.8 | 1.8 | 1.8 | 0.85 | A | B | A | B | A | A | A |
| Comparative Example 2 | 1.8 | 1.8 | 1.8 | 0.92 | A | B | A | B | A | A | A |
| Comparative Example 3 | 1.8 | 2.0 | 1.8 | 1.16 | A | B | A | B | A | A | A |
| Comparative Example 4 | 1.8 | 2.0 | 1.8 | 1.00 | A | B | A | B | A | A | A |
| Comparative Example 5 | 3.5 | 3.5 | 3.5 | 1.20 | B | C | B | C | A | A | C |
| Comparative Example 6 | 3.5 | 3.5 | 3.5 | 1.21 | B | C | B | C | A | A | C |

Evaluations were carried out as described in the following for the various image evaluations.

<Fogging>

To measure the fogging, the evaluation instrumentation described below was used as the image-forming apparatus and a durability test was run at a print percentage of 1% in a mode in which a one-minute pause was implemented every two prints and in a normal-temperature, normal-humidity environment (N/N: temperature=25.0° C., humidity=60% RH), a high-temperature, high-humidity environment (H/H: temperature=32.5° C., humidity=85% RH), and a low-temperature, low-humidity environment (L/L: temperature=10° C., humidity=10% RH). After an initial durability test run of 13,000 prints, standing was carried out for 6 days in the particular environment, after which the amount of fogging on the first image sample print was measured using a REFLECT METER Model TC-6DS from Tokyo Denshoku Co., Ltd. and was determined using the following formula. Ordinary A4 size paper (GF-0081A4 from Canon Marketing Japan Inc.) was used as the recording material used in the durability test.

amount of fogging (%)=(whiteness of the recording material prior to print out)−(whiteness of the nonimage-forming area (white region) of the recording material after print out).

<Image Density>

For the initial image density, one print of a full-surface solid chart, in which the toner laid-on level on the paper was set to 0.33 (mg/cm$^2$), was made using the evaluation instrumentation described below in a normal-temperature, normal-humidity environment (N/N: temperature=23.5° C., humidity=60% RH) and the image density of each image was measured. For the density of the image sample, the density was measured using a REFLECT METER Model TC-6DS from Tokyo Denshoku Co., Ltd. Ordinary A4 size paper (GF-0081A4 from Canon Marketing Japan Inc.) was used as the recording material.

<Fixing Performance>

For the fixing performance, the evaluation instrumentation described below was used in a low-temperature, low-humidity environment (L/L: temperature=15° C., humidity=10% RH). It was powered up from a condition in which the machine and toner-filled cartridge had been acclimated to the environment (after standing for 24 hours in the indicated environment). Immediately after the waiting period, a horizontal line pattern with a width of 200 μm (200 μm horizontal width, 200 μm interval) was printed out and the 50th printed image was used for the evaluation of the fixing performance. To evaluate the fixing performance, the image was rubbed with lens-cleaning paper for five back-and-forth excursions under a load of 100 g, and the image attrition was evaluated as the average decline (%) in the reflection density.

Bond paper with a surface smoothness of not more than 10 [sec] was used in the evaluation. The evaluation scale is given below.

A: the density decline is less than 10%

B: the density decline is less than 15% and greater than or equal to 10%

C: The density decline is less than 20% and greater than or equal to 15%

<Offset Resistance>

For the offset resistance, the evaluation instrumentation described below was used in a high-temperature, high-humidity environment (H/H: temperature=32.5° C., humidity=80% RH). It was powered up from a condition in which the machine and toner-filled cartridge had been acclimated to the environment (after standing for 24 hours in the indicated environment). Immediately after the waiting period, 100 prints were made of a full surface solid image, and the evaluation was performed on this image sample.

OHP film (CG3700, from Sumitomo 3M Limited) was used in the evaluation. The evaluation scale is given below.

Offset Resistance

A: production of offset completely absent

B: very minor offset is produced, which is unproblematic from a practical standpoint (produced on not more than 2 sheets)

C: very minor offset is produced, which is unproblematic from a practical standpoint (produced on 3 or 4 sheets)

D: offset is produced

<Melt Adhesion or Sticking of Toner to the Toner Layer Thickness Control Member>

For the melt adhesion or sticking of toner to the toner layer thickness control member, the evaluation instrumentation described below was used and a durability test was run at a print percentage of 1% in a mode in which a one-minute pause was implemented every two prints and in a normal-temperature, normal-humidity environment (N/N: temperature=23.5° C., humidity=60% RH) and a high-temperature, high-humidity environment (H/H: temperature=32.5° C., humidity=80% RH). The image sample on the 8000th print in the durability run from the start was visually evaluated. Ordinary A4 size paper (GF-0081A4 from Canon Marketing Japan Inc.) was used as the recording material. The evaluation scale is given below.

A: production on the image is completely absent

B: minor production on the image, but unproblematic from a practical standpoint (from 1 to not more than 3 minor stripes at the edge)

C: production on the image (at least 4 stripes at the edge)

<Filming of the Latent Image Bearing Member>

For the filming of the latent image bearing member, the evaluation instrumentation described below was used and a durability test was run at a print percentage of 1% by continuous printing in a normal-temperature, normal-humidity environment (N/N: temperature=23.5° C., humidity=60% RH) and a low-temperature, low-humidity environment (L/L: temperature=15° C., humidity=10% RH). The image sample on the 2000th print in the durability run from the start was visually evaluated. Ordinary A4 size paper (GF-0081A4 from Canon Marketing Japan Inc.) was used as the recording material. The evaluation scale is given below.

A: production completely absent

B: minor production, but unproblematic from a practical standpoint

C: production occurs

<Evaluation of the Storage Stability of the Toner>

To evaluate the storage stability of the toner, 10 g of the toner was weighed into a 100-mL plastic cup and was allowed to stand for 3 days in a 50° C. thermostat. This was followed by evaluation by the sievability at 200 mesh (aperture). The measurement instrument was a powder tester (from Hosokawa Micron Corporation) equipped with a digital vibrometer (DIGITAL VIBLATIONMETERMODEL 1332 from Showa Sokki Corporation).

For the measurement method, the toner to be evaluated was loaded on the 200-mesh sieve (75 μm aperture) that had been installed; adjustment was made to provide 0.50 mm (peak-to-peak) at the digital vibrometer for the displacement value; and vibration was applied for 30 seconds. After this, the storage stability was evaluated based on the status of the toner aggregates remaining on the individual sieves. The evaluation scale is given below.

A: the amount of residual toner on the mesh is less than 1.0 g and the flowability is excellent B: the amount of residual toner on the mesh is from 1.0 g to less than 2.5 g, and, while aggregates are present, they are easily disaggregated C: the amount of residual toner on the mesh is at least 2.5 g, or aggregates are present and cannot be easily disaggregated (The Evaluation Instrumentation)

A commercial LBP-2710 (from Canon Inc.) was used. Its process speed was modified to 220 mm/s. The toner was removed from a commercially acquired magenta cartridge; its interior was cleaned with an air blower; and it was then filled with 260 g of the toner of the present invention. The toner was removed from the other cyan, yellow, and black cartridges, which were then inserted in their respective stations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-044322, filed Feb. 29, 2012, which is hereby incorporated by reference herein in its entirety.

What is claimed is:

1. A toner containing a binder resin, a pigment, and an azo compound, wherein the pigment is selected from the group consisting of C. I. Pigment Blue 15, C. I. Pigment Blue 15:1, C. I. Pigment Blue 15:2, C. I. Pigment Blue 15:3, C. I. Pigment Blue 15:4, C. I. Pigment Violet 19, C. I. Pigment Red 122, C. I. Pigment Red 150, C. I. Pigment Yellow 120, C. I. Pigment Yellow 151, C. I. Pigment Yellow 185 and carbon black, wherein the azo compound contains a polymer component selected from the group consisting of a vinyl polymer-type resin, a polyester, a polyurethane, a polyamide resin and a hybrid resin in which a plurality of the preceding are chemically bonded, and a moiety in the azo compound other than the polymer component is represented by the following general formula (1):

formula (1)

[C1]

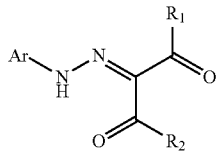

in general formula (1), any one of $R_1$, $R_2$, and Ar is bound to the polymer component with a single bond or a linking group;

$R_1$ not bound to the polymer component represents a monovalent group selected from the group consisting of an alkyl group, phenyl group, $OR_4$ group, and $NR_5R_6$ group (in which $R_4$ to $R_6$ each independently represent a hydrogen atom, alkyl group, phenyl group, or aralkyl group);

$R_1$, which is bound to the polymer component with a single bond or a linking group, represents a divalent group of which a hydrogen atom is removed from the corresponding monovalent group of $R_1$ and the linking group is a divalent linking group selected from the group consisting of an amide group, ester group, urethane group, urea group, alkylene group, phenylene group, —O—, —$NR_3$—, and —$NHCH(CH_2OH)CH_2$—wherein $R_3$ represents a hydrogen atom, alkyl group, phenyl group, or aralkyl group;

$R_2$ not bound to the polymer component represents a monovalent group selected from the group consisting of an alkyl group, phenyl group, $OR_8$ group, and $NR_9R_{10}$ group wherein $R_8$ to $R_{10}$ each independently represent a hydrogen atom, alkyl group, phenyl group, or aralkyl group;

$R_2$, which is bound to the polymer component with a single bond or a linking group, represents a divalent group of which a hydrogen atom is removed from the corresponding monovalent group of $R_2$, and the linking group is a divalent linking group (a) selected from the group consisting of an alkylene group, phenylene group, carboxylate ester group, carboxylamide group, sulfonate ester group, sulfonamide group, —O—, —$NR_7$—, and —$NHCH(CH_2OH)CH_2$— wherein $R_7$ represents a hydrogen atom, alkyl group, phenyl group, or aralkyl group;

Ar not bound to the polymer component represents an aryl group;

Ar, which is bound to the polymer component with a single bond or a linking group, represents a divalent group of which a hydrogen atom is removed from the corresponding aryl group of Ar, and the linking group is a divalent linking group selected from the group consisting of an amide group, ester group, urethane group, urea group, alkylene group, phenylene group, —O—, —$NR_3$—, and —$NHCH(CH_2OH)CH_2$— wherein $R_3$ represents a hydrogen atom, alkyl group, phenyl group or aralkyl group); and designating as (A) the solubility for the azo compound in a toluene-hexane solubility test and designating as (B) the solubility for the binder resin in the toluene-hexane solubility test, the (A) and the (B) satisfy the relationship $|(B)-(A)| \leq 60$.

2. The toner according to claim 1, wherein the azo compound represented by general formula (1) is represented by the following general formula (2):

formula (2)

[C2]

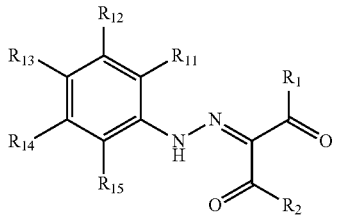

in general formula (2), any one of $R_1$, $R_2$, and $R_{11}$ to $R_{15}$ is bound to the polymer component with a single bond or a linking group, wherein $R_1$ and $R_2$ and the linking group bound to $R_1$ and $R_2$ have the same definitions as for general formula (1);

$R_{11}$ to $R_{15}$ not bound to the polymer component each independently represent a monovalent group selected from the group consisting of a hydrogen atom, $COOR_{16}$ group, and $CONR_{17}R_{18}$ group (in which $R_{16}$ to $R_{18}$ each independently represent a hydrogen atom, $C_{1-6}$ alkyl group, phenyl group, or aralkyl group);

any one of $R_{11}$ to $R_{15}$, which is bound to the polymer component with a single bond or a linking group, represents a divalent group of which a hydrogen atom is removed from the corresponding of any one of $R_{11}$ to $R_{15}$, the linking group is a divalent linking group selected from the group consisting of an amide group, ester group, urethane group, urea group, alkylene group, phenylene group, —O—, —$NR_3$—, and —$NHCH(CH_2OH)CH_2$— wherein $R_3$ represents a hydrogen atom, alkyl group, phenyl group or aralkyl group.

3. The toner according to claim 1, wherein $R_2$ in general formula (1) is an $NR_9R_{10}$ group, where $R_9$ is a hydrogen atom and $R_{10}$ is a phenyl group.

4. The toner according to claim 1, wherein $R_2$ in general formula (1) is an $NR_9R_{10}$ group, where $R_9$ is a hydrogen atom, and $R_{10}$ is a phenyl group, of which a hydrogen atom is removed, and bound to the polymer component with the divalent linking group (a).

5. The toner according to claim 1, wherein the azo compound represented by general formula (1) is represented by the following general formula (3) or general formula (4):

[C3]

formula (3)

[C3]

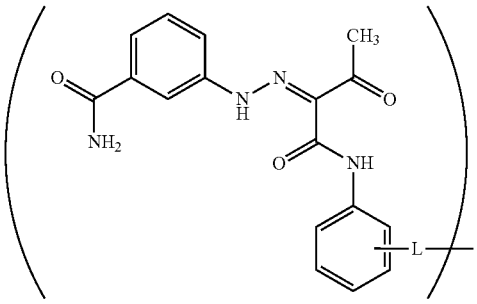

formula (4)

[C4]

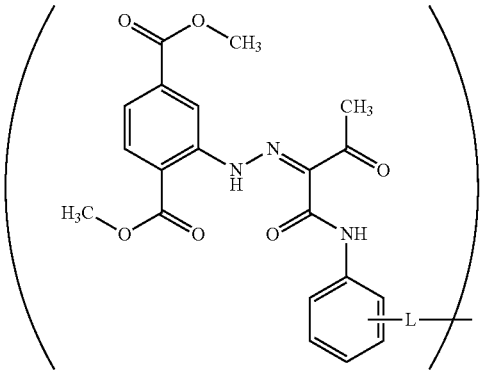

wherein in general formulas (3) and (4), L represents the divalent linking group (a) for bonding to the polymer component.

6. The toner according to claim 1, wherein the polymer component is a copolymer or polymer that contains a monomer unit represented by the following general formula (5) as a constituent component:

formula (5)

[C5]

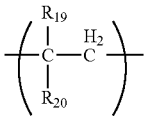

wherein in general formula (5), $R_{19}$ represents a hydrogen atom or an alkyl group having 1 or 2 carbon atoms and $R_{20}$ represents a phenyl group, carboxyl group, carboxylate ester group, or carboxylamide group.

7. The toner according to claim 1, wherein the polymer component is a polymer containing a polyester resin and when the any one of $R_1$, $R_2$, and Ar in the azo compound represented by general formula (1) is bound to the polymer component, bonding occurs with a linking group and the linking group bound to the $R_1$, $R_2$, or Ar is —O— or —NH—.

8. The toner according to claim 1, wherein when, in a toluene-hexane solubility test, designating as (C) the solubility of the polymer component in the azo compound, and in the toluene-hexane solubility test, designating as (B) the solubility of the binder resin constituting the toner, (B) and (C) satisfy the relationship $|(B)-(C)| \leq 35$.

9. The toner according to claim 1, wherein when, in a toluene-hexane solubility test, designating as (A) the solubility of the azo compound, and in the toluene-hexane solubility test, designating as (B) the solubility of the binder resin constituting the toner, (A) and (B) satisfy the relationship $35 \leq (A) < (B)$.

10. The toner according to claim 1, wherein the toner contains a hydrocarbon wax.

11. The toner according to claim 1, wherein the azo compound has an acid value of not more than 30 mg KOH/g.

12. The toner according to claim 1, wherein the toner is a toner produced by, in an aqueous medium, dispersing and granulating a polymerizable monomer composition containing the pigment, the azo compound, and a polymerizable monomer; and polymerizing the polymerizable monomer present in the particles provided by the granulation.

13. The toner according to claim 1, wherein the toner is produced by: granulating, in an aqueous medium, a mixed solution in which a toner composition containing the binder resin that constitutes the toner is dissolved or dispersed in an organic solvent; and removing the organic solvent present in the particles provided by the granulation.

14. The toner according to claim 1, wherein the pigment is selected from the group consisting of C. I. Pigment Blue 15:3, C. I. Pigment Red 122, C. I. Pigment Red 150, C. I. Pigment Yellow 185 and carbon black.

* * * * *